US007390600B2

(12) United States Patent
Toda et al.

(10) Patent No.: US 7,390,600 B2
(45) Date of Patent: Jun. 24, 2008

(54) LATENT ELECTROSTATIC IMAGE BEARING MEMBER, PROCESS CARTRIDGE, IMAGE FORMING APPARATUS, AND IMAGE FORMING PROCESS

(75) Inventors: Naohiro Toda, Yokohama (JP); Hiroshi Tamura, Susono (JP); Yoshiki Yanagawa, Numazu (JP); Tetsuro Suzuki, Fuji (JP)

(73) Assignee: Ricoh Company, Ltd., Tokyo (JP)

( * ) Notice: Subject to any disclaimer, the term of this patent is extended or adjusted under 35 U.S.C. 154(b) by 332 days.

(21) Appl. No.: 11/217,407

(22) Filed: Sep. 2, 2005

(65) Prior Publication Data

US 2006/0051688 A1 Mar. 9, 2006

(30) Foreign Application Priority Data

Sep. 3, 2004 (JP) ..... 2004-257358
Nov. 5, 2004 (JP) ..... 2004-322926

(51) Int. Cl.
*G03G 5/147* (2006.01)
*G03G 5/047* (2006.01)

(52) U.S. Cl. ..... 430/58.7; 430/123.42; 430/66; 430/970; 399/159

(58) Field of Classification Search ..... 430/66, 430/970, 58.7, 123.42; 399/159
See application file for complete search history.

(56) References Cited

U.S. PATENT DOCUMENTS 5,322,753 A 6/1994 Tamura et al.
5,492,784 A 2/1996 Yoshikawa et al.
5,608,010 A 3/1997 Tamura et al.
5,723,243 A 3/1998 Sasaki et al.
5,747,204 A 5/1998 Anzai et al.
5,830,980 A 11/1998 Anzai et al.
5,840,454 A 11/1998 Nagai et al.
5,853,935 A 12/1998 Suzuki et al.
5,871,876 A 2/1999 Ikuno et al.

(Continued)

FOREIGN PATENT DOCUMENTS

JP 56-48637 5/1981

(Continued)

OTHER PUBLICATIONS

U.S. Appl. No. 11/157,998, filed Jun. 22, 2005, Tamura et al.

(Continued)

*Primary Examiner*—Christopher RoDee
(74) *Attorney, Agent, or Firm*—Oblon, Spivak, McClelland, Maier & Neustadt, P.C.

(57) ABSTRACT

An object is to provide a latent electrostatic image bearing member that can provide high-quality images for prolonged periods, owing to photosensitive layers and crosslinked surface layers having excellent flaw and wear resistance and appropriate electric properties, image forming method, image forming apparatus and process cartridge that employ latent electrostatic image bearing member respectively. Accordingly, provided is a latent electrostatic image bearing member that comprises a support and at least a photosensitive layer and a crosslinked surface layer disposed on the support, wherein the crosslinked surface layer comprises a reactant from radical polymerizable compounds having three or more functionalities with no charge transport structure and radical polymerizable compounds having one functionality with charge transport structure, and at least two different antioxidants.

22 Claims, 9 Drawing Sheets

U.S. PATENT DOCUMENTS

| | | | | |
|---|---|---|---|---|
| 6,018,014 | A | 1/2000 | Nagai et al. | |
| 6,030,733 | A | 2/2000 | Kami et al. | |
| 6,066,428 | A | 5/2000 | Katayama et al. | |
| 6,093,784 | A | 7/2000 | Tamura et al. | |
| 6,151,468 | A | 11/2000 | Kami et al. | |
| 6,194,535 | B1 | 2/2001 | Katayama et al. | |
| 6,210,848 | B1 | 4/2001 | Nagai et al. | |
| 6,326,112 | B1 | 12/2001 | Tamura et al. | |
| 6,641,964 | B2 | 11/2003 | Ikuno et al. | |
| 6,790,572 | B2 | 9/2004 | Tamoto et al. | |
| 6,844,124 | B2 | 1/2005 | Ikuno et al. | |
| 6,858,362 | B2 | 2/2005 | Tamoto et al. | |
| 6,936,388 | B2 | 8/2005 | Suzuki et al. | |
| 7,175,957 | B2 * | 2/2007 | Suzuki et al. | 430/66 |
| 7,179,573 | B2 * | 2/2007 | Suzuki et al. | 430/66 |
| 2004/0053149 | A1 | 3/2004 | Toda et al. | |
| 2004/0053152 | A1 | 3/2004 | Nagai et al. | |
| 2004/0115545 | A1 * | 6/2004 | Horgan et al. | 430/58.8 |
| 2004/0120730 | A1 | 6/2004 | Niimi et al. | |
| 2004/0126686 | A1 | 7/2004 | Toda et al. | |
| 2004/0234875 | A1 | 11/2004 | Toda et al. | |
| 2004/0248024 | A1 | 12/2004 | Suzuki et al. | |
| 2004/0253527 | A1 | 12/2004 | Suzuki et al. | |
| 2005/0100804 | A1 | 5/2005 | Tamoto et al. | |
| 2005/0141919 | A1 | 6/2005 | Kitajima et al. | |
| 2005/0158644 | A1 | 7/2005 | Kondo et al. | |
| 2005/0175911 | A1 | 8/2005 | Tamoto et al. | |

FOREIGN PATENT DOCUMENTS

| | | | |
|---|---|---|---|
| JP | 64-1728 | | 1/1989 |
| JP | 4-281461 | | 10/1992 |
| JP | 8-179677 | | 7/1996 |
| JP | 2000-66425 | | 3/2000 |
| JP | 2001-51440 | | 2/2001 |
| JP | 3194392 | | 6/2001 |
| JP | 2001175016 | A * | 6/2001 |
| JP | 3262488 | | 12/2001 |
| JP | 2002-207308 | | 7/2002 |
| JP | 2003-177654 | | 6/2003 |

OTHER PUBLICATIONS

U.S. Appl. No. 11/403,012, filed Apr. 13, 2006, Toda.
U.S. Appl. No. 11/480,517, filed Jul. 5, 2006, Yanagawa et al.
U.S. Appl. No. 11/736,258, filed Apr. 17, 2007, Kawasaki et al.

* cited by examiner

LATENT ELECTROSTATIC IMAGE BEARING MEMBER, PROCESS CARTRIDGE, IMAGE FORMING APPARATUS, AND IMAGE FORMING PROCESS

BACKGROUND OF THE INVENTION

1. Field of the Invention

The present invention relates to latent electrostatic image bearing member (hereafter may be referred to as "photoconductor" or "electrophotographic photoconductor") that can provide high-quality images for prolonged periods, owing to photosensitive layers and crosslinked surface layers having excellent flaw and wear resistance and appropriate electric properties; process cartridge, image forming process and image forming apparatus that utilize latent electrostatic image bearing member respectively.

2. Description of the Related Art

Recently, organic photoconductors (OPC) are widely employed in copiers, facsimiles, laser printers, and composite apparatuses thereof owing to excellent performance and various advantages, in place of conventional inorganic photoconductors. The reasons for replacement are, for example: (1) favorable optical properties such as absorbable wavelength region and absorption rate, (2) electrical properties such as high sensitivity and stable charging ability, (3) broad selection of materials, (4) manufacturability, (5) low cost, (6) no toxic effects, etc.

On the other hand, photoconductors are more and more miniaturized as image forming apparatuses are being downsized; in addition, the trend toward speeding up and maintenance-free performance of machines are spurring the demand for ruggedization of photoconductors nowadays.

However, organic photoconductors, due to their relatively low hardness of surface layers that consist mainly of low-molecular charge transport substances and inactive polymers, tends to wear away under repeated usages in electrophotographic processes by the mechanical stress associated with developing systems or cleaning systems, etc.

To pursue high image quality, rubber hardness of cleaning blades as well as the pressure applied onto the photoconductors is being forced to increase so as to improve cleaning ability accompanied by the miniaturization of toner particles, therefore accelerating the wear on photoconductors. This kind of wear on photoconductors deteriorate sensitivity and electric properties such as charging ability etc., resulting in disordered images such as image density degradation or background smear, etc. Flaws caused by local wears often bring about streaks on images due to insufficient cleaning. Such wear and flaws typically dominate the cause of short lives of photoconductors that are being exchanged shortly.

Therefore, it is essential to reduce the amount of wear for improved durability of organic photoconductors, and it is the most significant problem in the field to be settled in a prompt manner.

Technologies to improve wear resistance of photosensitive layers, for example, (1) incorporation of curable binders into the crosslinked charge transporting layers e.g. Japanese Patent Application Laid-Open (JP-A) No. 56-48637, (2) employment of charge transport polymers e.g. JP-A No. 64-1728, (3) dispersion of inorganic fillers into crosslinked charge transporting layers e.g. JP-A No. 4-281461, and the like are proposed.

However, the technology incorporating curable binders described in (1) has insufficient compatibility with charge transport substances and residual voltage tends to increase owing to impurities such as polymerization initiators and/or unreacted residual groups, it is more likely to deteriorate image density. The technology employing charge transport polymers described in (2) can improve wear resistance in some measure; however, durability of organic photoconductors does not improve sufficiently. Moreover, electric properties of organic photoconductors are likely to become unstable because of difficulties in polymerizing and purifying charge transport polymers. Furthermore, coating liquids typically become excessively viscous for processing.

The technology in which inorganic fillers are dispersed as described in (3) may exhibit higher wear resistance compared to the conventional photoconductors in which the low-molecular charge transport substances are being dispersed into inactive polymers, however, charge traps on the surfaces of inorganic fillers tend to increase residual potential, thereby increasing the tendency for image density degradation. Also, if unevenness of inorganic fillers and binder resin of photoconductor surface is significant, defective cleaning may occur, resulting in toner filming or image deletion.

Based on these technologies (1), (2), and (3), the overall durability of organic photoconductors including electrical and mechanical durability has not achieved the satisfactory level.

Photoconductors containing cured materials of multi-functional acrylate monomers are proposed in order to improve wear and flaw resistance described in (1) e.g. JP-B No. 3262488. It is described as cured materials of multi-functional acrylate monomers are to be contained in the protective layer disposed on photosensitive layers, however, there is no specific description or examples other than the charge transport substances may be contained in the protective layers. Furthermore, when low-molecular charge transport substances are added to the crosslinked charge transporting layers, compatibility issue may arise with the cured materials. As a result, deposition and clouding of low-molecular charge transport substances may occur, in addition to the image density deterioration and reduced mechanical strength due to the increase in exposed-area potential.

More specifically, photoconductors are produced by reacting monomers with polymer binders being incorporated; therefore, three dimensional networks do not proceed sufficiently and the crosslinked joint density becomes less, failing to achieve a dramatic increase in wear resistance.

To improve wear resistance of photosensitive layers, for example, disposing charge transporting layers produced by the use of coating liquids with monomers having carbon-carbon double bonds, charge transport substances having carbon-carbon double bonds, and binder resin is proposed in JP-B No. 3194392. The binder resin is thought to improve adhesiveness between charge generating layers and curing charge transporting layers and alleviate the internal stress of film at the time of thick film curing. The binder resin can be classified broadly into two categories: binders reactive to the charge transport substances having carbon-carbon double bonds, and binders non-reactive to the charge transport substances having no double bonds. This photoconductor is remarkable in having wear resistance and proper electrical properties, however, if non-reactive resins are used as binder resin, compatibility with cured materials generated from reactions with monomers and charge transport substances may not be desirable and a phase separation within crosslinked charge transporting layers may occur, resulting in flaws or retention of external additives of toner and paper powders. As stated above, three-dimensional network does not progress appropriately and the crosslinked density becomes sparse, prohibiting the exhibition of significant wear resistance. In addition, monomers specified in Japanese Patent (JP-B) No. 3194392 have two functionalities, not sufficient for wear resistance. When a reactive resin is employed as binder resin, though the molecular mass of cured materials increases, number of intermolecular crosslinked joints is small, thus simultaneous pursuit of bonding amount and crosslinked density of the charge transport substances is difficult and electric properties and wear resistance would not be satisfactory.

Photoconductors having photosensitive layers that contain cured compounds generated from curing hole transport compounds having two or more chain polymerizable functional groups within one molecule is proposed in Japanese Patent Application Laid-Open (JP-A) No. 2000-66425. The photosensitive layer may have high degree of hardness due to increased crosslinked joint density, however, since bulky hole transport compounds have two or more chain polymerizable functional groups, distortion within cured materials may occur and internal stress becomes high and the crosslinked surface layers may yield cracks or peelings when used on long-term basis.

From these aspects and much dedicated investigations on the subject, it is found that employing crosslinked resin layer obtained from curing radical polymerizable compounds having three or more functionalities with no charge transport structure and radical polymerizable compounds having one functionality with charge transport structure as surface layer improves electric properties and wear resistance. However, this crosslinked resin layer is electrically unstable; specifically, charge deterioration has been verified after long-term use. These are assumed to be caused by the decomposition or alteration of charge transport substances or binder resin led by the eruption of NOx or ozone gases from outside or within the electrophotographic apparatus. Specifically, it is thought to be caused by the deteriorated outer surface where deterioration is most likely to be progressed, that has been retained for a long period of time because of improved wear resistance due to disposed surface protective layers.

Examples of effective countermeasures to above issues include employing photoconductors on which protective layers containing fillers, dispersants and at least two different antioxidants are disposed, as disclosed in JP-A No. 2002-207308, or employing photoconductors containing protective layers with charge transport property, syloxane resin with crosslinked structure and antioxidant, as disclosed in JP-A No. 2001-51440. However, when small amount of hindered phenol antioxidant or hindered amine antioxidant as described in above literatures are contained in the surface layers made of crosslinked resin layers produced from the curing radical polymerizable compounds having three or more functionalities with no charge transport structure and radical polymerizable compounds having one functionality with charge transport structure, the protective layers show high wear resistance compared to the conventional protective layers and the outermost surface will not get refreshed and insufficient electric stability, especially the charge property deterioration will result in long-term use. If antioxidant is contained in excessive amount, the wear resistance is deteriorated due to sensitivity degradation or crosslinking inhibition.

On the other hand, in terms of image-forming apparatuses, dehumidification of photoconductors is known as a way to refresh outermost surfaces of photoconductors, however, employing heaters will not only incur size-growth of apparatus but consumes large volume of electricity, therefore is not cost-effective. To overcome this problem, for example, the image-forming apparatus in which an exhaust path and a fan is placed between photoconductor and fixing unit so that the waste heat from the fixing unit is sent to the photoconductor via exhaust path or duct as disclosed in JP-A No. 08-179677. However, the fixing unit has a temperature as high as around 200° C. when it is under operation and the surface of photoconductor becomes hot in the image forming apparatus where the heat of fixing unit is directly transmitted to the photoconductor and the sensitivity of photoconductor is deteriorated.

Therefore, the image forming processes and associated technologies with superior endurance that can provide high-quality images for prolonged periods, having latent electrostatic image bearing members that can provide high-quality images for prolonged periods, owing to photosensitive layers and crosslinked surface layers having excellent flaw and wear resistance and appropriate electric properties, have not been obtained and in the present state of affairs, their prompt development is desirable.

SUMMARY OF THE INVENTION

The object of the present invention is to provide a latent electrostatic image bearing member that can provide high-quality images for prolonged periods, owing to photosensitive layers and crosslinked surface layers having excellent flaw and wear resistance and appropriate electric properties; image forming process, image forming apparatus and process cartridge that utilize latent electrostatic image bearing members respectively.

The latent electrostatic image bearing member of the invention comprises a support, and at least a photosensitive layer and crosslinked surface layer on the support, wherein the crosslinked surface layer has a reactant from radical polymerizable compounds having three or more functionalities with no charge transport structure and radical polymerizable compounds having one functionality with charge transport structure and at least two different antioxidants. The latent electrostatic image bearing member of the invention has high flaw and wear resistance and can provide highly durable, high quality images for prolonged periods.

The image forming apparatus of the invention comprises a latent electrostatic image bearing member, a latent electrostatic image forming unit configured to form a latent electrostatic image on the latent electrostatic image bearing member, a developing unit configured to develop a latent electrostatic image using toner to form a visible image, a transferring unit configured to transfer the visible image onto a recording medium, a fixing unit configured to fix the transferred image on the recording medium, and a cleaning unit configured to clean the latent electrostatic image bearing members, wherein the latent electrostatic image bearing member is one according to the invention. The image forming apparatus of the invention, employing a latent electrostatic image bearing member of the invention, has high flaw and wear resistance and can provide highly durable, high quality images for prolonged periods.

The image forming process of the invention comprises forming a latent electrostatic image on the latent electrostatic image bearing member, developing the latent electrostatic image using toner to form a visible image, transferring the visible image onto a recording medium, fixing the transferred image on the recording medium and cleaning the latent electrostatic image bearing members, wherein the latent electrostatic image bearing member is one according to the invention. The image forming process of the invention, by employing latent electrostatic image bearing members of the invention, has high flaw and wear resistance and can provide highly durable, high quality images for prolonged periods.

The process cartridge of the invention comprises a latent electrostatic image bearing member and a developing unit configured to develop a latent electrostatic image using toner to form a visible image, wherein the latent electrostatic image bearing member is one according to the invention. Therefore the process cartridge of the invention has high flaw and wear resistance and can provide high quality images for prolonged periods and the amount of wear of latent electrostatic image bearing members can be controlled at minimum even when under the operation of blade cleaning, etc. and the cleaning efficiency is satisfactory.

DESCRIPTION OF THE PREFERRED EMBODIMENTS (Latent Electrostatic Image Bearing Member)

The latent electrostatic image bearing member of the invention comprises a support, at least a photosensitive layer and a crosslinked surface layer disposed on the support, and other layers as necessary.

The photosensitive layers are not limited and may be selected accordingly. They can have either single or multilayer structure.

Figure 1:
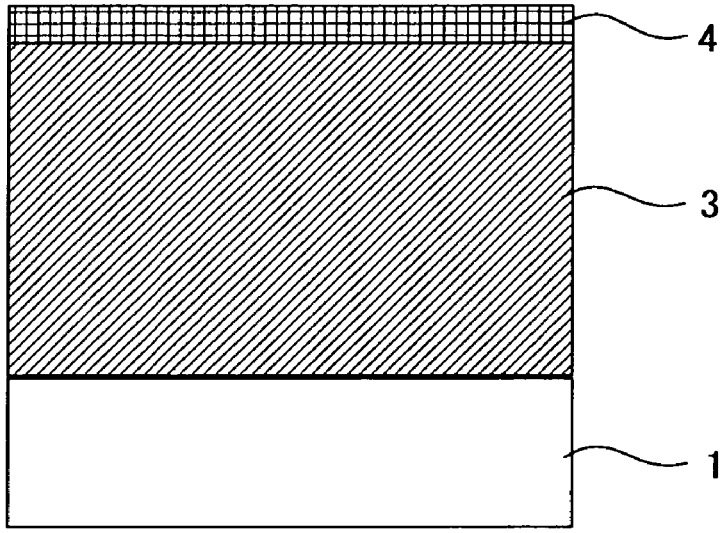
FIG. 1 is a schematic sectional view of layer structure of an exemplary single-layered latent electrostatic image bearing member of the invention.

FIG. 1 is a schematic sectional view of an exemplary latent electrostatic image bearing member, a photoconductor having support 1, single-layered photosensitive layer 3 having charge generating function and charge transporting function at the same time, disposed on the support 1 and the crosslinked surface layer 4 disposed on the photosensitive layer 3.

Figure 2:
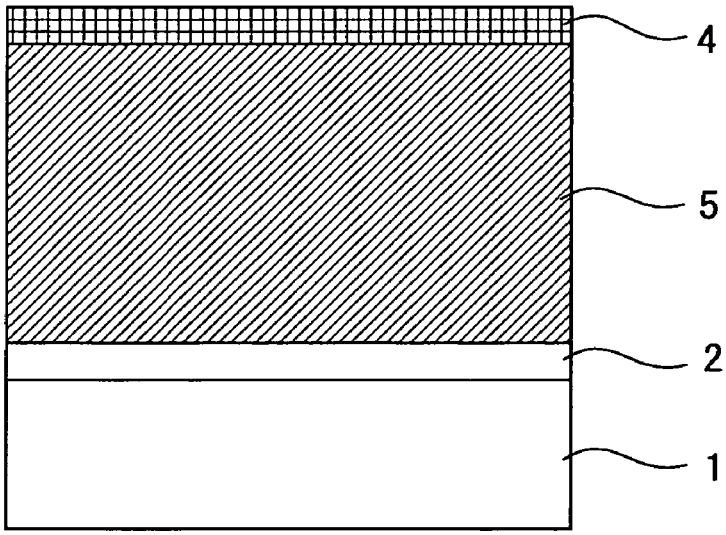
FIG. 2 is a schematic sectional view of layer structure of an exemplary laminated latent electrostatic image bearing member of the invention.

FIG. 2 is a schematic sectional view of another exemplary latent electrostatic image bearing member comprising the support 1, the laminated photosensitive layer comprising the charge generating layer 2 having charge generating function and the charge transporting layer 5 having charge transporting function disposed on the support, and the crosslinked surface layer 4 disposed on the charge transporting layer 5 of the photosensitive layer.

Crosslinked Surface Layer

The crosslinked surface layer has at least a crosslinked structure with charge transport function and is formed by dissolution or dispersion of at least a radical polymerizable compound having three or more functionalities with no charge transport structure, a radical polymerizable compound with one functionality with charge transport structure and at least two different antioxidants in an appropriate medium, coating onto the charge transporting layer and drying, and the curing reaction triggered by exposure of external energy such as heat or light.

The radical polymerizable compounds having three or more functionalities with no transport structure refers to the monomers having three or more radical polymerizable functional groups with no hole transport structure such as triarylamine, hydrazone, pyrazoline, carbazole or no electron transport structure such as fused polycyclic quinone, diphenoquinone, or electron pulling aromatic rings having cyano group or nitro group, etc., for example. The radical polymerizable functional group can be any that have carbon-carbon double bond and is radically polymerizable.

Examples of radical polymerizable functional group include 1-substituted ethylene functional groups and 1,1-substituted ethylene functional groups.

(1) Examples of 1-substituted ethylene functional groups include functional groups represented by the following Structural Formula (4):

$$CH_2{=}CH{-}X^1{-} \qquad \text{Structural Formula (4)}$$

wherein $X^1$ represents an arylene group such as phenylene group, naphthylene group, and the like, which may be substituted, alkynylene group which may be substituted, —CO— group, —COO— group, —CON($R^{10}$)— group ($R^{10}$ represents hydrogen atom, alkyl group such as methyl group and ethyl group, aralkyl group such as benzyl group, naphthylmethyl group and phenethyl group, aryl group such as phenyl group and naphthyl group), or —S— group.

Specific examples of substituents include vinyl group, styryl group, 2-methyl-1,3-butadienyl group, vinylcarbonyl group, acryloyloxy group, acryloylamide group, vinylthioether group, and the like.

(2) Examples of 1,1-substituted ethylene functional groups include those represented by following Structural Formula (5):

$$CH_2{=}C(Y){-}X^2{-} \qquad \text{Structural Formula (5)}$$

wherein Y represents an alkyl group which may be substituted, aralkyl group which may be substituted, aryl group such as phenyl group, naphthyl group which may be substituted, halogen atom, cyano group, nitro group, alkoxy group such as methoxy group and ethoxy group, —$COOR^{11}$ group (where $R^{11}$ represents hydrogen atom, alkyl group such as methyl group and ethyl group which may be substituted, aralkyl group such as benzyl and phenethyl groups which may be substituted, aryl groups such as phenyl group and naphthyl group which may be substituted), or —$CONR^{12}R^{13}$ (where $R^{12}$ and $R^{13}$ represent hydrogen atom, alkyl groups such as methyl group and ethyl group which may be substituted, aralkyl group such as benzyl group, naphthylmethyl group, and phenethyl group which may be substituted, aryl group such as phenyl group and naphthyl group which may be substituted, and may be identical or different), $X^2$ represents identical substituent of $X^1$ in the Formula (4) and a single bond, alkylene group, provided that at least one of either Y or $X^2$ is an oxycarbonyl group, cyano group, alkenylene group, or aromatic ring.

Specific examples of these substituents include alpha-chloro acryloyloxy group, methacryloyloxy group, alpha-cyanoethylene group, alpha-cyanoacryloyloxy group, alpha-cyanophenylene group, methacryloylamino group, and the like.

Examples of substituent that are additionally substituted by the subsituents of X and Y include halogen atom, nitro group, cyano group, alkyl groups such as methyl group, ethyl group and the like; alkoxy groups such as methoxy group and ethoxy group; aryloxy groups such as phenoxy group; aryl groups such as phenyl group and naphthyl group; and aralkyl groups such as benzyl group and phenethyl group.

Among these radical polymerizable functional groups, acryloyloxy group and methacryloyloxy group are particularly useful. Compounds having three or more acryloyloxy groups may be prepared, for example, by esterification or transesterification using compounds having three or more hydroxy groups in the molecule, acrylic acid or salt, acrylic acid halide and acrylic acid ester. Also, compounds having three or more methacryloyloxy groups may be similarly prepared. The radical polymerizable functional groups in a monomer having three or more functionalities may be identical or different.

Specific examples of radical polymerizable compounds having three or more functionalities with no charge transport structure are listed below, but are not limited to.

Examples of radical polymerizable monomers include trimethylolpropanetriacrylate (TMPTA), trimethylolpropanetrimethacrylate, alkylene-modified trimethylolpropanetriacrylate, ethyleneoxy-modified (this is referred to as "EO-modified" hereafter) trimethylolpropane ethylenetriacrylate, ethyleneoxy-modified (this is referred to as "EO-modified" hereafter) trimethylolpropanepropylene triacrylate, caprolactone-modified trimethylolpropane triacrylate, alkylene-modified trimethylolpropane trimethacrylate, pentaerythritol triacrylate, pentaerythritol tetraacrylate (PETTA), glycerol triacrylate, epichlorohydrin-modified (this is referred to as "ECH-modified" hereafter) glycerol triacrylate, EO-modified glycerol triacrylate, PO-modified glycerol triacrylate, tris(acryloxyethyl)isocyanurate, dipentaerythritol hexacrylate (DPHA), caprolactone-modified dipentaerythritol hexacrylate, dipentaerythritolhydroxy pentaacrylate, alkyl-modified dipentaerythritol pentaacrylate, alkyl-modified dipentaerythritol tetraacrylate, alkyl-modified dipentaerythritol triacrylate, dimethylolpropane tetraacrylate (DTMPTA), pentaerythritolethoxy tetraacrylate, EO-modified phosphonic acid triacrylate, 2,2,5,5,-tetrahydroxymethylcyclopentanone tetraacrylate and the like. These may be used alone or in combination of two or more.

Preferably, radical polymerizable monomers having three or more functionalities with no charge transport structure employed in the invention has molecular mass ratio relative to number of functional groups, molecular mass/number of functional groups, of 250 or less in order to form a compact crosslinked bonding within crosslinked surface layers. When the ratio is more than 250, crosslinked surface layers become softer, thus decreasing wear resistance in some degree; therefore, monomers having excessively long modified groups should not preferably be employed alone when monomers having modified groups such as EO, PO or caprolactone, etc. are employed among described monomers, and the like.

Preferably, the content of radical polymerizable compounds having three or more functionalities is 20% by mass to 80% by mass, more preferably 30% by mass to 70% by mass based on the total mass of crosslinked surface layers. When the content of radical polymerizable compounds is less than 20% by mass, significant improvement of wear resistance may not be attained compared to the conventional thermoplastic binder resins, because of low three-dimensional crosslinked density of the crosslinked surface layers. When the content of radical polymerizable compounds is more than 80% by mass, electric properties are deteriorated due to decrease in the content of charge transport compounds. Because electric properties and wear resistance differ depending on the processes and the film thickness of crosslinked surface layers on the photoconductor varies accordingly, the content of radical polymerizable compounds is preferably 30% by mass to 70% by mass, considering the balance between properties.

The radical polymerizable compounds having one functionality with charge transport structure may be of those having hole transport structure such as triarylamine, hydrazone, pyrazoline, and carbazole, or those having electron transport structure such as fused polycyclic quinone, diphenoquinone, and electron pulling aromatic rings having cyano group or nitro group, and one radical polymerizable functional group. Examples of radical polymerizable functional groups may be of those described as radical polymerizable monomers, and specifically, acryloyloxy or methacryloyloxy groups are useful. For the charge transport structure, triarylamine structure can be highly effective and by employing compounds that are expressed by Structural Formula (1) and (2), electric properties such as sensitivity and residual potential, etc. may be stabilized in appropriate condition.

Structural Formula (1)

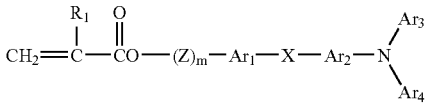

Structural Formula (2)

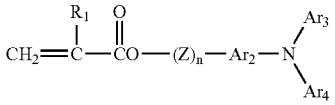

In Structural Formula (1) and (2), $R_1$ represents hydrogen atom, halogen atom, cyano group, nitro group, alkyl group which may be substituted, aralkyl group which may be substituted, aryl group which may be substituted, alkoxy group, —$COOR_7$ (where $R_7$ represents hydrogen atom, alkyl group which may be substituted, aralkyl group which may be substituted, or aryl group which may be substituted), halogenated carbonyl group, or $CONR_8R_9$ (where each $R_8$ and $R_9$ represents hydrogen atom, halogen atom, alkyl group which may be substituted, aralkyl group which may be substituted, or aryl group which may be substituted and $R_8$ and $R_9$ may be identical or different); Each $Ar_1$ and $Ar_2$ represents substituted or unsubstituted arylene group which may be identical or different; Each $Ar_3$ and $Ar_4$ represents substituted or unsubstituted aryl group which may be identical or different; X represents single bond, substituted or unsubstituted alkylene group, substituted or unsubstituted cycloalkylene group, substituted or unsubstituted alkylene ether group, oxygen atom, sulfur atom, or vinylene group; Z represents substituted or unsubstituted alkylene group, substituted or unsubstituted alkylene ether bivalent group, or alkyleneoxycarbonyl bivalent group; each "m" and "n" represents an integer of 0 to 3.

Examples of alkyl group included in the substituents of $R_1$ in Structural Formulas (1) and (2) include methyl group, ethyl group, propyl group, butyl group etc., examples of aryl group include phenyl group, naphthyl group etc., examples of aralkyl group include benzyl group, phenethyl group, naphthylmethyl group etc., examples of alkoxy group include methoxy group, ethoxy group, propoxy group etc. These groups may be substituted furthermore by halogen atom, nitro group, cyano group, alkyl group such as methyl group, ethyl group etc., alkoxy group such as methoxy group, ethoxy group, and the like, aryloxy group such as phenoxy group, and the like, aryl group such as phenyl group, naphthyl group, and the like, aralkyl group such as benzyl group, phenethyl group, and the like.

Hydrogen atom and methyl group are particularly preferable among substituents of $R_1$.

$Ar_3$ and $Ar_4$ are substituted or unsubstituted aryl groups and examples of aryl group include fused polycyclic hydrocarbon groups, non-fused cyclic hydrocarbon groups, and heterocyclic groups.

The fused polycyclic hydrocarbon group is preferably one having 18 or less carbon atoms for ring formation and examples thereof include pentanyl group, indenyl group, naphthyl group, azulenyl group, heptarenyl group, biphenylenyl group, as-indacenyl group, s-indacenyl group, fluorenyl group, acenaphthylenyl group, pleiadenyl group, acenaphthenyl group, phenalenyl group, phenanthryl group, antholyl group, fluoranthenyl group, acephenanthrylenyl group, aceanthrylenyl group, triphenylenyl group, pyrenyl group, chrysenyl group, and naphthacenyl group.

Examples of non-fused cyclic hydrocarbon group include monovalent group of monocyclic hydrocarbon compounds such as benzene, diphenyl ether, polyethylenediphenyl ether, diphenylthioether and diphenylsulphone, monovalent group of non-fused polycyclic hydrocarbon compounds such as biphenyl, polyphenyl, diphenylalkane, diphenylalkene, diphenylalkyne, triphenylmethane, distyrylbenzene, 1,1-diphenylcycloalkane, polyphenylalkane and polyphenylalkene, or monovalent group of cyclic hydrocarbon compounds such as 9,9-diphenylfluorene.

Examples of heterocyclic group include monovalent group of carbazole, dibenzofuran, dibenzothiphene, oxadiazole, and thiadiazole.

The aryl group represented by $Ar_3$ and $Ar_4$ may be substituted by substituents described in (1) to (8) below.

(1) halogen atom, cyano group, nitro group, and the like.

(2) alkyl group, preferably straight-chained or branched alkyl group of 1 to 12 carbon numbers, more preferably 1 to 8 carbon numbers, and most preferably 1 to 4 carbon numbers, wherein alkyl groups may be substituted by fluorine atom, hydroxy group, cyano group, alkoxy group of 1 to 4 carbon numbers, phenyl group, or phenyl group substituted by halogen atom, alkyl group of 1 to 4 carbon numbers or alkoxy group of 1 to 4 carbon numbers. Specific examples thereof include methyl group, ethyl group, n-butyl group, i-propyl group, t-butyl group, s-butyl group, n-propyl group, tri-fluoromethyl group, 2-hydroxyethyl group, 2-ethoxyethyl group, 2-cyanoethyl group, 2-methoxyethyl group, benzyl group, 4-chlorobenzyl group, 4-methylbenzyl group, 4-phenylbenzyl group, and the like.

(3) alkoxy group (—$OR_2$), wherein $R_2$ represents alkyl group as described in (2). Specific examples thereof include methoxy group, ethoxy group, n-propoxy group, i-propoxy group, t-butoxy group, n-butoxy group, s-butoxy group, i-butoxy group, 2-hydroxyethoxy group, benzyloxy group, trifluoromethoxy group, and the like.

(4) aryloxy group, wherein aryl group may be phenyl group and naphthyl group, which may be substituted by alkoxy group of 1 to 4 carbon numbers, alkyl group of 1 to 4 carbon numbers, or halogen atom. Specific examples thereof include phenoxy group, 1-naphthyloxy group, 2-naphthyloxy group, 4-methoxyphenoxy group, 4-methylphenoxy group, and the like.

(5) alkylmercapto group or arylmercapto group. Specific examples thereof include methylthio group, ethylthio group, phenylthio group, p-methylphenylthio group, and the like.

(6) Groups expressed by Structural Formula (6) below.

Structural Formula (6)

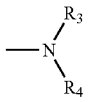

Wherein each $R_3$ and $R_4$ independently represents hydrogen atom, alkyl group as described in (2) or aryl group. Examples of aryl group include phenyl group, biphenyl group, or naphthyl group which may be substituted by alkoxy group of 1 to 4 carbon numbers, alkyl group of 1 to 4 carbon numbers, or halogen atom. $R_3$ and $R_4$ may form a ring together.

Specific examples thereof include amino group, diethylamino group, N-methyl-N-phenylamino group, N,N-diphenylamino group, N,N-di(tryl)amino group, dibenzylamino group, piperidino group, morpholino group, pyrrolidino group, and the like.

(7) alkylenedioxy group or alkylenedithio group such as methylenedioxy group or methylenedithio group.

(8) substituted or unsubstituted styryl group, substituted or unsubstituted β-phenylstyryl group, diphenylaminophenyl group, ditolylaminophenyl group, and the like.

The arylene groups represented by $Ar_1$ and $Ar_2$ include divalent groups derived from aryl groups represented by $Ar_3$ and $Ar_4$.

X represents single bond, substituted or unsubstituted alkylene group, substituted or unsubstituted cycloalkylene group, substituted or unsubstituted alkylene ether group, oxygen atom, sulfur atom, or vinylene group.

Examples of substituted or unsubstituted alkylene groups are preferably straight chained or branched alkylene groups of 1 to 12 carbon numbers, more preferably 1 to 8 carbon numbers, and most preferably 1 to 4 carbon numbers. The alkylene groups may be further substituted by fluorine atom, hydroxy group, cyano group, alkoxy groups of 1 to 4 carbon numbers, phenyl group, or phenyl group substituted by halogen atom, alkyl group of 1 to 4 carbon numbers, or alkoxy group of 1 to 4 carbon numbers. Specific examples thereof include methylene group, ethylene group, n-butylene group, i-propylene group, t-butylene group, s-butylene group, n-propylene group, trifluoromethylene group, 2-hydroxyethylene group, 2-ethoxyethylene group, 2-cyanoethylene group, 2-methoxyethylene group, benzylidene group, phenylethylene group, 4-chlorophenylethylene group, 4-methylphenylethylene group, 4-biphenylethylene group, and the like.

Examples of substituted or unsubstituted cycloalkylene groups include cyclic alkylene groups of 5 to 7 carbon numbers, wherein the cyclic alkylene groups may be substituted by fluorine atom, hydroxide group, alkyl group of 1 to 4 carbon numbers, or alkoxy group of 1 to 4 carbon numbers.

Specific examples thereof include cyclohexylidene group, cyclohexylene group, 3,3-dimethylcyclohexylidene group, and the like.

Examples of substituted or unsubstituted alkylene ether group include ethyleneoxy group, propyleneoxy group, ethylene glycol, propylene glycol, diethylene glycol, tetraethylene glycol, tripropylene glycol wherein alkylene ether group and alkylene group may be substituted by hydroxyl group, methyl group, ethyl group, and the like.

The vinylene group may be represented by the following formula.

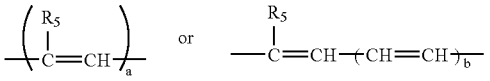

In the above Structural Formula, $R_5$ represents hydrogen atom, alkyl group identical to the one described in (2), or aryl group identical to the one represented by $Ar_3$ and $Ar_4$; "a" represents an integer of 1 or 2, and "b" represents an integer of 1 to 3.

Z represents substituted or unsubstituted alkylene group, substituted or unsubstituted alkylene ether bivalent group, or alkyleneoxycarbonyl bivalent group. The substituted or unsubstituted alkylene groups include alkylene groups defined as X. The substituted or unsubstituted alkylene ether bivalent groups include alkylene ether bivalent groups defined as X. The alkyleneoxycarbonyl bivalent groups include caprolactone-modified bivalent groups.

The good examples of radical polymerizable compounds having one functionality with charge transport structure are those expressed by Structural Formula (3).

The radical polymerizable compounds having one functionality with charge transport structure expressed by Structural Formula (1), (2), and (3), in particular those expressed by Structural Formula (3) become incorporated into continuous polymer chains instead of being a terminal structure because polymerization is accomplished by opening carbon-carbon double bonds at both sides. The radical polymerizable compounds having one functionality exist within crosslinked polymers formed with radical polymerizable monomers having three or more functionalities as well as in the crosslinking chain between main chain. These crosslinking chains may be classified into intermolecular crosslinking chains between polymers and intramolecular crosslinking chains that connect certain sites within a molecule. Whether radical polymerizable compounds having one functionality exist in the main chain or the crosslinking chain, the triarylamine structure attached to the chain is bulky having at least three aryl groups placed in a radial direction from the nitrogen atom. However, three aryl groups are not directly attached to the chains; instead they are indirectly attached to the chains through carbonyl group or the like, so that triarylamine structure is fixed flexibly in terms of stereoscopic centering control. Because triarylamine structure allows appropriate space alignment within a molecule, it is presumed that the intramolecular structural strain is less and intramolecular structure can relatively escape the disconnection of charge transport path in the crosslinked surface layer of photoconductors.

Specific examples of radical polymerizable compounds having one functionality with charge transport structure of the invention are listed below, but are not limited to.

Structural Formula (3)

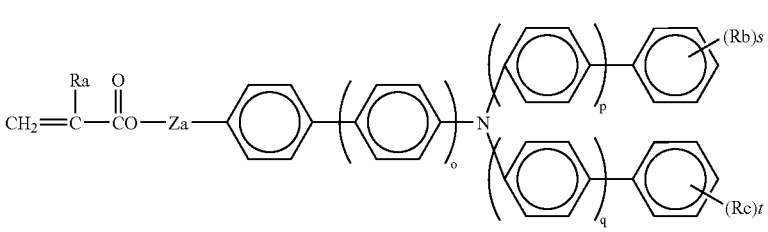

In Structural Formula (3), each "o," "p", and "q" represents an integer of 0 or 1, Ra represents hydrogen atom or methyl group, Rb and Rc may be identical or different, and represent alkyl groups of 1 to 6 carbon numbers. Each "s" and "t" represents an integer of 0 to 3, and Za represents single bond, methylene group, ethylene group, or groups expressed by following formulas:

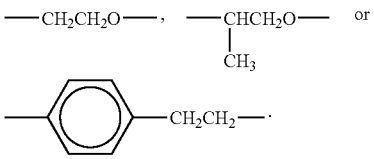

Compounds represented by Structural Formula (3), substituents of $R_b$ and Rc, are preferably methyl groups or ethyl groups.

No. 1

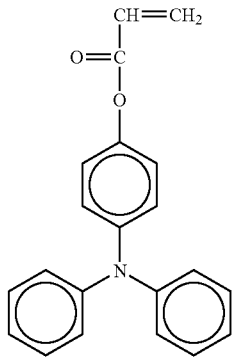

-continued
No. 2
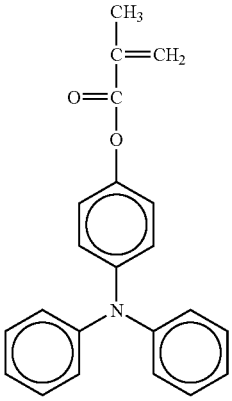
No. 3
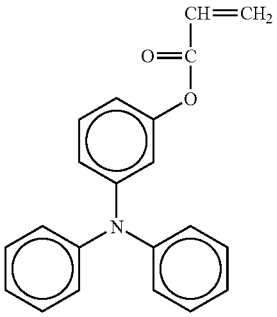
No. 4
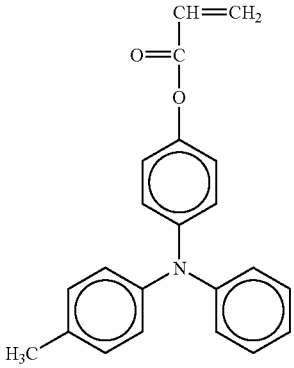
No. 5
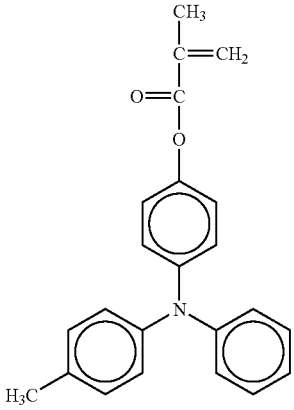
-continued
No. 6
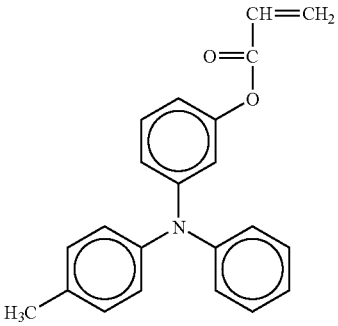
No. 7
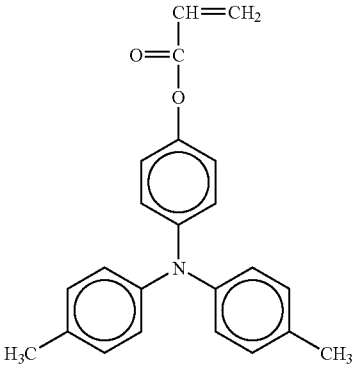
No. 8
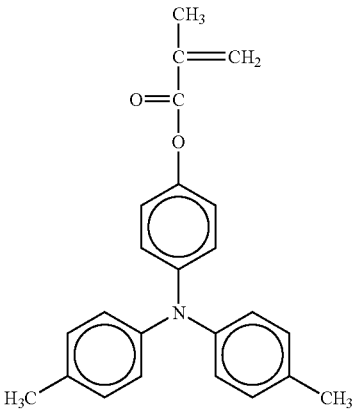
No. 9
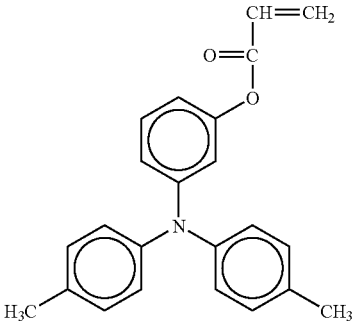

-continued
No. 10
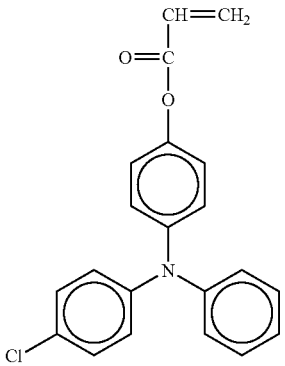
No. 11
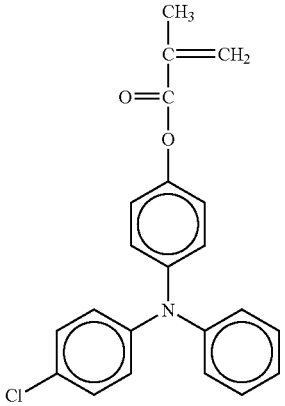
No. 12
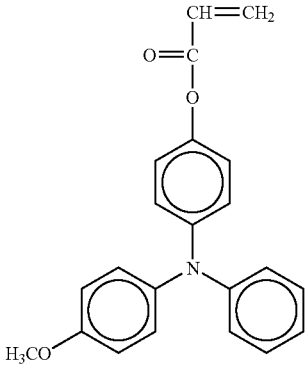
No. 13
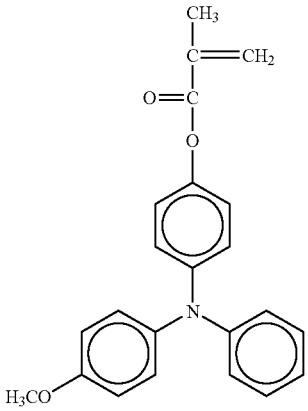
-continued
No. 14
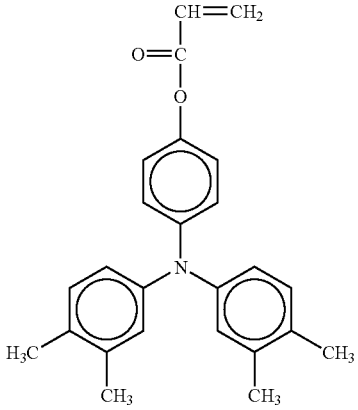
No. 15
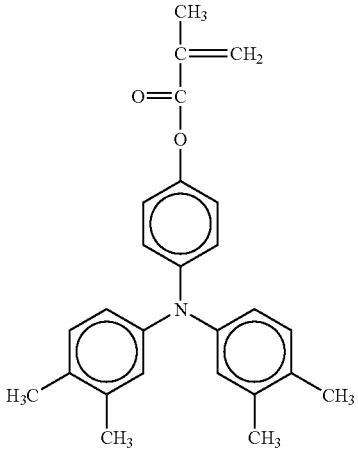
No. 16
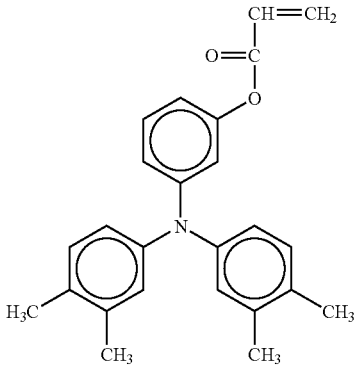
No. 17
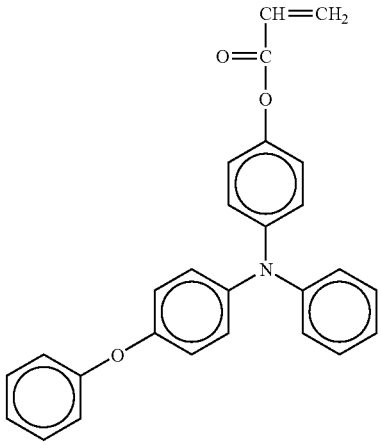

-continued
No. 18
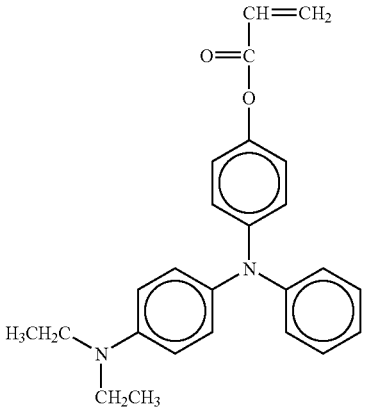
No. 19
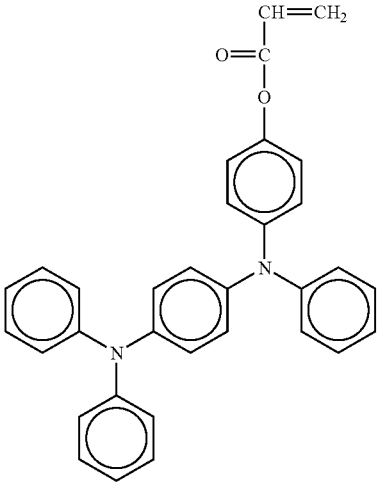
No. 20
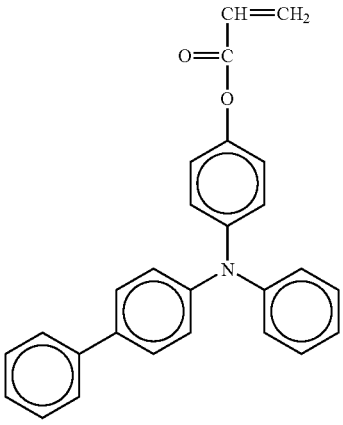
-continued
No. 21
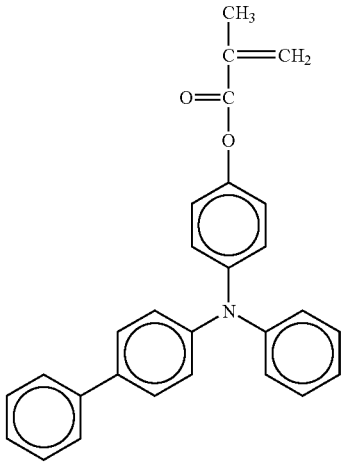
No. 22
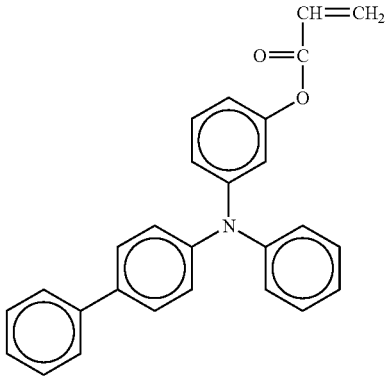
No. 23
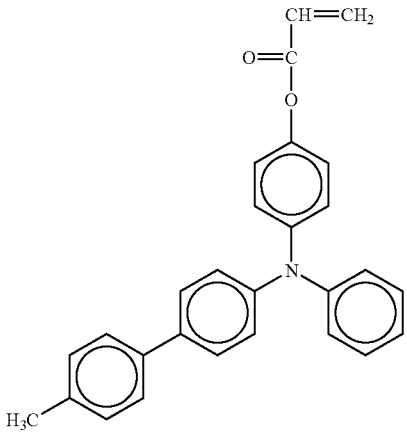

-continued
No. 24
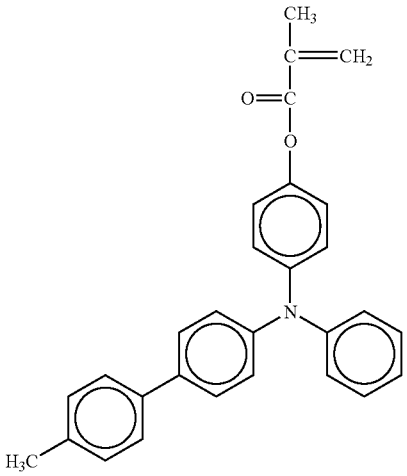
No. 25
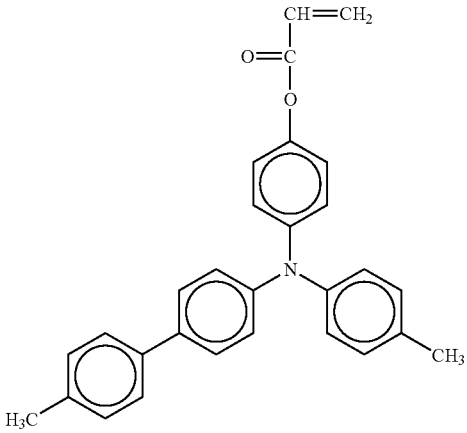
No. 26
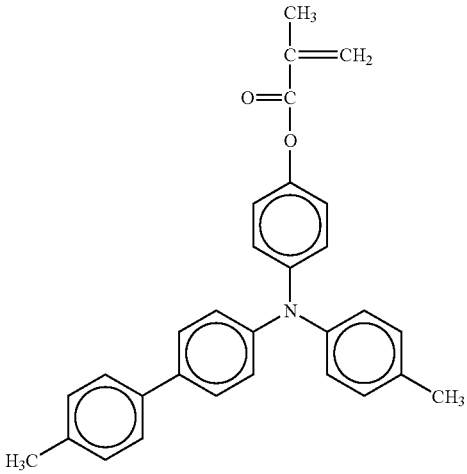
-continued
No. 27
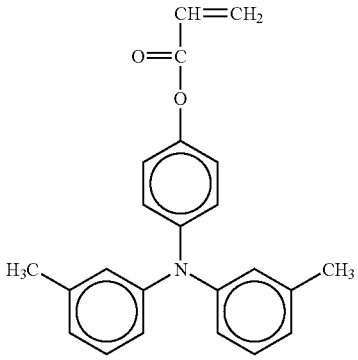
No. 28
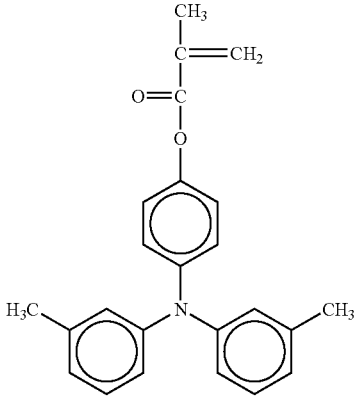
No. 29
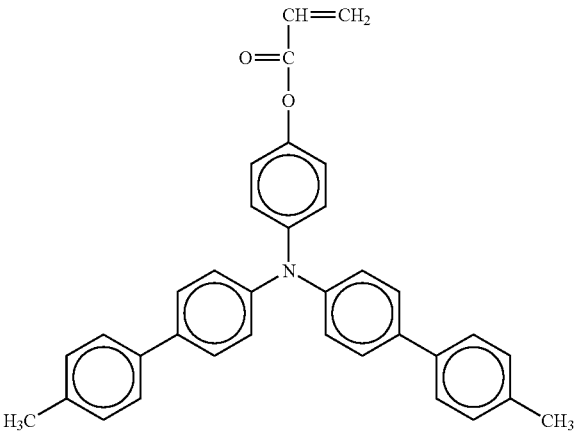

-continued
No. 30
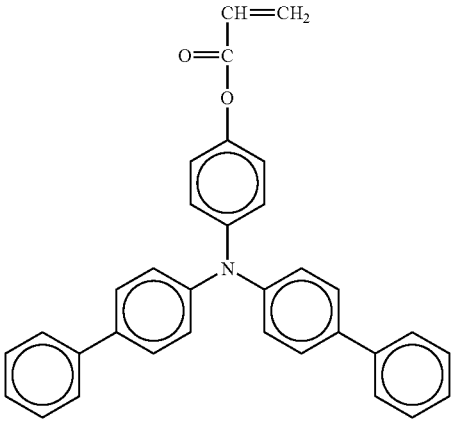
No. 31
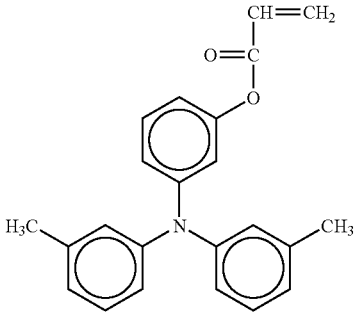
No. 32
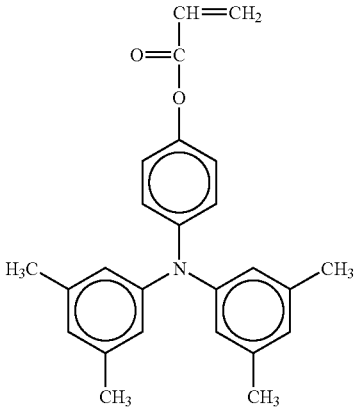
No. 33
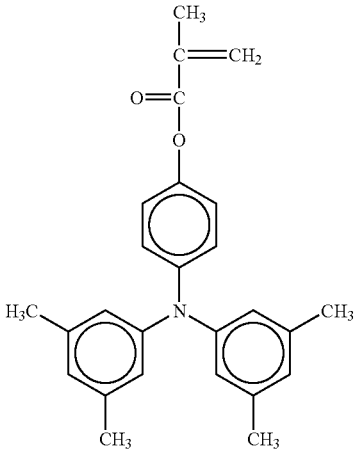
-continued
No. 34
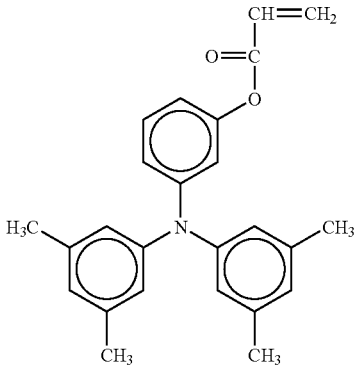
No. 35
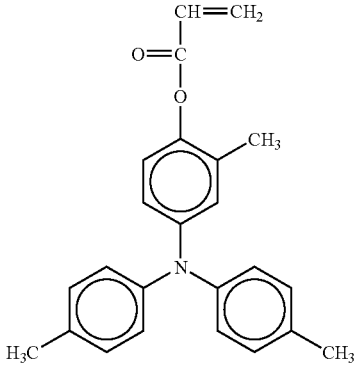
No. 36
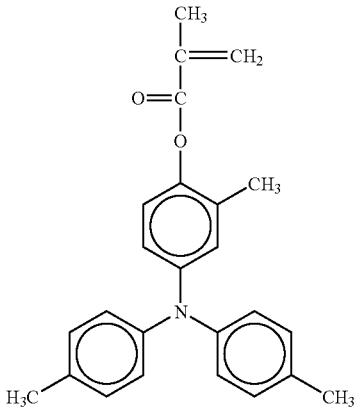
No. 37
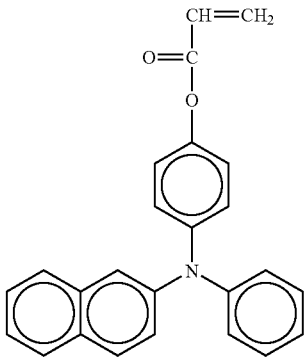

-continued
No. 38
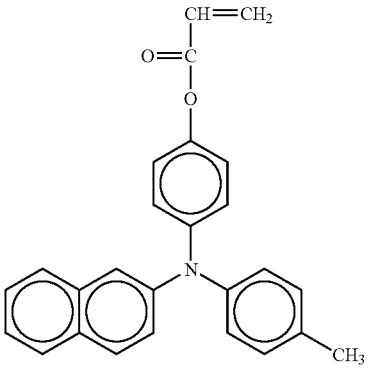
No. 39
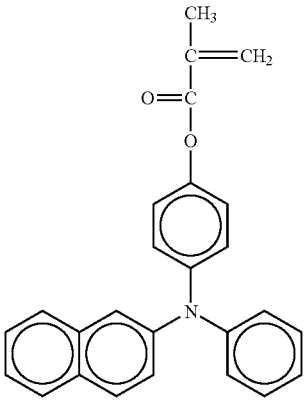
No. 40
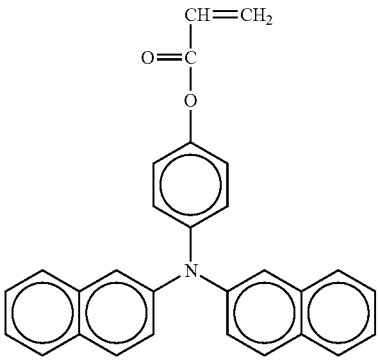
No. 41
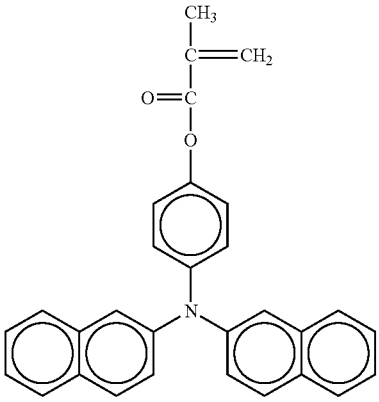
-continued
No. 42
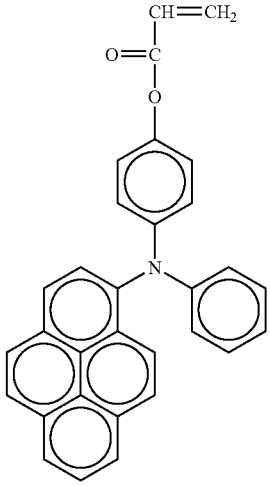
No. 43
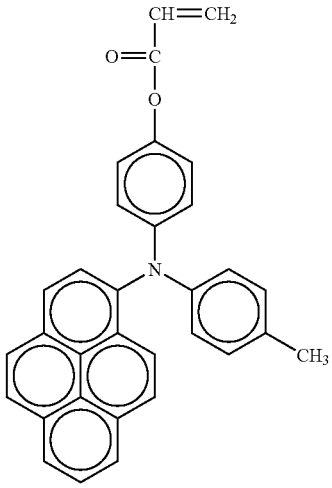
No. 44
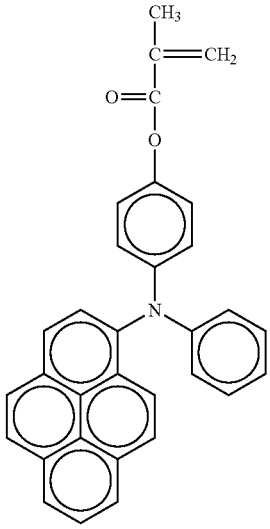

-continued
No. 45
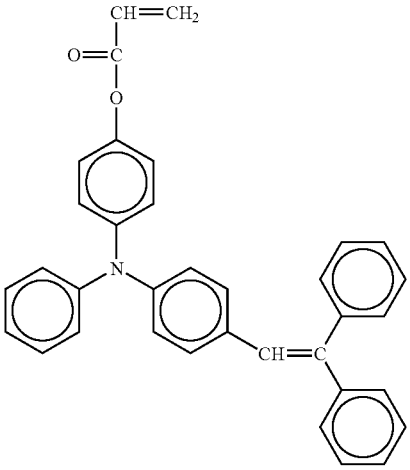
No. 46
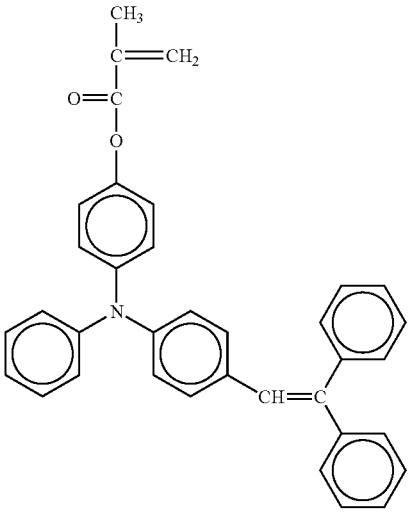
No. 47
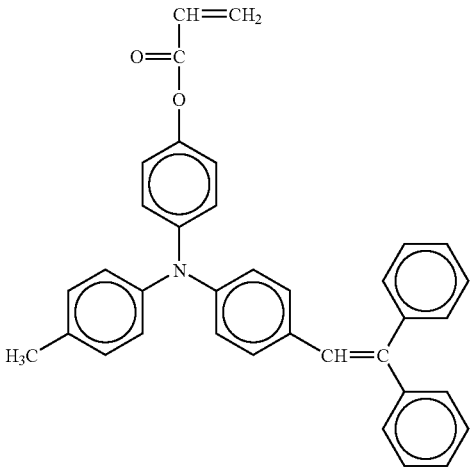
-continued
No. 48
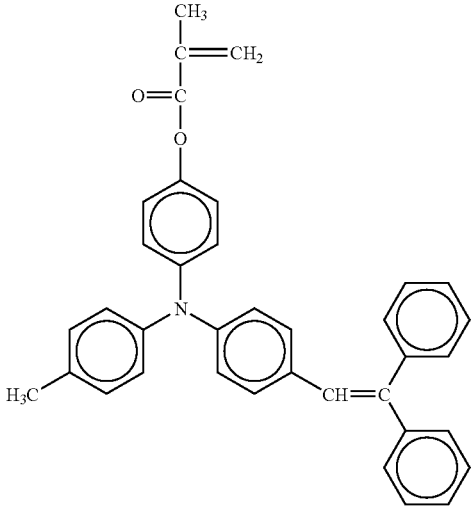
No. 49
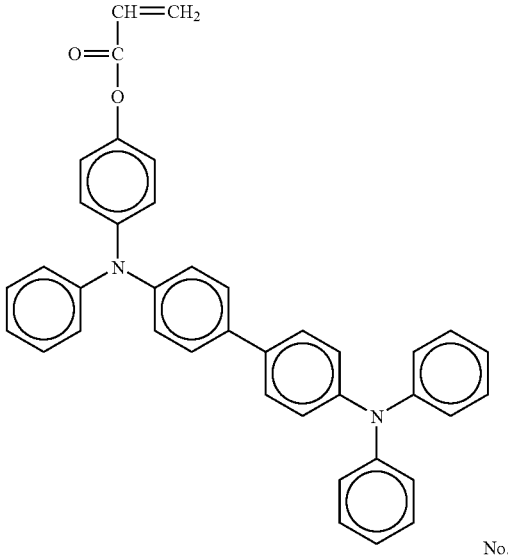
No. 50
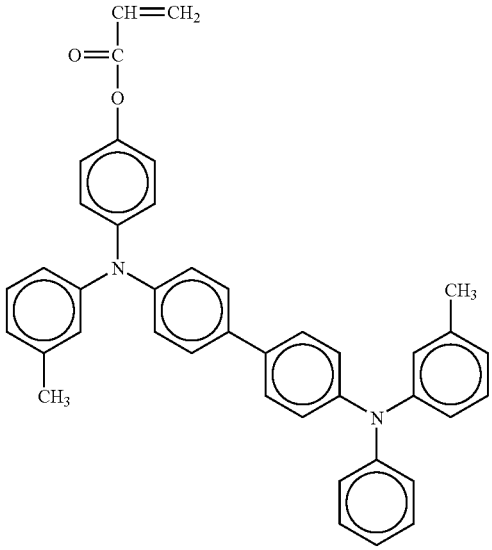

-continued
No. 51
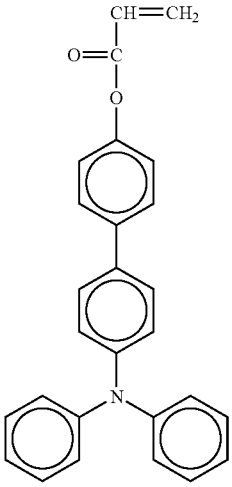
No. 52
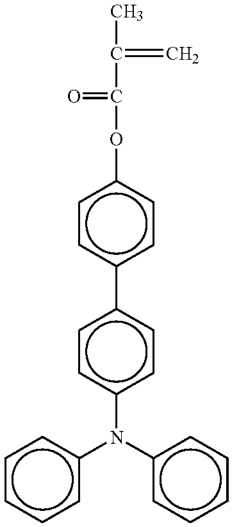
No. 53
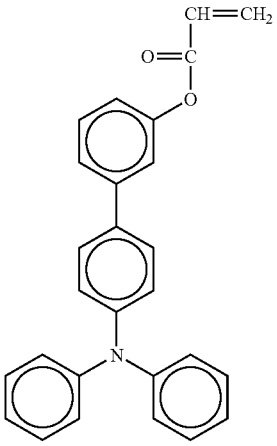
-continued
No. 54
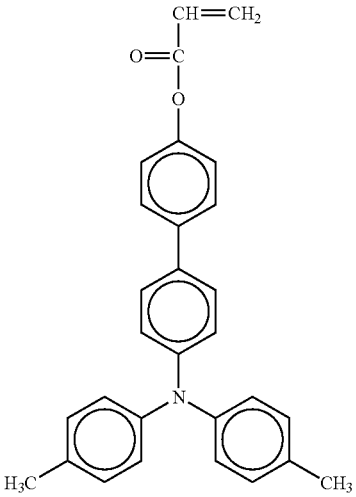
No. 55
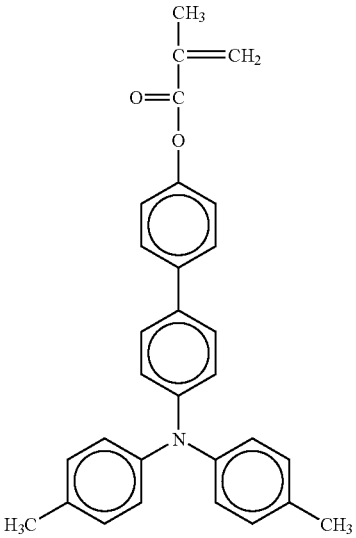
No. 56
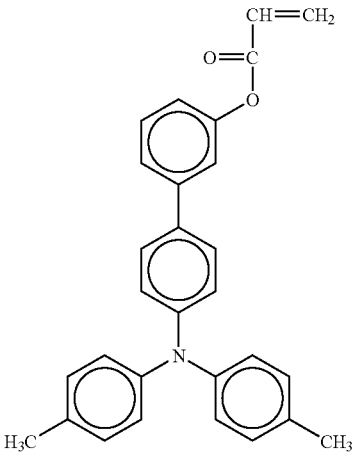

-continued
No. 57
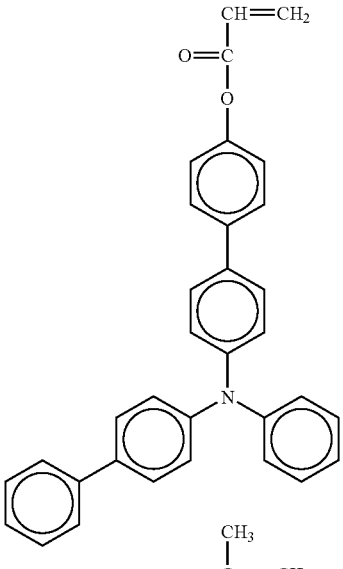
No. 58
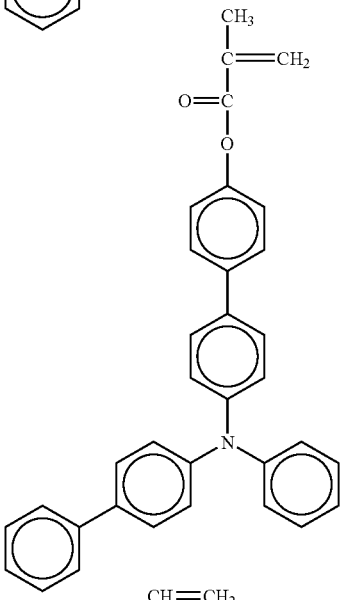
No. 59
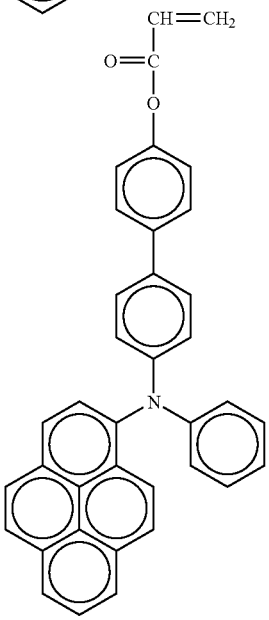
-continued
No. 60
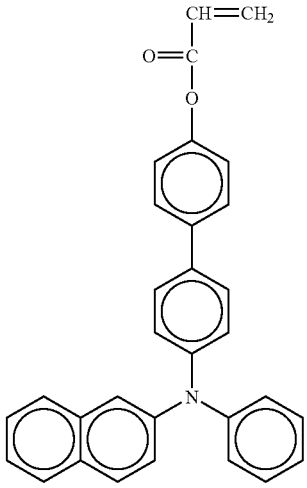
No. 61
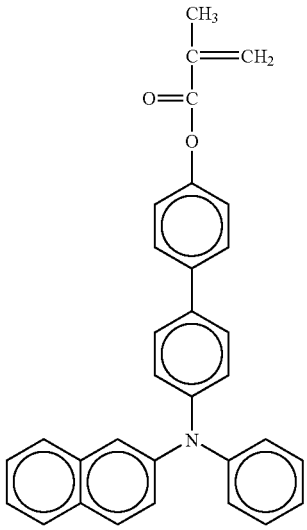
No. 62
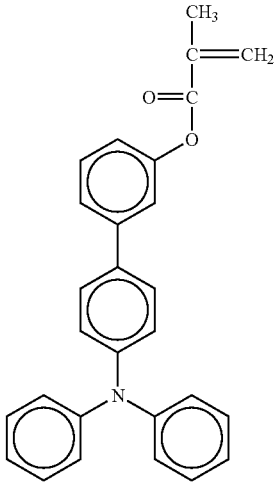

-continued
No. 63
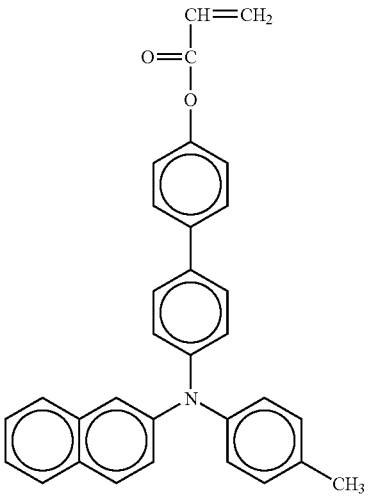
No. 64
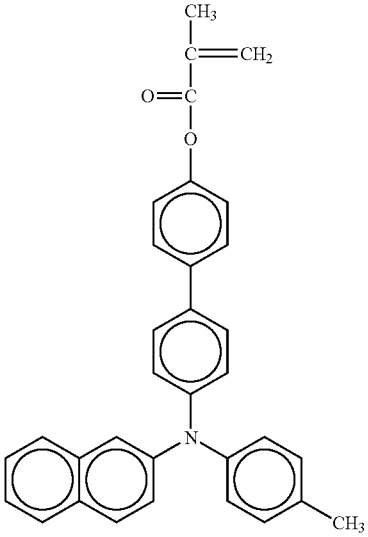
No. 65
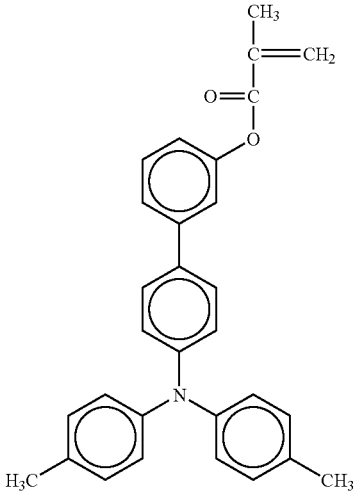
-continued
No. 66
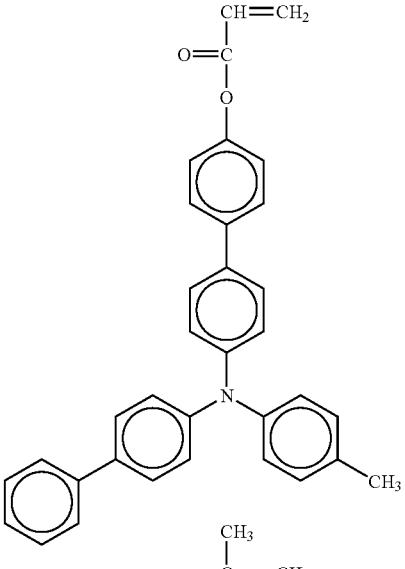
No. 67
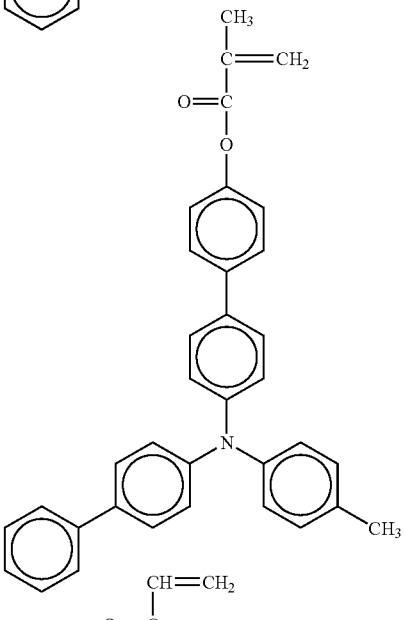
No. 68
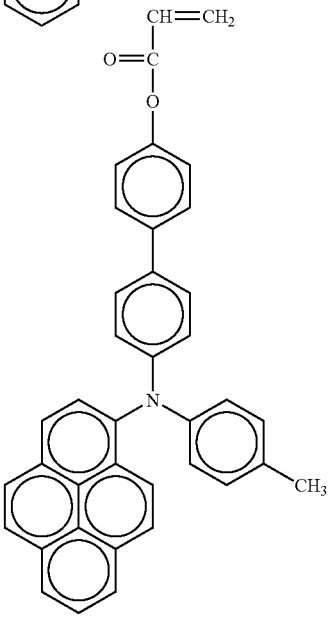

-continued
No. 69
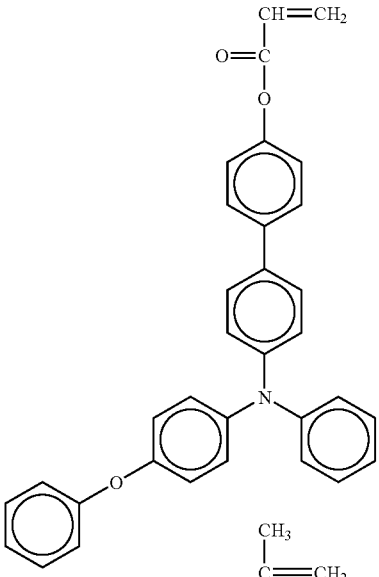
No. 70
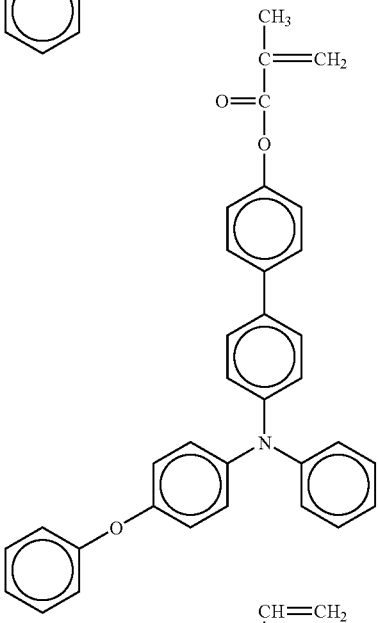
No. 71
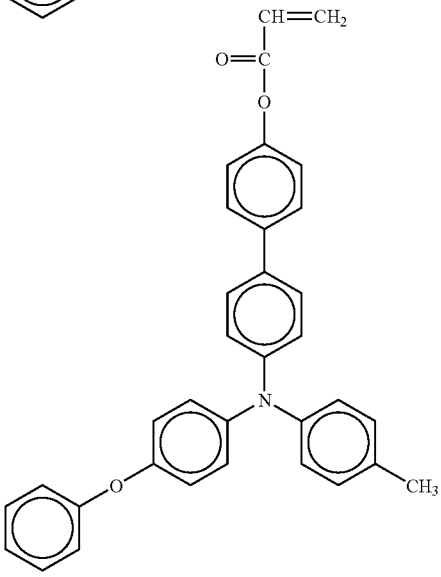
-continued
No. 72
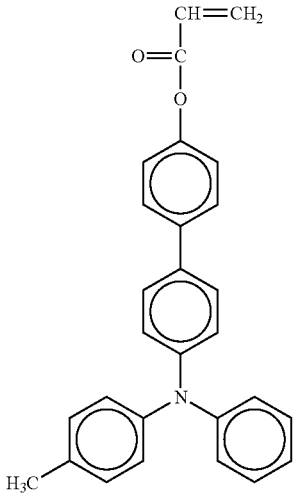
No. 73
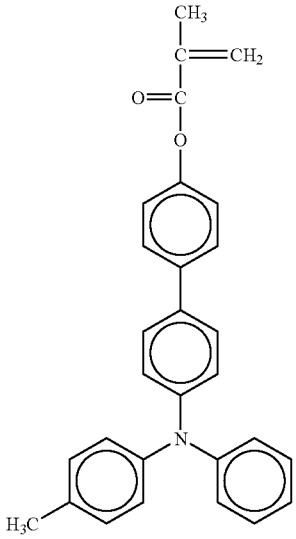
No. 74
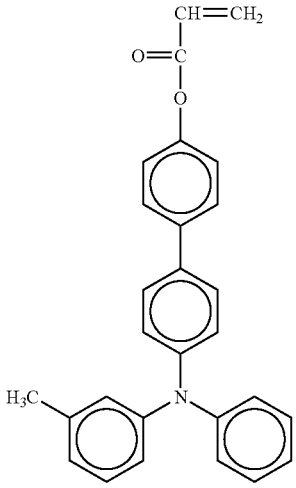

-continued
No. 75
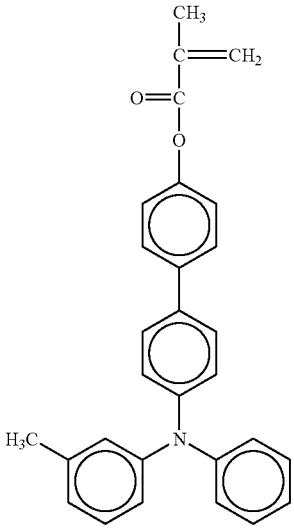
No. 76
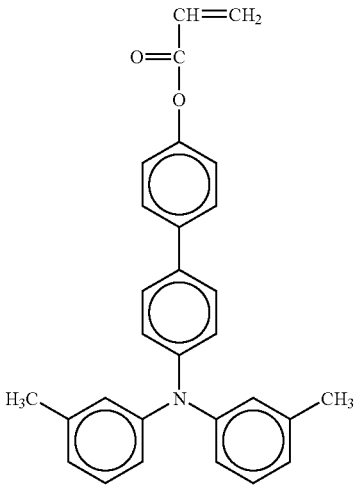
No. 77
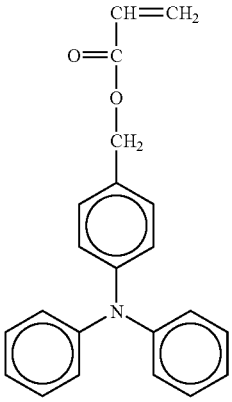
-continued
No. 78
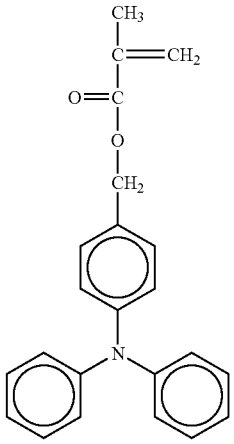
No. 79
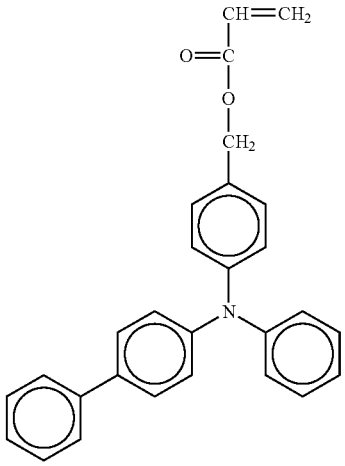
No. 80
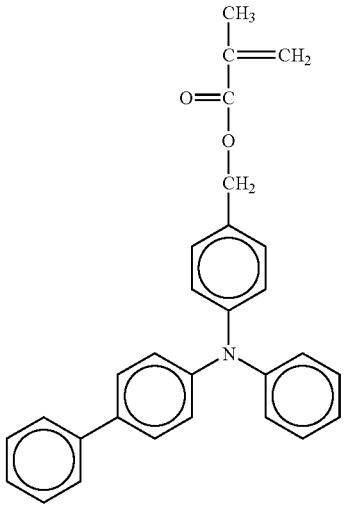

-continued
No. 81
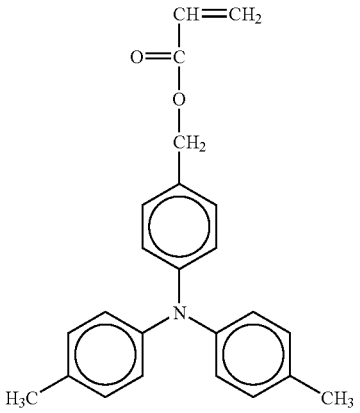
No. 82
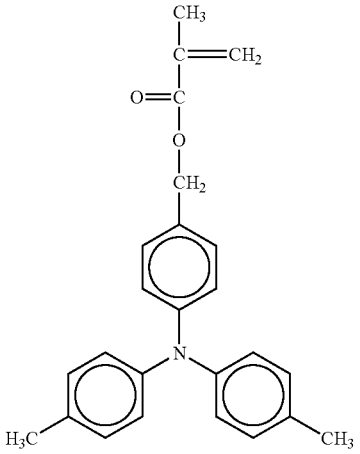
No. 83
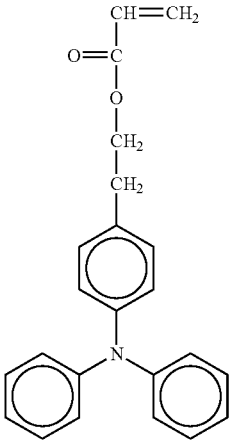
-continued
No. 84
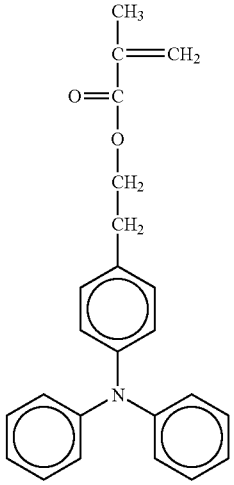
No. 85
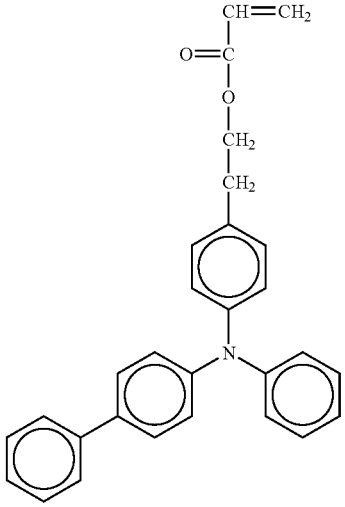
No. 86
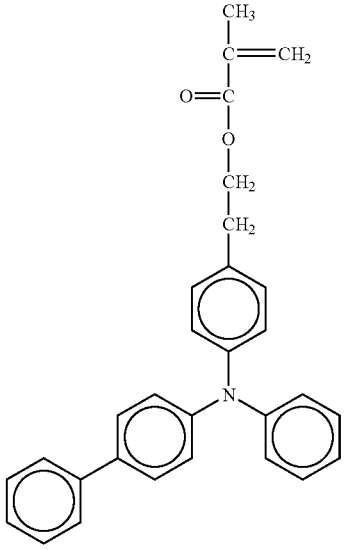

-continued
No. 87
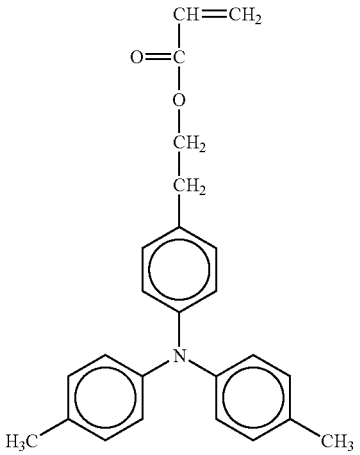
No. 88
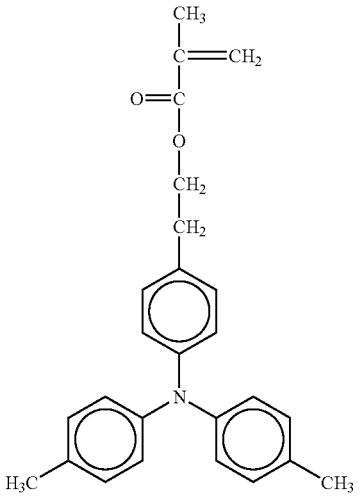
No. 89
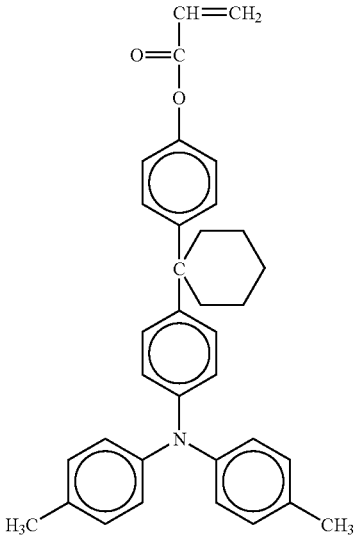
-continued
No. 90
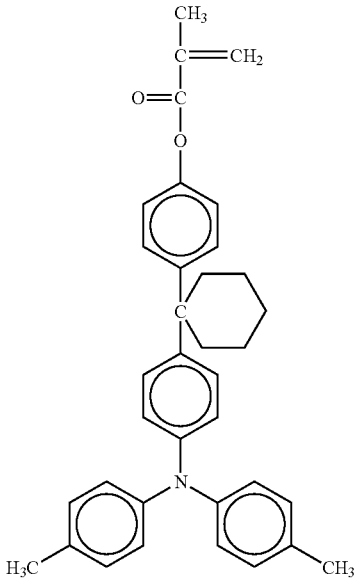
No. 91
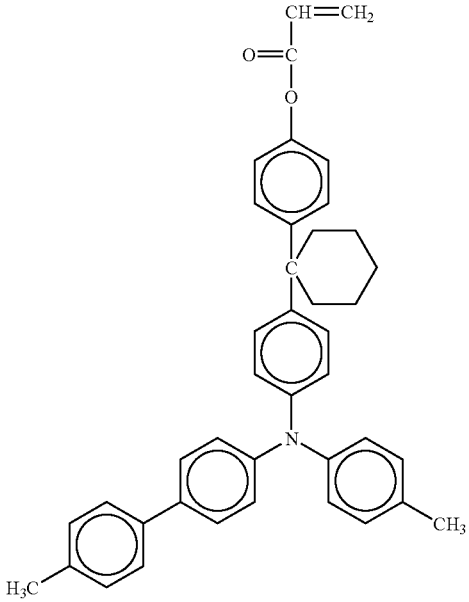

-continued
No. 92
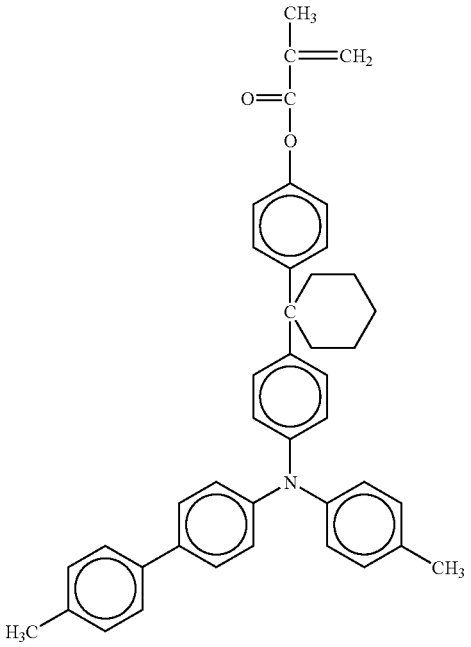
-continued
No. 94
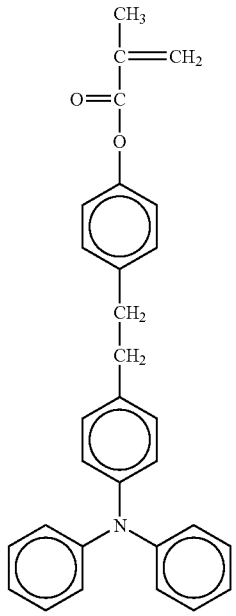
No. 93
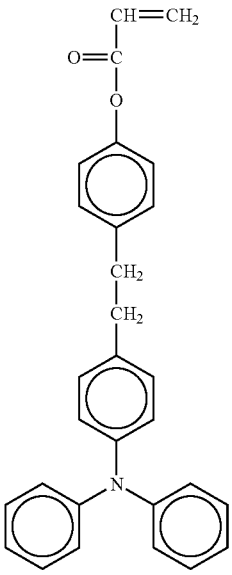
No. 95
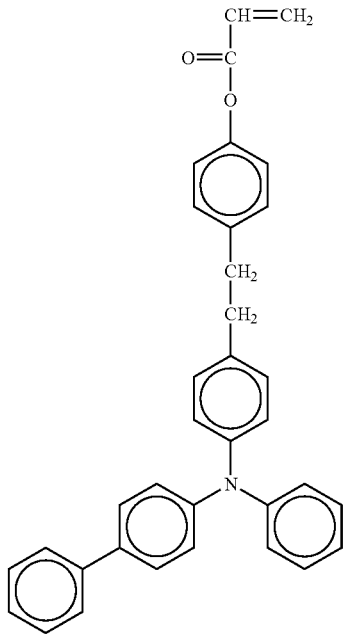

-continued
No. 96
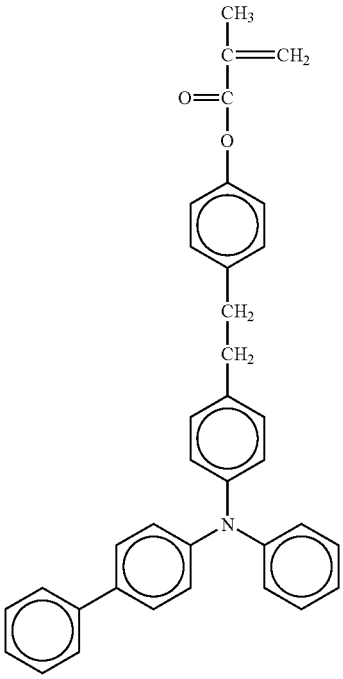
No. 97
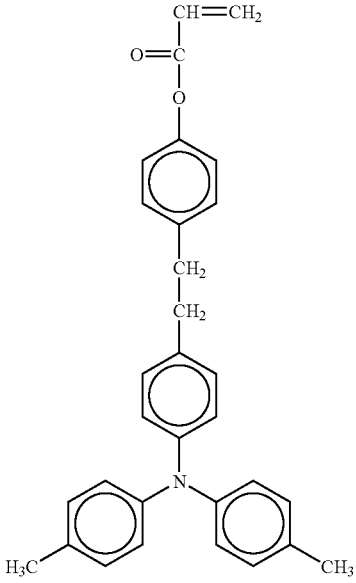
-continued
No. 98
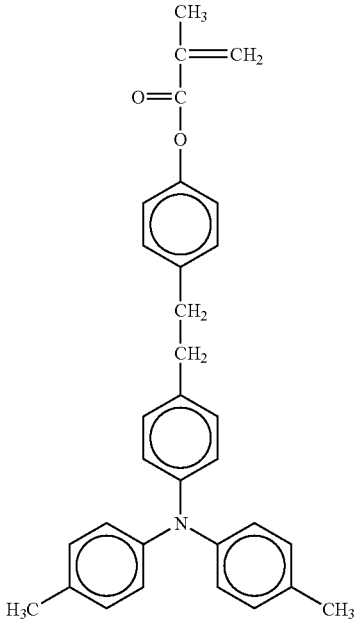
No. 99
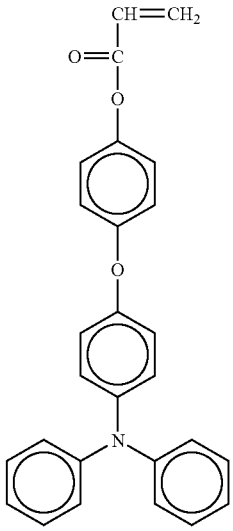

-continued
No. 100
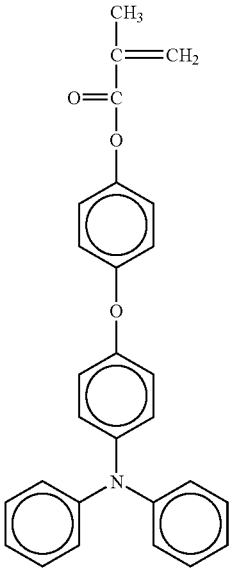
No. 101
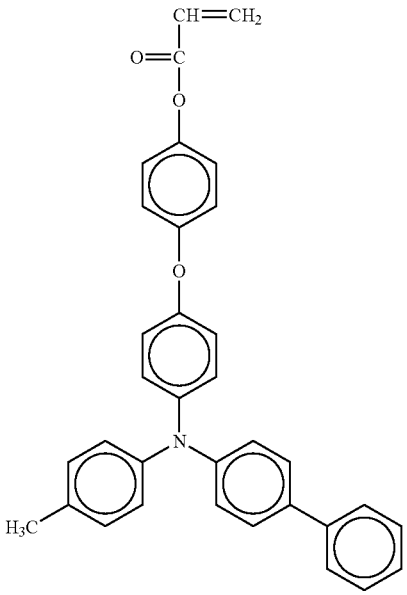
-continued
No. 102
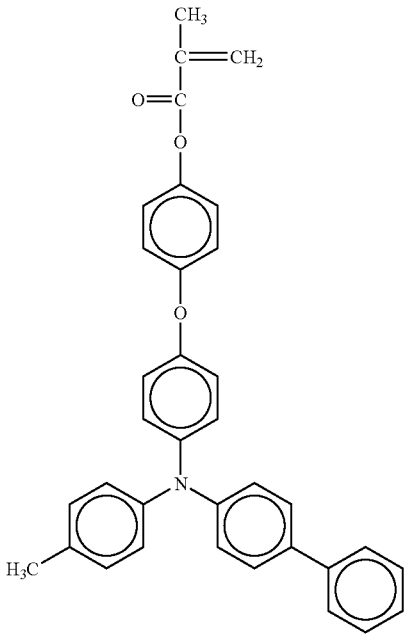
No. 103
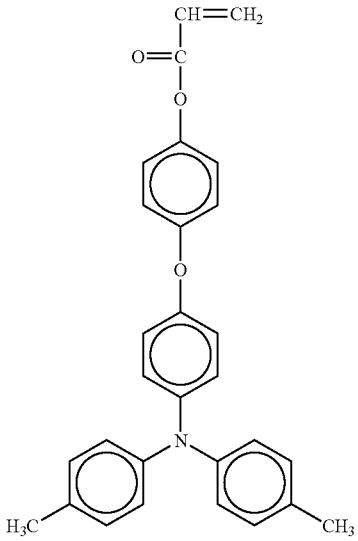

-continued
No. 104
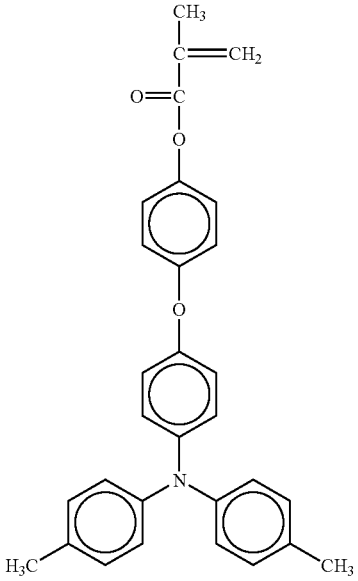
No. 105
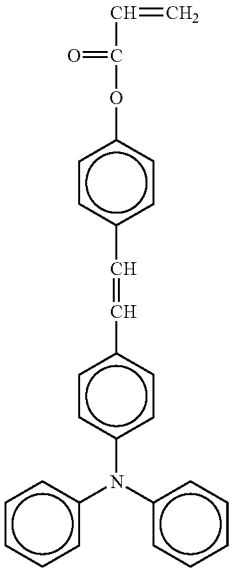
-continued
No. 106
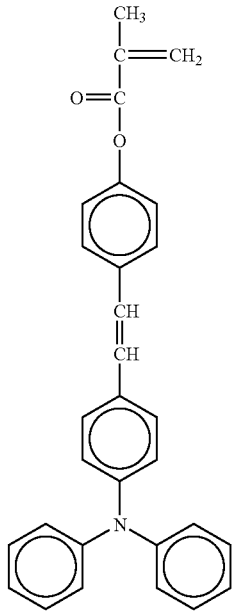
No. 107
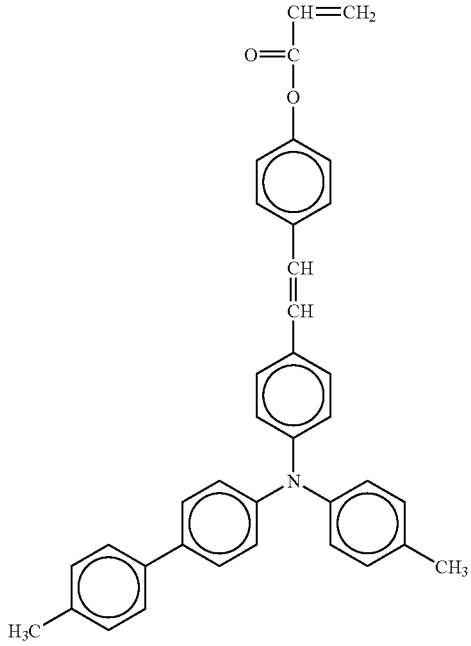

-continued
No. 108
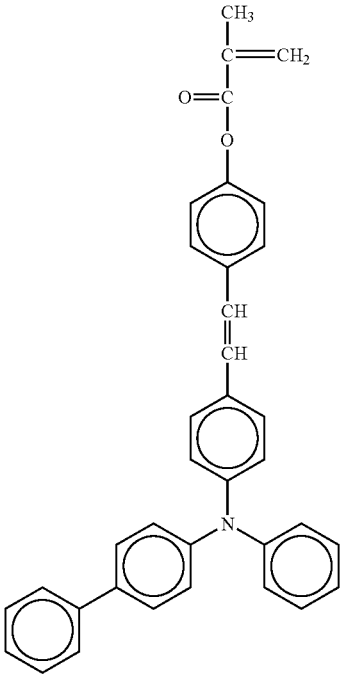
No. 109
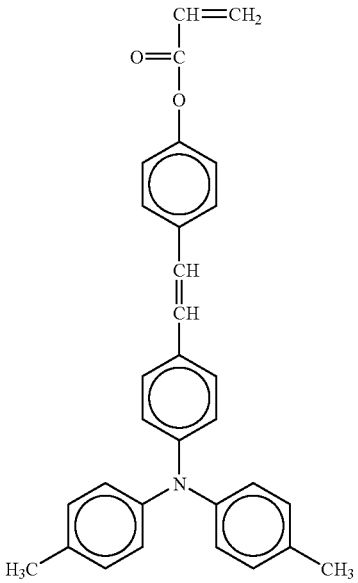
-continued
No. 110
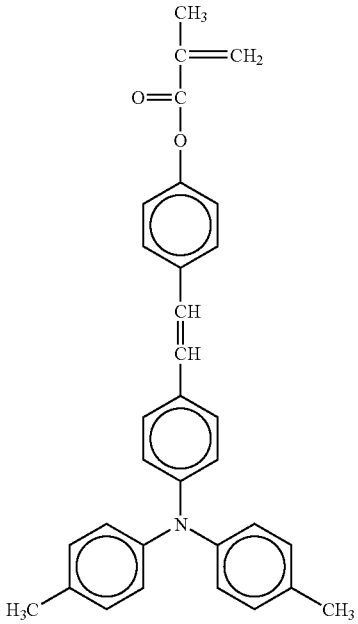
No. 111
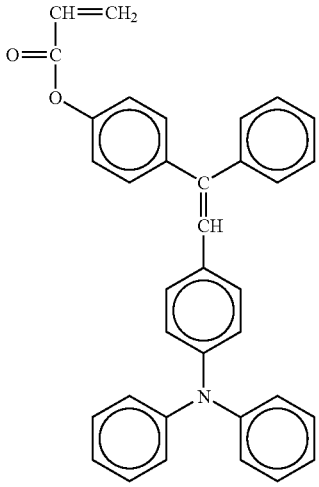
No. 112
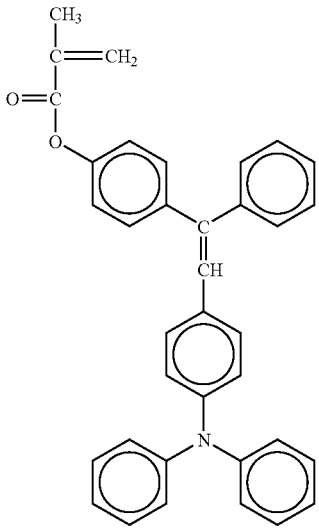

-continued
No. 113
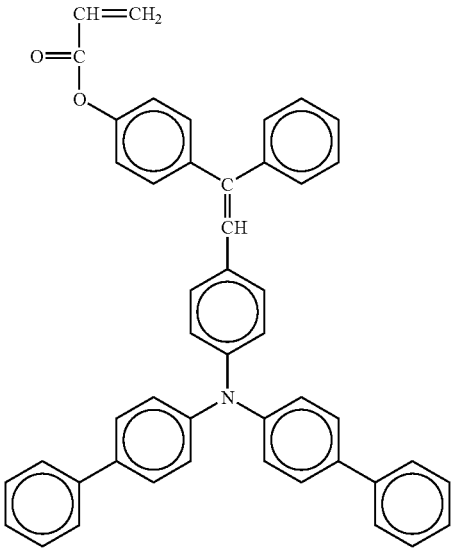
No. 114
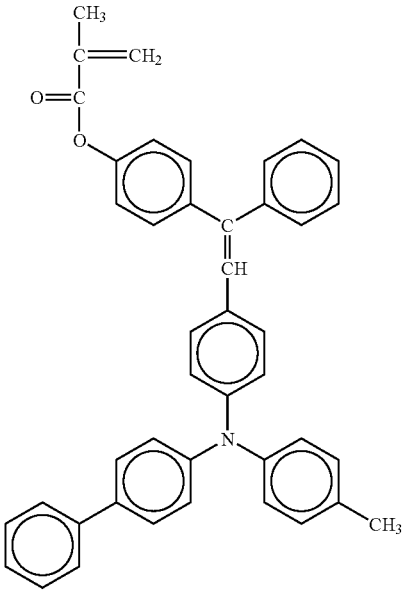
No. 115
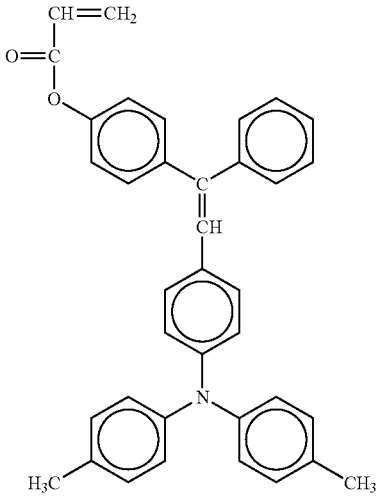
-continued
No. 116
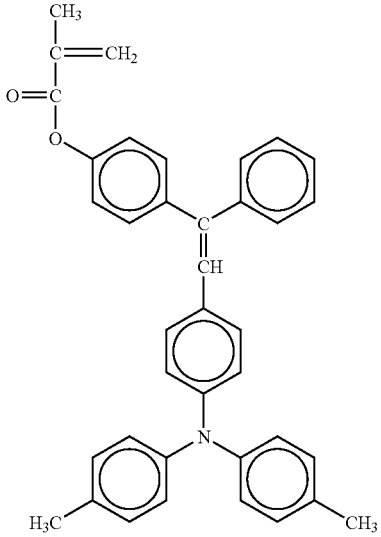
No. 117
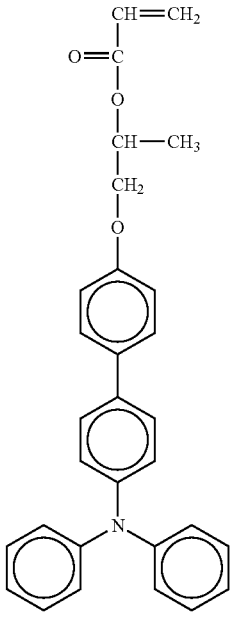

-continued
No. 118
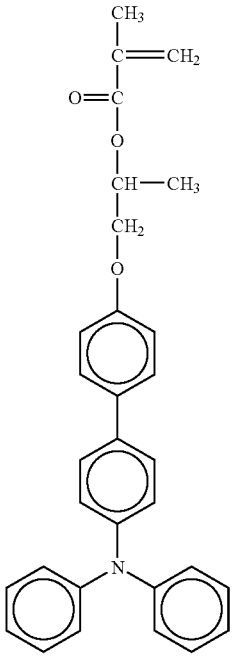
No. 119
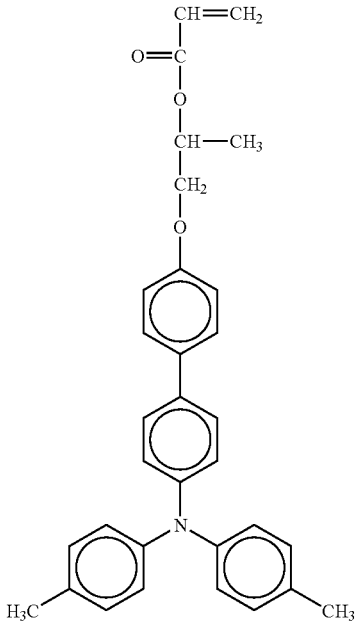
-continued
No. 120
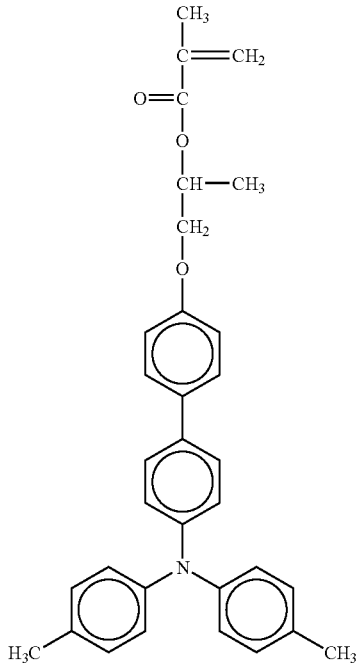
No. 121
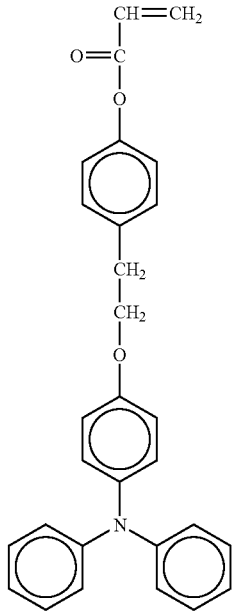

-continued
No. 122
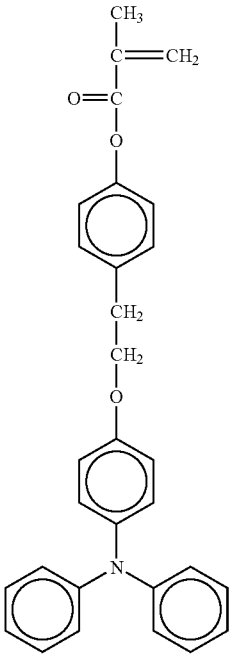
No. 123
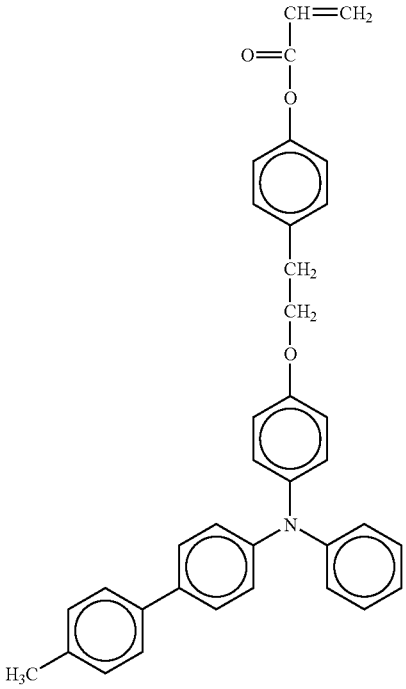
-continued
No. 124
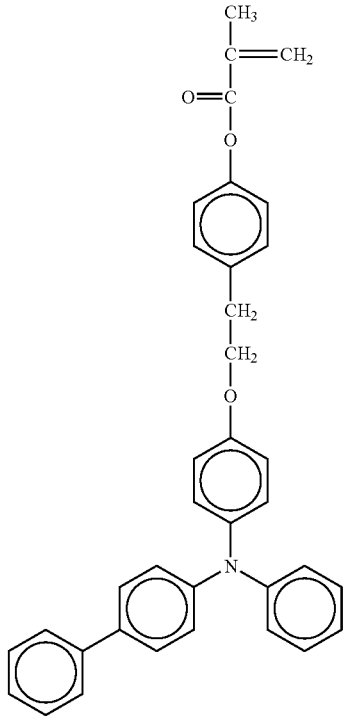
No. 125
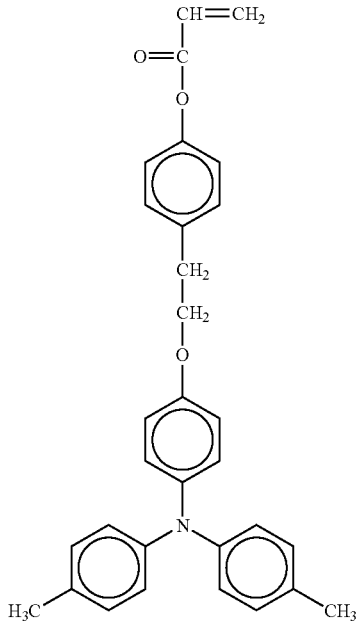

-continued
No. 126
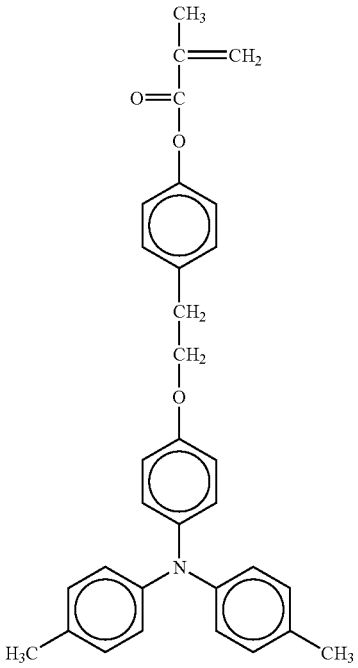
No. 127
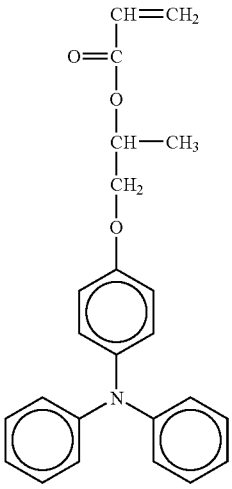
No. 128
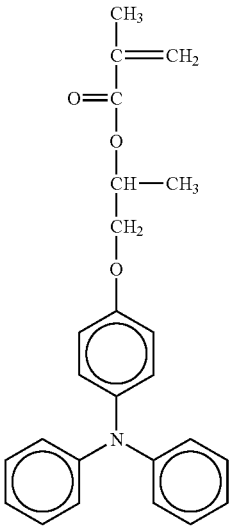
-continued
No. 129
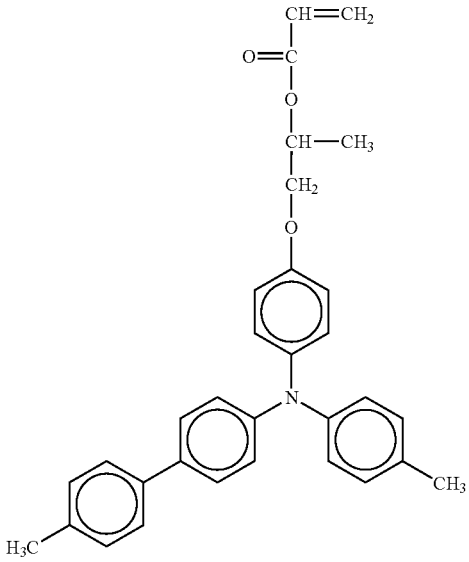
No. 130
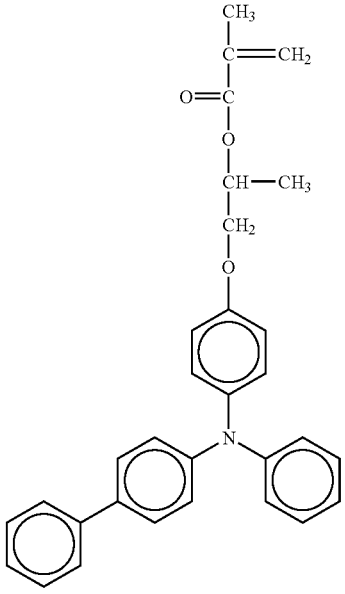

-continued
No. 131
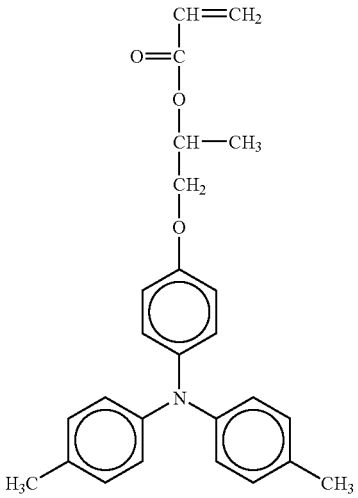
No. 132
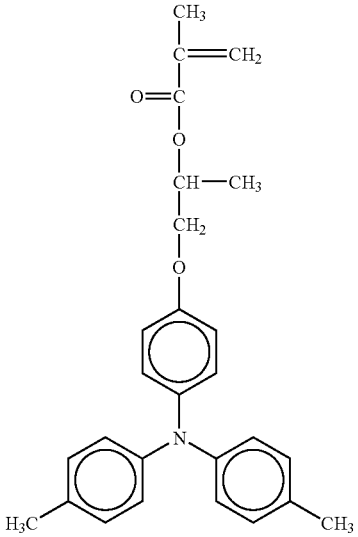
No. 133
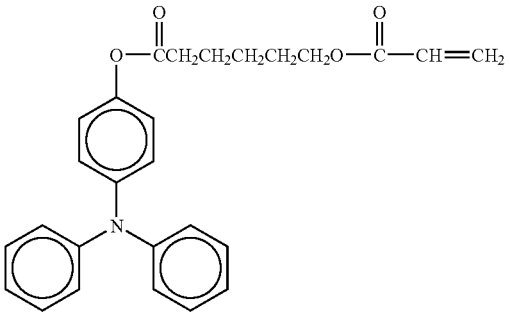
-continued
No. 134
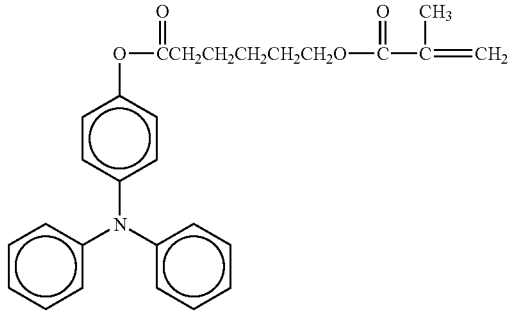
No. 135
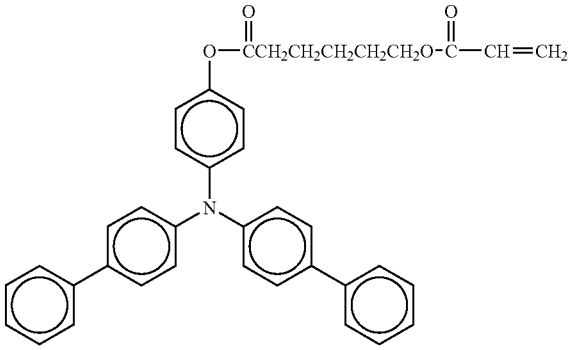
No. 136
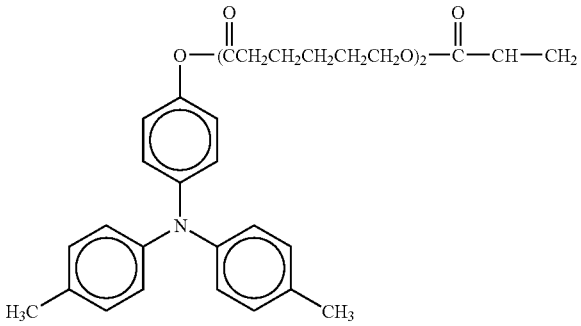
No. 137
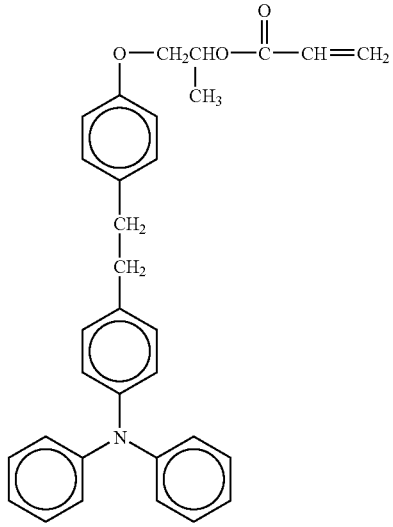

-continued
No. 138
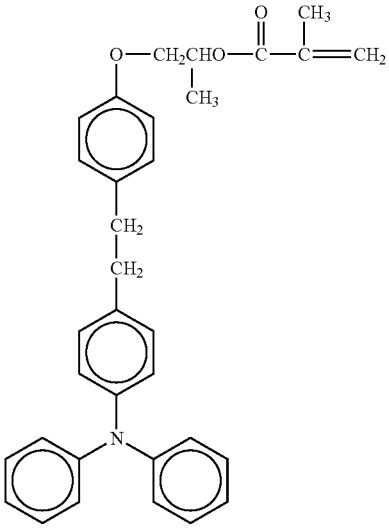
No. 139
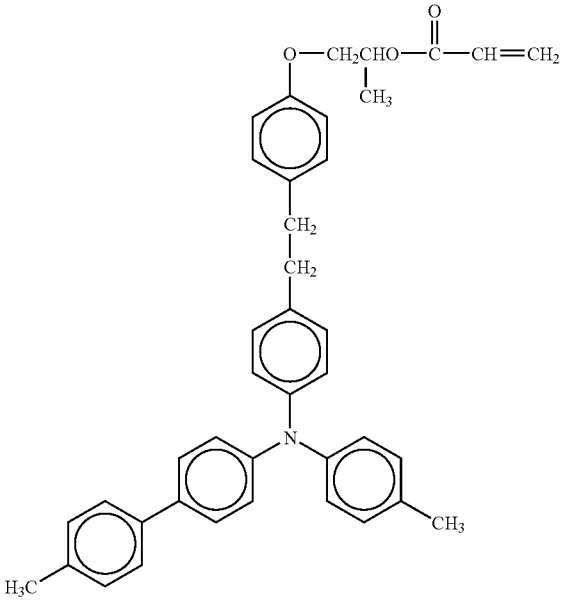
-continued
No. 140
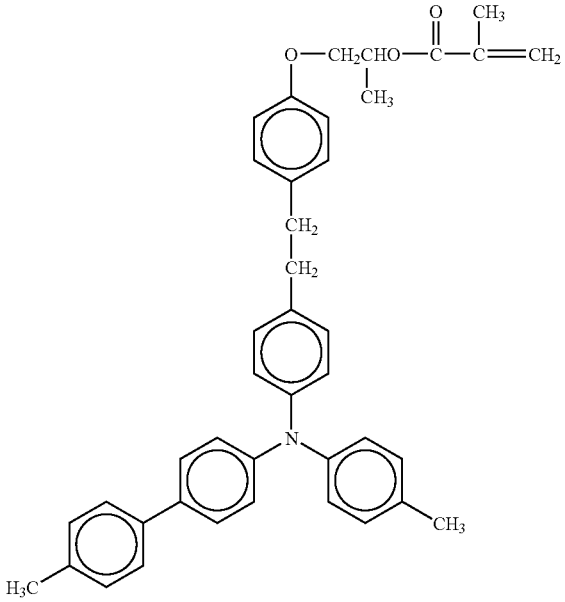
No. 141
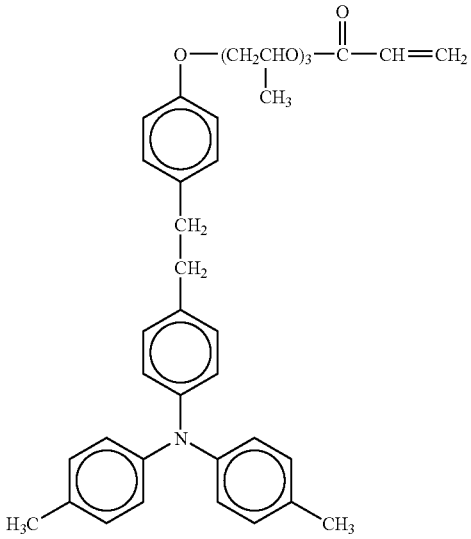

-continued
No. 142
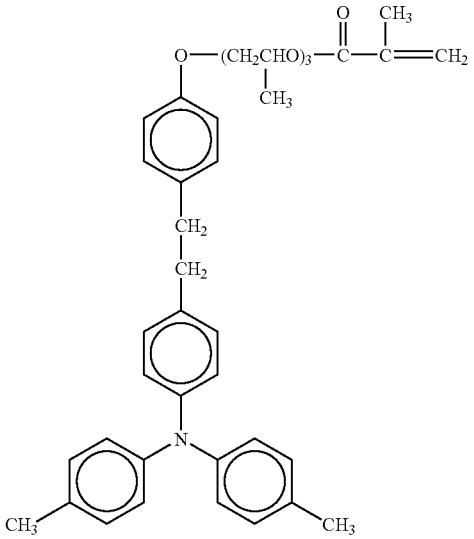
No. 143
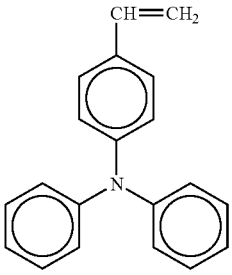
No. 144
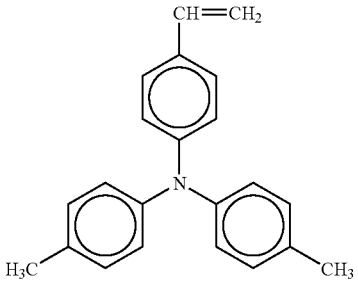
No. 145
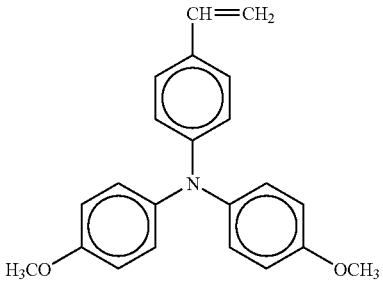
-continued
No. 146
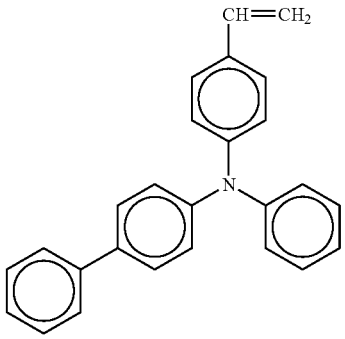
No. 147
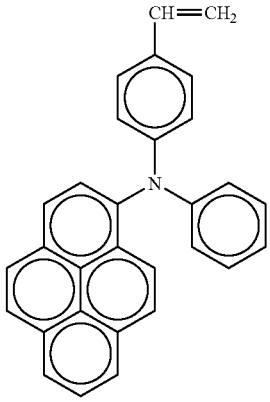
No. 148
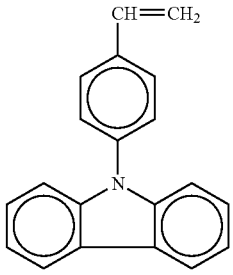
No. 149
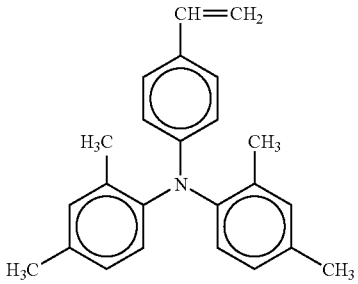
No. 150
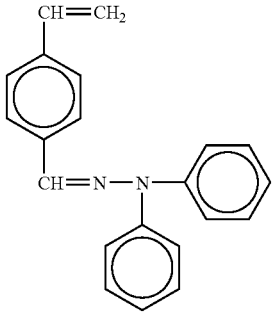

-continued
No. 151
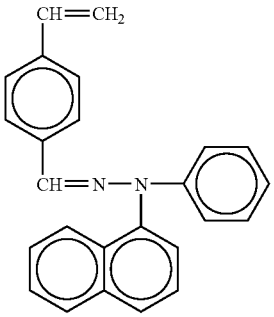
No. 152
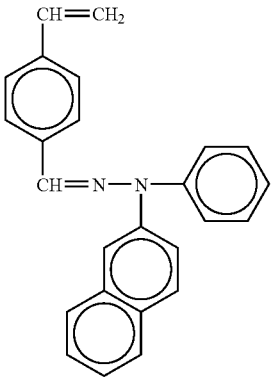
No. 153
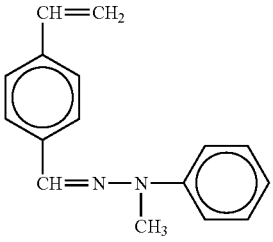
No. 154
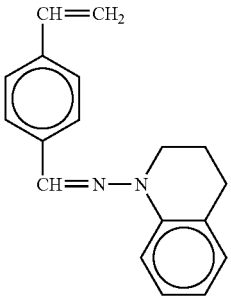
No. 155
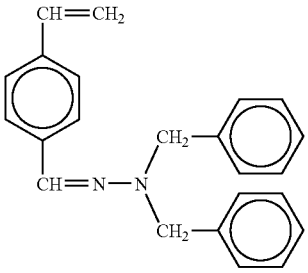
-continued
No. 156
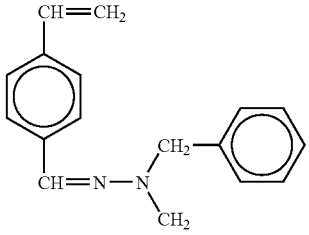
No. 157
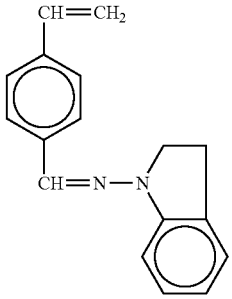
No. 158
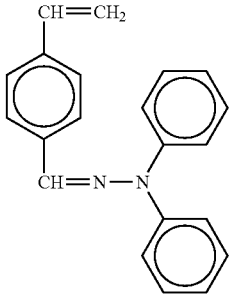
No. 159
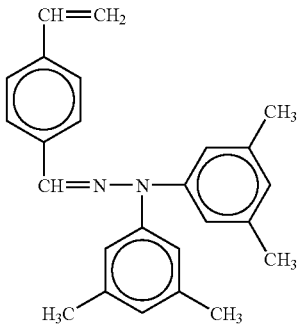
No. 160
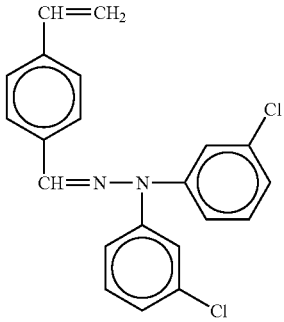

The radical polymerizable compounds having one functionality with charge transport structure employed in the invention is essential for providing crosslinked surface layers with charge transport ability. The content of radical polymerizable compounds is preferably 20% by mass to 80% by mass, more preferably 30% by mass to 70% by mass, based on the total mass of crosslinked surface layers. When the content is less than 20% by mass, charge transport property of crosslinked surface layers may not be sufficiently maintained, and causes deterioration of electrical properties such as sensitivity reduction and residual potential increase under repeated usages. When the content of radical polymerizable compounds having one functionality is more than 80% by mass, the content of radical polymerizable monomers having three or more functionalities may become inevitably deficient, reducing the crosslinked density and causing insufficient wear resistance. Although required electric properties, degree of wear resistance and associated film thickness of crosslinked surface layers of photoconductor differs depending on the processes, the content of radical polymerizable compounds having one functionality is more preferably 30% by mass to 70% by mass, considering the balance between properties.

The crosslinked surface layers are formed by curing at least a radical polymerizable compound having three or more functionalities with no charge transport structure and a radical polymerizable compound having one functionality with charge transport structure. Furthermore, known radical polymerizable monomers and/or radical polymerizable oligomers having one or two functionalities may be used simultaneously for viscosity control during coating, stress relief of crosslinked surface layers, surface energy degradation, and friction coefficient reduction. These radical polymerizable monomers or olygomers may be of known compounds.

Examples of radical polymerizable compounds having one functionality include 2-ethylhexyl acrylate, 2-hydroxyethyl acrylate, 2-hydroxypropyl acrylate, tetrahydrofurfuryl acrylate, 2-ethylhexylcarbitol acrylate, 3-methoxybutyl acrylate, benzyl acrylate, cyclohexyl acrylate, isoamyl acrylate, isobutyl acrylate, methoxytriethyleneglycol acrylate, phenoxytetraethyleneglycol acrylate, cetyl acrylate, isotearyl acrylate, stearyl acrylate, styrenemonomer, and the like.

Examples of radical polymerizable monomer having two functionalities include 1,3-butanediol diacrylate, 1,4-butanediol diacrylate, 1,4-butanediol dimethacrylate, 1,6-hexanediol diacrylate, 1,6-hexanediol dimethacrylate, diethyleneglycol diacrylate, neopentylglycol diacrylate, EO-modified bisphenol A diacrylate, EO-modified bisphenol F diacrylate, neopentylglycoldiacrylate, and the like.

Examples of functional monomer include fluorinated monomers such as octafluoropentylacrylate, 2-perfluorooctylethyl acrylate, 2-perfluorooctylethyl methacrylate, 2-perfluoroisononylethyl acrylate, and the like; vinyl monomers, acrylate and methacrylate having polysiloxane group such as acryloylpolydimethylsiloxaneethyl, methacryloylpolydimethylsiloxaneethyl, acryloylpolydimethylsiloxanepropyl, acryloylpolydimethylsiloxanebutyl, diacryloylpolydimethylsiloxanediethyl, and the like, which have 20 to 70 siloxane repeating units, as described in JP-B Nos. 05-60503 and 06-45770.

Examples of radical polymerizable oligomer include epoxy acrylates, urethane acrylates, and polyester acrylate oligomers.

The content of radical polymerizable monomers and/or radical polymerizable oligomers having one or two functionalities is preferably 50 parts by mass or less and more preferably 30 parts by mass relative to 100 parts by mass of radical polymerizable monomers having three or more functionalities. If the content is more than 50 parts by mass, three dimensional crosslink density of the crosslinked surface layer actually becomes less, causing wear resistance degradation.

Antioxidant

Antioxidant is not limited and may be selected accordingly from commercially available products such as rubbers, plastics, and fats, etc. Examples include phenol compounds, paraphenylene diamine compounds, hydroquinone compounds, organosulfur compounds, organophosphorus compounds, and the like. These can be used alone or in combination of two or more.

Examples of phenol compounds include: 2,6-di-t-butyl-p-cresol, butylhydroxyanisole, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t)-butylphenol, 4,4'-butylydenebis-(3-methyl-6-t-butylphenol), 1,1,3-tris-(2-methyl-4-hydroxy 5-t-butylphenyl)butane, 1,3,5-trimethyl-2,4,6-tris-(3,5-di-t-butyl-4-hydroxybenzyl)benzene, tetrakis-[methylene 3-(3',5'-di-t-butyl-4'-hydroxy-phenyl)propionate]methane, bis-[3,3'-bis-(4'-hydroxy-3'-t-butylphenyl)butylic acid]glycolester, tocopherols, etc.

Examples of paraphenylene diamine compounds include: N-phenyl-N'-isopropyl-p-phenylene diamine, N,N'-di-sec-butyl-p-phenylene diamine, N-phenyl-N-sec-butyl-p-phenylene diamine, N,N'-di-isopropyl-p-phenylene diamine, N,N'-dimethyl-N,N'-di-t-butyl-p-phenylene diamine, etc.

Examples of hydroquinone compounds include 2,5-di-t-octyl hydroquinone, 2,6-di-dodecyl hydroquinone, 2-dodecyl hydroquinone, 2-dodecyl 5-chlorohydroquinone, 2-t-octyl 5-methyl hydroquinone, 2-(2-octadecenyl)-5-methyl hydroquinone, etc.

Examples of organosulfur compounds include dilauril-3,3'-thiodipropionate, distearil-3,3'-thiodipropionate, dimyristyl-3,3'-thiodipropionate, ditetradecyl-3,3'-thiodipropionate, pentaerythritol tetrakis (3-laurylthiol propionate), etc.

Examples of organophosphorus compounds include triphenyl phosphite, tris (nonylphenyl) phosphite, tri(di-nonyl phenyl) phosphite, tris (2-ethylhexyl) phosphite, tridecyl phosphite, toris (toridecyl) phosphite, diphenylmono (2-ethylhexyl) phosphite, diphenylmonodecyl phosphite, tris(2,4-di-t-butylphenyl) phosphate, distearyl pentaerythritol diphosphite, bis (2,4,di-t-butylphenyl) pentaerythritol phosphite, 2,2-methylenebis (4,6,di-t-butylphenyl) octylphosphite, tetrakis (2,4,di-t-butylphenyl)4, 4'-biphenylene-diphosphite, dilauryl hydrogen phosphite, diphenyl hydrogen phosphite, tetraphenyl dipropylene glycol diphosphite, tetraphenyltetra (tridecyl)pentaerythritol tetraphosphite, tetra (tridecyl)-4,4'isopropyledene diphenyl diphosphite, bis (nonylphenyl) pentaerythritol diphosphite, hydrogenerated bisphenol A•pentaerythritol phosphite polymer, etc.

The latent electrostatic image bearing member of the invention is required to contain at least two different antioxidants to be able to prevent surface contamination such as decomposition or alteration, etc. caused by ozone gas or NOx produced from the repeated usage inside the image forming apparatus by eliminating radical residual roused from lights and heat during production and by preventing reaction of unreacted radical functional groups.

Two or more different antioxidants may be of identical or heterogonous compounds. It is preferably having at least one selected from phenol compounds, paraphenylene diamine compounds, or hydroquinone xenogeneic compounds working as supplement agents for radicals, and at least one selected from organosulfur or organophosphorus compounds working as peroxide decomposer.

Specifically, when one or more of phenol and organic phosphorus compounds are added to radical polymerizable compounds having three or more functionalities with no charge transport structure and radical polymerizable compounds having one functionality with charge transport structure, electric properties, particularly electrification properties can be protected from degradation and residual potential increase, crosslinking inhibition or wear resistance degradation can be prevented.

The content of antioxidant in the crosslinked surface layers is preferably 0.2% by mass to 10% by mass and more preferably 1% by mass to 5% by mass. If the content is less than 0.2% by mass, protection against degradation of electrification properties may be insufficient, and if the content is more than 10% by mass, wear resistance may be deteriorated due to crosslinking inhibition.

The mixture fraction of phosphorus antioxidant relative to 1 part by mass of phenol antioxidant is preferably 2 parts by mass to 50 parts by mass and more preferably 3 parts by mass to 30 parts by mass. By following this mixture fraction, electric properties, in particular, electrification properties can be protected from degradation and unwanted increase in residual potential, crosslinking inhibition or wear resistance degradation can be prevented yielding photosensitive members with excellent properties.

Of these phosphorus antioxidant, one with the melting point of 100° C. or more is unlikely to be effected by heat associated with latent electrostatic image bearing member production and can function as a peroxide decomposer effectively.

The crosslinked surface layer of the invention comprises at least a radical polymerizable compound having three or more functionalities with no charge transport structure, a radical polymerizable compound having one functionality with charge transport structure, and at least two different antioxidants. The pararell use of radical polymerizable monomers and radical polymerizable oligomers with one or two functionalities are possible to induce advantageous effects such as viscosity adjustment at the coating, stress relief on the crosslinked surface layers, surface-energy degradation and friction coefficient reduction. Known products can be used for these radical polymerizable monomers and oligomers.

Examples of radical polymerizable monomers with one functionality are 2-ethylhexyl acrylate, 2-hydroxyethyl acrylate, 2-hydroxypropyl acrylate, tetrahedrofurfuryl acrylate, 2-ethylhexyl carbitol acrylate, 3-methoxybutyl acrylate, benzyl acrylate, cyclohexyl acrylate, isoamyl acrylate, isobutyl acrylate, methoxytriethlene glycol acrylate, phenoxytetraethylene glycol acrylate, cetyl acrylate, isostearyl acrylate, stearyl acrylate, styrene monomer, etc.

Examples of radical polymerizable monomers with two functionalities are 1,3-butanediol diacrylate, 1,4-butanediol diacrylate, 1,4-butanediol dimethacrylate, 1,6-hexanediol diacrylate, 1,6-hexanediol dimethacrylate, diethylene glycol diacrylate, neopentyl glycol diacrylate, EO-modified bisphenol A diacrylate, EO-modified bisphenol F diacrylate, neopentylglycol diacrylate, etc.

Examples of functional monomer include fluorinated monomers such as octafluoropentylacrylate, 2-perfluorooctylethyl acrylate, 2-perfluorooctylethyl methacrylate, 2-perfluoroisononylethyl acrylate, and the like; vinyl monomers, acrylate and methacrylate having polysiloxane group such as acryloylpolydimethylsiloxaneethyl, methacryloylpolydimethylsiloxaneethyl, acryloylpolydimethylsiloxanepropyl, acryloylpolydimethylsiloxanebutyl, diacryloylpolydimethylsiloxanediethyl, and the like, which have 20 to 70 siloxane repeating units, as described in JP-B Nos. 05-60503 and 06-45770.

Examples of radical polymerizable olygomers include epoxyacrylic, urethane-acrylic and polyester-acrylic olygomers. However, if excessive amount of radical polymerizable monomers or radical polymerizable olygomers with one or two functionalities are added, three-dimentional crosslink bonding density of crosslinked surface layers actually decreases, leading to wear resistance deterioration. For this reason, the content of these monomers or olygomers are preferably 50 parts by mass or less and more preferably 30 parts by mass or less relative to 100 parts by mass of radical polymerizable compounds with three or more functionalities.

The crosslinked surface layer of the invention is produced by curing at least a radical polymerizable compound having three or more functionalities with no charge transport structure, a radical polymerizable compound having one functionality with charge transport structure and at least two or more different antioxidants using light energy irradiation. Polymerization initiator can be added into the crosslinked surface layer for effective crosslinking reaction as necessary.

The crosslinked surface layer of the invention is produced by curing at least a radical polymerizable compound having three or more functionalities with no charge transport structure and a radical polymerizable compound having one functionality with charge transport structure, however, polymerization initiator can be added into the crosslinked surface layer coating liquids for effective crosslinking reaction as necessary. Examples of polymerization initiator include thermal polymerization initiator and light polymerization initiator, and the like. These polymerization initiators can be used alone or in combination of two or more.

Examples of thermal polymerization initiator include peroxides such as 2,5-dimethyl hexane-2,5-dihydro peroxide, diqumyl peroxide, benzoyl peroxide, t-butylqumyl peroxide, 2,5-dimethyl-2,5-di(peroxybenzoyl) hexane-3, di-t-butyl beroxide, t-butyl hydroberoxide, cumene hydroberoxide, lauroyl peroxide, 2,2-bis(4,4-di-t-butylperoxycyclohexyl)propane, etc. and azo compounds such as azobis isobutylnitrile, azobiscyclohexane carbonitrile, azobisisobutyricmethyl, azobisisobutylamidin hydrochloride, 4,4-azobis-4-cyanovalericacid, and the like.

Examples of photopolymerization initiator include acetophenone or ketal compounds such as diethoxyacetophenone, 2,2-dimethoxy-1,2-diphenylethan-1-one, 1-hydroxycyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1, 2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl)oxime; benzoinether compounds such as benzoin, benzoinmethyl ether, benzoinethylether, benzoinisobutylether, and benzoinisopropyl ether; benzophenone compounds such as benzophenone, 4-hydroxybenzophenone,methyl o-benzoylbenzoate, 2-benzoylnaphthalene, 4-benzoylbiphenyl, 4-benzoylphenylether, acrylated benzophenone, and 1,4-benzoylbenzene; thioxanthone compounds such as 2-isopropylthioxanthone, 2-chlorothioxanthone, 2,4-dimethylthioxanthone, 2,4-diethylthioxanthone, and 2,4-dichlorothioxanthone; and other photopolymerization initiators such as ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide, bis(2,4-dimethoxybenzoyl)-2,4,4-trimethylpentylphosphine oxide, methylphenylglyoxyester, 9,10-phenanthrene compounds, acridine compounds, triazine compounds, imidazole compounds, and the like.

Also, compounds that has photopolymerization promoting effect can be employed alone or together with the photopolymerization initiators described above; examples of photopolymerization promoter include triethanolamine, methyldiethanolamine, ethyl 4-dimethylaminobenzoate, isoamyl 4-dimethylaminobenzoate, (2-dimethylamino)ethylbenzoate, 4,4'-dimethylaminobenzophenone, and the like.

The content of polymerization initiator is preferably 0.5 parts by mass to 40 parts by mass; more preferably 1 part by mass to 20 parts by mass based on 100 parts by mass of the total amount of entire radical polymerizable compounds.

The coating liquid for crosslinked surface layer of the invention may contain various additives such as plasticizers for the purpose of relieving stress and improving adhesion, leveling agents, non-reactive low-molecular charge transport substances, and the like, as necessary.

Plasticizers usable in the invention include those commonly used for conventional resins such as dibutylphthalate, dioctylphthalate, and the like.

The additive amount is preferably 20% by mass or less, more preferably 10% by mass or less based on the total solid content of coating liquid.

Examples of leveling agents include silicone oils such as dimethyl silicone oil, methylphenyl silicone oil, and the like, and polymers or oligomers having perfluoroalkyl group in the side chain.

The additive amount of leveling agent is preferably 3% by mass or less based on the total solid content of coating liquid.

The crosslinked surface layers of the invention may be prepared by applying coating liquid containing radical polymerizable compounds having three or more functionalities with no charge transport structure and radical polymerizable compounds having one functionality with charge transport structure, onto the charge transporting layer as mentioned later on, followed by curing. If radical polymerizable monomers or compounds are in the liquid state, other ingredients may be dissolved into the liquid prior to coating; alternatively, a solvent may be utilized to dissolve the ingredients.

Examples of solvent include alcohols such as methanol, ethanol, propanol, and butanol; ketones such as acetone, methylethylketone, methyl isobutylketone, and cyclohexanone; esters such as ethyl acetate and butyl acetate; ethers such as tetrahydrofuran, dioxane, and propylether; halogenated compounds such as dichloromethane, dichloroethane, tolly chloroethane, and chlorobenzene; aromatics such as benzene, toluene, and xylene; cellosolves such as methylcellosolve, ethylcellosolve, and cellosolve acetate. These solvents may be used alone or in combination of two or more.

The dilution rate by solvent depends on the solubility of coating liquid, coating process, desired membrane thickness, and the like, and may be properly selected according to the application. Examples of coating method include dipping method, spray coating, bead coating, ring coating, and the like.

In the present invention, after coating liquid for crosslinked surface layer is applied, it is cured by exposing to external energy to form a crosslinked surface layer. The external energy may be thermal, optical, or radiation energy. The thermal energy may be applied from the coat surface or the support by the use of air, nitrogen, vapor, various heating media, infrared ray, or electronic wave. The heating temperature is preferably 100° C. to 170° C. When the temperature is less than 100° C., reaction rate may be slow and the curing progress may not complete. When the temperature is more than 170° C., the reaction may progress nonuniformly, possibly causing significant distortion, many unreacted residues or halt ends in the crosslinked surface layer. In some cases, preferably, initial heating is carried out at a lower temperature of less than 100° C., and then further heating is carried out at a higher temperature of 100° C. or more to complete the reaction.

The source of optical energy may be selected from high pressure mercury lamps and metal halide lamps having main emitting wavelength at UV region, and also visible light sources in accordance with the absorption wave length of radical polymerizable components or photopolymerization initiators. Preferred irradiated energy is 50 mW/cm$^2$ to 1,000 mW/cm$^2$. When irradiated energy is less than 50 mW/cm$^2$, the curing period may be excessively long, and when it is more than 1,000 mW/cm$^2$, the surface of crosslinked surface layers become considerably rough, may be containing local wrinkles, many unreacted residues or halt ends, due to nonuniform reaction. Example of radiation energy may be of electron beam. Among energies, thermal and optical energy may be effective and useful by virtue of easiness of controlling the reaction rate and convenience of the apparatus.

The coating liquid for crosslinked surface layer may contain other additives such as binder resin, antioxidant or plasticizer having no radical polymerizable functional groups other than radical polymerizable compounds having three or more functionalities with charge transport structure or radical polymerizable compounds having one functionality with charge transport structure.

When these additives are contained in excessive amount, crosslinked density decreases and the phase separation between cured materials produced by reaction and additives occur and the coating liquid become soluble in organic solvent. Therefore adjusting total content to be 20% by mass or less relative to the total solid amount of coating liquid is important. The total content of radical polymerizable monomers, reactive olygomers and reactive polymers with one or two functionalities is preferably 20% by mass or less relative to radical polymerizable monomers with three functionalities in order to prevent crosslinked density degradation. Furthermore, if radical polymerizable compounds with two or more functionalities are contained in excessive amounts, bulky structures become fixed in the crosslinked structure by multiple bonding, likely to cause distortion and become an aggregate of minute hardened materials. This may also lead to solubilization of coating liquid in organic solvents. It varies according to the compound structures; however, the content of radical polymerizable compounds with two or more functionalities is preferably 10% by mass or less relative to the content of radical polymerizable compounds having one functionality with charge transport structure. Keeping outermost surfaces of crosslinked surface layers insoluable in organic solvents is preferable for wear and flaw resistance to reach satisfactory level in the structure where charge generating layer, charge transporting layer and crosslinked surface layer are built up sequentially.

To make crosslinked surface layers insoluble in organic solvent, controlling (i) composition and content fraction of coating liquid for crosslinked surface layer, (ii) diluent solvent and solid density of coating liquid for crosslinked surface layer, (iii) selection of coating method for crosslinked surface layer, (iv) curing condition of the crosslinked surface layer and (v) lower solubility of bottom layer of the charge transporting layer, are important, however one factor may not be enough to accomplish the task.

If a solvent with low evaporation rate is used for diluent solvent of coating liquid for crosslinked surface layer, residual solvent may prevent curing or may multiply added amount of bottom element, leading to unhomogeneous curing or curing density degradation, and the coating liquid may become soluble in organic solvent. Specifically, tetrahydrofuran, mixed solvent of tetrahydrofuran and methanol, ethyl acetate, methyl ethyl ketone, ethyl cellosolve, etc. are useful and can be selected according to the coating method. Correspondingly, if solid density is too low for the same reason, it is likely to become soluble in organic solvent. The upper limit of density may be specified due to the limitations in film thickness and coating liquid viscosity, it is preferably used in a range of 10% by mass to 50% by mass.

The coating method for crosslinked surface layers where solvent amount at the coated membrane formation and contact time with the solvent are cut back is preferred. Specifically, spray coating method and ring coating method in which the coating liquid amount is controlled are preferred. Using charge transport polymer as charge transporting layers and building insoluble intermediate layer against coating solvent of crosslinked surface layers are effective for controlling the content mixed in the lower layer.

When curing crossliked layers, if heat or light irradiation energy is low, curing does not complete and solubility against organic solvent increases. On the other hand, if the curing is progressed with very high energy, curing reaction is likely to become inhomogeneous and uncrosslinked part or radical stopping part may increase and become aggregate of minute cured materials resulting in the increase in solubility against organic solvent.

To make it insoluble against organic solvent, the heat curing condition is preferably 100° C. to 170° C. for 10 minutes to 3 hours and 50 mW/cm$^2$ to 1,000 mW/cm$^2$ for 5 seconds to 5 minutes for UV light irradiation curing condition while adjusting temperature increase 50° C. or less and controlling inhomogeneous curing reaction.

To make crosslinked surface layers insoluble against organic solvent, the content fraction is preferably 7:3 to 3:7 when acrylate monomers with three acryloyl oxy groups and triaryl amine compounds with one acryloyl oxy group are used for coating liquid. And it is preferable to add 3% by mass to 20% by mass of polymerization initiator relative to total amount of acrylate compounds and additional solvent to produce coating liquid. For example, when using triaryl amine doner as charge transport substance and polycarbonate resin as binder resin to produce an outer layer by spray coating in the charge transporting layer as a lower layer of crosslinked surface layer, tetrahydrofuran, 2-butanone and ethyl acetate are favorably used as solvent for coating liquid. The amount fraction is 3 times to 10 times the total amount of acrylate compounds.

Then, prepared coating liquid is coated by spraying, etc. on the photoconductor where undercoat layer, charge generating layer, and charge transporting layer are coated sequentially on the support of alumina cylinder, etc. Then, the coating is subjected to drying at a relatively low temperature for a short period, e.g. 25° C. to 80° C. for 1 minute to 10 minutes, and cured by ultraviolet (UV) irradiation or heating.

In UV irradiation, preferably, a metal halide lamp etc. is used at an irradiated energy of 50 mW/cm$^2$ to 1,000 mW/cm$^2$. For example, when UV irradiation is applied at 200 mW/cm$^2$, the irradiation is preferably applied evenly from several lamps in the drum circumferential direction for about 30 seconds. The temperature of drum should be controlled to maintain 50° C. or less. When the crosslinked surface layer is cured through thermal polymerization, the heating temperature is preferably 100° C. to 170° C. When an air blasting oven is used as a heater and the heating temperature is set at 150° C., the heating time is preferably about 20 minutes to 3 hours, for example.

After curing is completed, the latent electrostatic image bearing member of the invention is produced by additional heating at 100° C. to 150° C. for 10 minutes to 30 minutes for residual solvent reduction.

<Support>

The support is not specified and may be of any having electric conductivity of volume resistance, $10^{10}$ Ω·cm or less.

Examples of support include film-shaped, cylindrically-shaped plastic or paper covered with metals such as aluminum, nickel, chromium, nichrome, copper, gold, silver, and platinum; metal oxides such as tin oxide and indium oxide; by vapor deposition or sputtering. Or the support may be a plate of aluminum, aluminum alloy, nickel or stainless steel, or a plate formed into a tube by extrusion or drawing and surface-treating by cut, finish and polish, etc. The endless nickel belt and endless stainless steel belt such as those described in JP-A No. 52-36016 may also be employed as a support.

The support may be prepared by dispersing conductive fine particles into a suitable binder resin and coating onto a support material.

Examples of conductive fine particles include metal powder such as carbon black, acetylene black, aluminum, nickel, iron, nichrome, copper, zinc and silver, and metal oxide fine particles such as of conductive tin oxide and ITO. Examples of binder resin include thermoplastic, thermoset or photocoagulating resins such as polystyrene, styrene acrylonitrile copolymer, styrene butadiene copolymer, styrene maleic anhydride copolymer, polyester, polyvinyl chloride, vinyl chloride-vinyl acetate copolymer, polyvinyl acetate, polyvinylidene chloride, polyacrylate resin, phenoxy resin, polycarbonate, cellulose acetate resin, ethyl-cellulose resin, polyvinyl butyral, polyvinyl formal, polyvinyl toluene, poly-N-vinylcarbazole, acrylate resin, silicone resin, epoxy resin, melamine resin, urethane resin, phenol resin, alkyd resin, etc.

The conductive layer can be prepared by dispersing and coating the conductive fine particles and the binder resin into a suitable solvent, for example, tetrahydrofuran, dichloromethane, methyl ethyl ketone, toluene, etc.

Furthermore, the support which is prepared by forming a conductive layer on the suitable cylinder base with a thermal-contraction inner tube made of suitable materials such as polyvinyl chloride, polypropylene, polyester, polystyrene, polyvinylidene chloride, polyethylene, chlorinated rubber, Teflon™, etc. containing conductive fine particles may also be utilized as the conductive support in the present invention.

<Photosensitive Layers of Laminated Structure>

The photosensitive layer of laminated structure contains a charge generating layer and a charge transporting layer having charge transport function disposed in the order and other layers as necessary.

Charge Generating Layer

The charge generating layer contains a charge generating material having charge generating function as a main element and may also contain binder resin or other elements as necessary.

The charge generating materials may be classified into inorganic materials and organic materials and both of them are suitable for use.

Examples of inorganic materials include crystalline selenium, amorphous selenium, selenium-tellurium, selenium-tellurium-halogen, selenium-arsenic compound, and amorphous silicon. The amorphous silicon may have dangling bonds terminated with hydrogen atom or halogen atom, or it may be doped with boron or phosphorus.

The organic material may be selected from conventional materials, examples thereof include phthalocyanine pigments such as metal phthalocyanine, non-metal phthalocyanine, and the like, azulenium salt pigments, squaric acid methine pigment, azo pigments having a carbazole skeleton, azo pigments having a triphenylamine skeleton, azo pigments having diphenylamine skeleton, azo pigments having dibenzothiophene skeleton, azo pigments having fluorenone skeleton, azo pigments having oxadiazole skeleton, azo pigments having bisstylbene skeleton, azo pigments having distyryl oxiadiazole skeleton, azo pigments having distyrylcarbazole skeleton, pherylene pigments, anthraquinone or polycyclic quinone pigments, quinone imine pigments, diphenylmethane or triphenylmethane pigments, benzoquinone or haphtoquinone pigments, cyanine or azomethine pigments, indigoido pigments, bisbenzimidazole pigments, and the like. These charge generating materials may be used alone or in combination of two or more.

Oxytitanium phthalocyanine shown in the Structural Formula (1) is one of preferred substances.

Structural Formula (1)

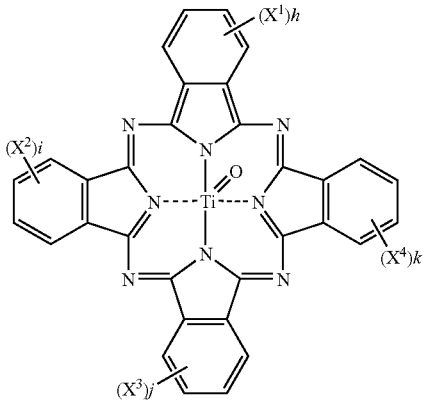

Where $X^1$, $X^2$, $X^3$ and $X^4$ stand for C1 or Br and h, i, j, and k stand for integer from 0 to 4.

Crystal forms of oxytitanium phthalocyanine are not limited and may be selected accordingly. It is preferably oxytitanium phthalocyanine of which the strongest peak at the black angle (2θ±0.2°) of characteristic X-ray diffraction of CuK α is 9.0°, 14.2°, 23.9° and 27.1° or oxytitanium phthalocyanine of which the strongest peak at the black angle (2θ±0.2°) of characteristic X-ray diffraction of CuK α is 9.6° and 27.3° from the viewpoint of sensitivity behavior.

Examples of binder resin include polyamides, polyurethanes, epoxy resins, polyketones, polycarbonates, silicone resins, acrylic resins, polyvinyl butyrals, polyvinyl formals, polyvinyl ketones, polystyrenes, poly-N-vinyl carbazoles, and polyacrylamides. These binder resins may be used alone or in combination.

Specific examples of charge transport polymer are described in JP-A Nos. 01-001728, 01-009964, 01-013061, 01-019049, 01-241559, 04-011627, 04-175337, 04-183719, 04-225014, 04-230767, 04-320420, 05-232727, 05-310904, 06-234836, 06-234837, 06-234838, 06-234839, 06-234840, 06-234841, 06-239049, 06-236050, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085, 09-328539, and the like.

In addition to the binder resin described above, charge transport polymers having charge transport function, for example, polycarbonates, polyesters, polyurethanes, polyethers, polysiloxanes, and acrylic resins having arylamine skeleton, benzidine skeleton, hydrazone skeleton, carbazole skeleton, stylbene skeleton, pyrazoline skeleton, and the like, or polymers having polysilane skeleton.

Specific examples are polysilylene polymers described in JP-A Nos. 63-285552, 05-19497, 05-70595 and 10-73944, etc.

Furthermore, low-molecular charge transport substances may be incorporated into charge generating layers. The charge transport substances may be classified into hole transport substances and electron transport substances.

Electron-accepting substances are suitable for electron transport substance and examples thereof include chloroanil, bromoanil, tetracyanoethylene, tetracyano quinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indino[1,2-b]thiophene-4-on, 1,3,7-trinitrodibenzothiophene-5,5-dioxide, and diphenoquinone derivatives. These electron transport substances may be used alone or in combination.

Examples of hole transporting substance include oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and the like. These hole transporting substances may be used alone or in combination.

The method for forming charge generating layer is not limited and may be selected accordingly and vacuum thin-film forming method or casting method with solution dispersal are preferable.

The vacuum thin-film forming method include the vacuum deposition, glow discharge electrolysis, ion plating, sputtering, reactive-sputtering, and CVD processes, which may form inorganic materials or organic materials satisfactory.

The casting method forms a charge generating layer by an inorganic or organic charge-generating material being dispersed, together with binder resin as required, by ball mill, attritor, sand mill, or bead mill using a solvent such as tetrahydrofuran, dioxane, dioxolane, toluene, dichloromethane, monochlorobenzene, dichloroethane, cyclohexanone, cyclopentanone, anisole, xylene, methyl ethyl ketone, acetone, ethyl acetate, or butyl acetate. The dispersion liquid is then properly diluted and coated. A leveling agent such as dimethyl silicone oil, methylphenyl silicone oil, and the like may be added to the dispersion liquid as required. The dispersion liquid may be applied by way of dip coating, spray coating, bead coating, ring coating, and the like.

Preferably, the thickness of charge generating layer is 0.01 μm to 5 μm, more preferably 0.05 μm to 2 μm.

Charge Transporting Layer

The charge transporting layer has a charge transport function, charge transport substances, binder resin and other elements as necessary.

When the charge transporting layer has a laminated structure having a crosslinked surface layer formed on the charge transporting layer, the charge transporting layer may be formed by way of dissolving or dispersing a charge transport substance and a binder resin in a proper solvent and applying the resulting liquid onto the charge generating layer, followed by drying. The coating liquid containing 0.2% by mass to 10% by mass of at least two different antioxidants relative to the total mass of radical polymerizable composition and crosslinked surface layer is applied and cross-linked by external energy of heat or light to form a crosslinked surface layer.

The thickness of charge transporting layer is preferably 5 μm to 40 μm and more preferably 10 μm to 30 μm.

The thickness of crosslinked surface layer is preferably 1 μm to 20 μm, more preferably 2 μm to 10 μm. When the thickness is less than 1 μm, durability may vary due to uneven thickness and when the thickness is more than 20 μm, the charge transporting layer become thick and cause image reproducibility degradation due to charge diffusion.

As for the charge transport substances, the electron transport substances, hole transport substances, and charge transport polymers described above may be employed. Particularly, charge transport polymers are favorable because solubility of the undercoat layer may be suppressed upon coating of crosslinked surface layer.

Examples of binder resin include polystyrene, styrene-acrylonitrile copolymers, styrene-butadiene copolymers, styrene-maleicanhydride copolymers, polyester, polyvinyl chloride, vinylchloride-vinylacetate copolymers, polyvinyl acetate, polyvinylidene chloride, polyacrylate resins, phenoxy resins, polycarbonates, celluloseacetate resins, ethylcellulose resins, polyvinyl butyral, polyvinyl formal, polyvinyl toluene, poly-N-vinylcarbazole, acrylate resins, silicone resins, epoxy resins, melamine resins, urethane resins, phenol resins, alkyd resins, and the like. These can be used alone or in combination.

The amount of charge transport substance is preferably 20 parts by mass to 300 parts by mass, more preferably 40 parts by mass to 150 parts by mass based on 100 parts by mass of the binder resin. When the charge transport substance is a polymer, the charge transport substance may be employed without binder resin.

The solvent utilized in the coating of charge transporting layer may be the same as those utilized in the charge generating layer described above. Preferably, the solvent can dissolve both of charge transport substance and binder resin. The solvent can be used alone or in combination. The same method as used for the charge generating layer may be applied for charge transporting layer formation.

The charge transporting layer may include additives such as plasticizers and leveling agents depending on the requirements.

Specific examples of plasticizers include known ones that are being used for plasticizing resins such as dibutyl phthalate, dioctyl phthalate, and the like. The additive amount of plasticizer is 0 parts by mass to 30 parts by mass based on 100 parts by mass of binder resin.

Specific examples of leveling agents include silicone oils such as dimethyl silicone oil, and methyl phenyl silicone oil; polymers or oligomers including a perfluoroalkyl group in their side chain, and the like. The additive amount of leveling agents is 0 parts by mass to 1 part by mass based on 100 parts by mass of binder resin.

<Single-Layered Photosensitive Layer>

A photosensitive layer having a single-layered structure refers to a layer having both charge generating function and charge transport function. The crosslinked surface layer having a charge transport structure of the invention is favorably employed to be disposed on the single-layered photosensitive layer.

When the crosslinked surface layer is formed on the surface of single-layered photosensitive layer, the photosensitive layer is formed by dissolving or dispersing a charge generating substance, a charge transport substance, and a binder resin in a proper solvent and coating, followed by drying. Also, a plasticizer, a leveling agent, or the like may be added as needed. The dispersion method for charge generating substances, charge transport substances, plasticizers, and leveling agents may be the same as used for the charge generating layers and charge transporting layers. As for the binder resin, in addition to the binder resins described for the charge transporting layer, the binder resins described for the charge generating layers may be employed in combination. Also, the charge transport polymer may be used, which is favorable in reducing the inclusion of photosensitive composition of lower layer into the crosslinked surface layer. The thickness of photosensitive layer is preferably 5 μm to 30 μm, more preferably 10 μm to 25 μm.

When the crosslinked surface layer is formed on the surface of single-layered photosensitive layer, a coating liquid containing radical polymerizable composition and charge generating substance is applied on the upper layer of photosensitive layer, followed by drying as needed, and curing by the use of external energy: thermal or optical energy, as described above. Preferably, the crosslinked surface layer has a thickness of 1 μm to 20 μm, more preferably 2 μm to 10 μm. When the thickness is less than 1 μm, the durability may fluctuate owing to uneven thickness.

The charge generating substance contained in the single-layered photosensitive layers is preferably 1% by mass to 30% by mass. The binder resin contained in the lower-layer part of photosensitive layer is preferably 20% by mass to 80% by mass based on the total amount of photosensitive layer and the charge transport substance is preferably 10 parts by mass to 70 parts by mass based on 100 parts by mass of binding resin.

<Undercoat Layer>

In the photoconductor of the invention, an undercoat layer may be formed between the support and the photosensitive layer.

The undercoat layer is typically formed of resin. The resin is preferably solvent-resistant against common organic solvents since photosensitive layers are usually coated with organic solvent on the undercoat layers. Examples of resin include water-soluble resins such as polyvinyl alcohol, casein and sodium polyacrylate, alcohol-soluble resins such as copolymer nylon and methoxymethylated nylon, and curing resins which form three-dimensional networks such as polyurethane, melamine resins, phenol resins, alkyd-melamine resins, and epoxy resins.

Also, metal oxide fine powder pigments such as titanium oxide, silica, alumina, zirconium oxide, tin oxide or indium oxide may be added to the undercoat layer for preventing Moire patterns and reducing residual potential.

Also, $Al_2O_3$ prepared by anodic oxidation, organic materials such as polyparaxylylene (parylene) and inorganic materials such as $SiO_2$, $SnO_2$, $TiO_2$, ITO, $CeO_2$ prepared by vacuum thin-film forming process, can be used for the undercoat layer.

These undercoat layers may be formed by using suitable solvents and coating methods as described for photosensitive layers. Silane coupling agents, titanium coupling agents or chromium coupling agents, etc. can be used as undercoat layer of the invention. The undercoat layer can be of laminated structure containing two or more layers and the thickness of undercoat layer is not limited and may be adjusted accordingly and is preferably 0 μm to 5 μm.

In the photoconductor of the invention, antioxidant may be incorporated into the respective layers of crosslinked surface layer, charge generating layer, charge transporting layer and undercoat layer, etc. in order to improve environmental resistance, particularly to prevent sensitivity decrease and residual potential increase. The content of antioxidant is preferably 0.01% by mass to 10% by mass based on the total mass of the incorporated layer.

Production of Compounds having One Functionality with Charge Transport Structure The compounds having one functionality with charge transport structure of the invention can be produced according to the method disclosed in Japanese Patent No. 3164426 and an example is given below.

(1) Production of hydroxyl group-substituted triaryl amine compounds (Structural Formula (9)).

240 ml of Sulfolane was added to 113.85 g (0.3 mol) of methoxy group-substituted triarylamine compounds (Structural Formula (8)) and 138 g (0.92 mol) of sodium iodide and heated to 60° C. in the nitrogen gas stream. Furthermore, 99 g (0.91 mol) of trimethyl chlorosilane was dripped into the liquid for one hour and agitated for four and a half hours at the temperature around 60° C. and the reaction was ended. Then about 1.5 L of toluene was added to the reaction liquid and cooled to the room temperature and washed repeatedly with water and sodium carbonate solution. And then the solvent was eliminated from the toluene solution and the solution was refined by column chromatography treatment under the following condition: silica gel as absorption medium, toluene: ethyl acetate=20:1 as development solvent. The crystal was deposited by adding cyclohexane into the obtained light yellow oil. 88.1 g and the yield of 80.4% of white crystal in the following Structural Formula (9) was obtained accordingly. The melting points are from 64.0 to 66.0° C.

TABLE 1

| | C | H | N |
|---|---|---|---|
| Observed Value | 85.06% | 6.41% | 3.73% |
| Calculated Value | 85.44% | 6.34% | 3.83% |

Structural Formula (8)

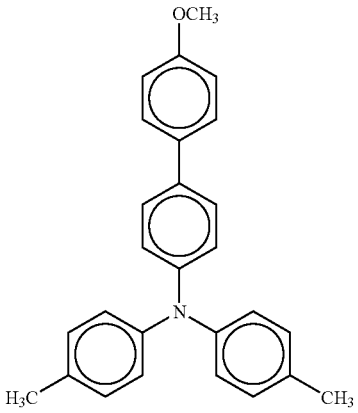

-continued

Structural Formula (9)

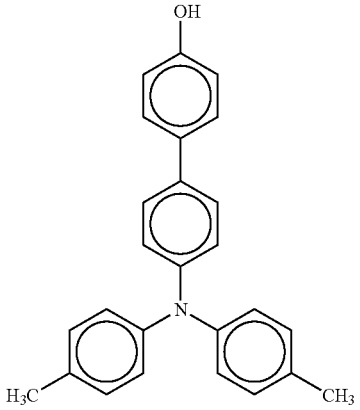

(2) Triarylamine Group-Substituted Acrylate Compounds (Exemplification No. 54)

82.9 g (0.227 mol) of hydroxyl group-substituted triarylamine compounds in the Structural Formula (9) obtained from (1) above was dissolved in 400 ml of tetrahydrofuran and sodium hydroxide with the ratio of NaOH: 12.4 g and water: 100 ml was dripped under the nitrogen gas stream. Then the solution was cooled to 5° C. and 25.2 g (0.272 mol) of acrylic acid chloride was dripped for 40 minutes and agitated for 3 hours at 5° C. and the reaction was ended. Toluene was extracted by pouring the reaction liquid into the water. The extracted liquid was washed repeatedly with sodium hydrogen carbonate and water. Then the solvent was removed from the toluene solution and the solution was refined by column chromatography treatment with silica gel as absorption medium and toluene as development solvent. The crystal was deposited by adding n-hexane to the obtained colorless oil. 80.73 g and the yield of 84.8% of white crystal of the exemplification No. 54 was obtained accordingly. The melting points are from 117.5° C. to 119.0° C.

TABLE 2

| | C | H | N |
|---|---|---|---|
| Observed Value | 83.13% | 6.01% | 3.16% |
| Calculated Value | 83.02% | 6.00% | 3.33% |

Production of Compounds having Two Functionalities with Charge Transport Structure The compound having two functionalities with charge transport structure, dihydroxymethyl triphenylamine can be produced by the following method.

49 g of compound (1) described in the Reaction Formula below and 184 g of phosphorus oxychloride was put in a flask equipped with thermometer, cooling tube, agitator and drip funnel and was heated and dissolved. Then 117 g of dimethylformamide was dripped gently and the reaction liquid was agitated for about 15 hours maintaining temperature at 85° C. to 95° C. And then the reation liquid was poured into the large excess amount of warm water and was cooled gradually while agitated. After filtrating and drying the deposited crystal, the coumpound (2) was obtained by absorbing impurities by silicagel, etc. and refining by recrystallization with acetonitorile. The yield was 30 g.

30 g of obtained compound (2) and 100 ml of ethanol was put into a flask and agitated. 1.9 g of sodium borohydride was added gradually and agitated for about 2 hours maintaining the liquid temperature at 40° C. to 60° C. Then the reaction liquid was poured into about 300 ml of water and agitated to deposit crystal. The compound (3) was obtained after filtrating, sufficient water washing and drying. The yield was 30 g.

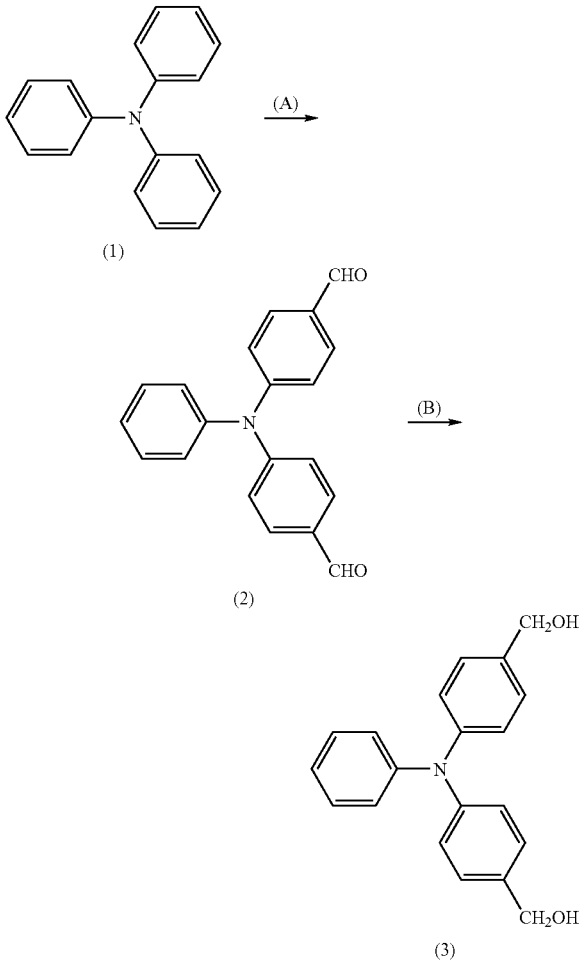

(Image Forming Method and Image Forming Apparatus)

The image forming apparatus of the invention has a photoconductor, latent electrostatic image forming unit, developing unit, transferring unit, fixing unit and other units such as charge-eliminating unit, recycling unit and controlling unit as necessary.

The image forming method of the invention include latent electrostatic image forming, developing, transfer, fixing, cleaning and other steps such as charge-eliminating, recycling and controlling, etc. as necessary.

The image forming method of the invention may be favorably implemented by the image forming apparatus of the invention. The latent electrostatic image forming may be performed by the latent electrostatic image forming unit, the developing may be performed by the developing unit, the transfer may be performed by the transferring unit, and the fixing may be performed by the fixing unit. And other processes may be performed by other units respectively.

Latent Electrostatic Image Forming and Latent Electrostatic Image Forming Unit

The latent electrostatic image forming is one that forms a latent electrostatic image on the photoconductor.

Materials, shapes, structures or sizes, etc. of photoconductor are not limited and may be selected accordingly and it is preferably drum-shaped.

The photoconductor, that is, electrophotographic photoconductor of the invention is suitably used for general electrophotographic machines such as copier, laser printer, LED printer, liquid crystal shutter printer, etc. and can also widely used for machines applying electrophotographic technology such as display, recording, near-print, plate making, facsimile, etc.

The latent electrostatic image may be formed, for example, by uniformly charging the surface of photoconductor, and irradiating it imagewise, and this may be performed by latent electrostatic image forming unit.

The latent electrostatic image forming unit, for example, contain a charger which uniformly charges the surface of photoconductor, and an irradiator which exposes the surface of latent image carrier imagewise.

Charging may be performed, for example, by applying a voltage to the surface of photoconductor using chargers.

The charger may be properly selected accordingly, for example, contact chargers equipped with conductive or semi-conductive roller, brush, film or rubber blade and non-contact chargers using corona discharges such as corotron or scorotron, etc.

Exposures may be performed by irradiating the surface of photoconductor imagewise, using irradiators, for example.

The irradiator is not specified as long as it is capable of exposing the surface of photoconductor that has been charged by a charger to form an image as it is expected, and may be properly selected accordingly, for example, irradiators such as copy optical system, rod lens array system, laser optical system, and liquid crystal shutter optical system, etc.

A backlight system may be employed in the invention by which the photoconductor is exposed imagewise from the rear surface.

When image forming apparatus is used as a copier or a printer, image exposure is done by irradiating specular light or transmitted light to the photoconductor from documents or by irradiating lights to the photoconductor by lazer beam scan, LED alley drive or liquid crystal shutter alley drive according to the signals converted by reading documents with sensors.

Developing and Developing Unit

Developing is a process by which a latent electrostatic image is developed toner and/or developer of the invention to form a visible image.

The visible image may be formed, for example, by developing a latent electrostatic image with toner and/or developer, which may be performed by a developing unit.

The developing unit is not specified as long as it is capable of developing an image by using toner and/or developer, for example, and may be selected accordingly. Examples are those containing toner and/or developer that can supply toner and/or developer to the latent electrostatic images by contact or with no contact.

Generally, dry developing methods are used for developers. They can be a developer of either plain color or multicolor and preferred examples include one having mixer whereby toner and/or developer is charged by friction-stirring and rotatable magnet rollers.

In the image-developer, the toner and the carrier may, for example, be mixed and stirred together. The toner is thereby charged by friction, and forms a magnetic brush on the surface of the rotating magnet roller. Since the magnet roller is arranged near the photoconductor, a part of the toner in the magnetic brush formed on the surface of the magnet roller moves toward the surface of the photoconductor due to the force of electrical attraction. As a result, the latent electrostatic image is developed by the use of toner, and a visible toner image is formed on the surface of the photoconductor.

Developers fed inside the processor is the developer containing toner, and they can be one element or two element developers.

Transferring and Transferring Unit

Transferring is a process that transfers the visible image onto a recording medium. In a preferable aspect, the first transferring is performed, using an intermediate image-transferring member by which the visible image is transferred to the intermediate image-transferring member, and the second transferring is performed wherein the visible image is transferred to the recording medium. In a more preferable aspect, using toner of two or more colors and preferably full color toner, the first transferring unit transfers the visible image to the intermediate image-transferring member to form a compounded transfer image, and the second transferring unit transfers the compounded transfer image onto the recording medium.

Transferring may be carried out, for example, by charging the photoconductor using a transferring charger, which can be performed by the transferring unit. In a preferable aspect, the transferring unit contains the first transferring unit which transfers the visible image onto the intermediate image-transferring member to form a compounded transfer image, and a second transferring unit which transfers the compounded transfer image onto the recording medium.

The intermediate image-transferring member may be properly selected from transferring materials or units known in the art such as transferring belts.

The transferring units of the first and the second transferring preferably contain an image-transferring unit which releases by charging the visible image formed on the photoconductor to the recording-medium side. There may be one, two or more of the transferring unit.

The image-transferring unit may be a corona transferring unit based on corona discharge, transfer belt, transfer roller, pressure transfer roller, or adhesion transferring unit.

The recording medium may be properly selected from recording media or recording paper known in the art. The recording medium is typically plain paper, and other materials such as polyethylene terephthalate (PET) sheets for overhead projector (OHP) may be utilized.

Fixing and Fixing Unit

Fixing is a process that fixes the visible image transferred to the recording medium using a fixing unit. The fixing may be carried out using developer of each color transferred to the recording medium, or in one operation when the developers of each color have been laminated.

The fixing unit may be properly selected from heat and pressure units known in the art. Examples of heat and pressure unit include a combination of heat roller and pressure roller, and a combination of heat roller, pressure roller, and endless belt.

The heating temperature in the heat-pressure unit is preferably 80° C. to 200° C. Further, an optical fixing unit known in the art may be used in addition to or in place of fixing and fixing unit, depending on the application.

Cleaning and Cleaning Unit

Cleaning is a process that cleans the surface of photoconductor, and may be performed by a cleaning unit.

Examples of cleaning unit include cleaning blade, magnetic brush cleaner, electrostatic brush cleaner, magnetic roller cleaner, blade cleaner, brush cleaner, and web cleaner, etc.

Examples of materials for rubber blades used in the blade cleaning unit include urethane rubber, silicone rubber, fluororubber, chloroplane rubber, butadiene rubber, etc. and urethane rubber is especially preferred among them.

Blade inversion can be prevented by controlling hardness of rubber blades and restitution elastic modulus simultaneously. The preferable JIS-A hardness of rubber blades at 25±5° C. is 65 to 80. When JIS-A hardness is less than 65, blade inversion is likely to occur, and when JIS-A hardness is more than 80, cleaning performance may be deteriorated. The restitution elastic modulus of rubber blades are preferably 20% to 75%. When the restitution elastic modulus is more than 75%, blade inversion is likely to occur, and if it is less than 20%, cleaning performance may be deteriorated.

JIS-A hardness and restitution elastic modulus can be measured based on the vulcanized rubber physical testing of JIS K6301.

Charge-eliminating is a process that applies a discharge bias to the photoconductor to discharge it, and may be performed by a charge-eliminating unit.

The charge eliminating unit may be properly selected from charge-eliminating units known, as long as capable of applying a discharge bias to the photoconductor such as discharge lamps.

Recycling is a process that recycles the electrophotographic toner removed in the cleaning to the developing, and may be performed by the use of recycling unit.

The recycling unit may be properly selected from transport units known in the art.

Controlling is a process that controls the respective steps, and may be carried out by the use of controlling unit.

The controlling unit may be properly selected depending on the application, as long as capable of controlling the entire units; the controlling unit may be equipped with instruments such as sequencers or computers, etc.

Figure 3:
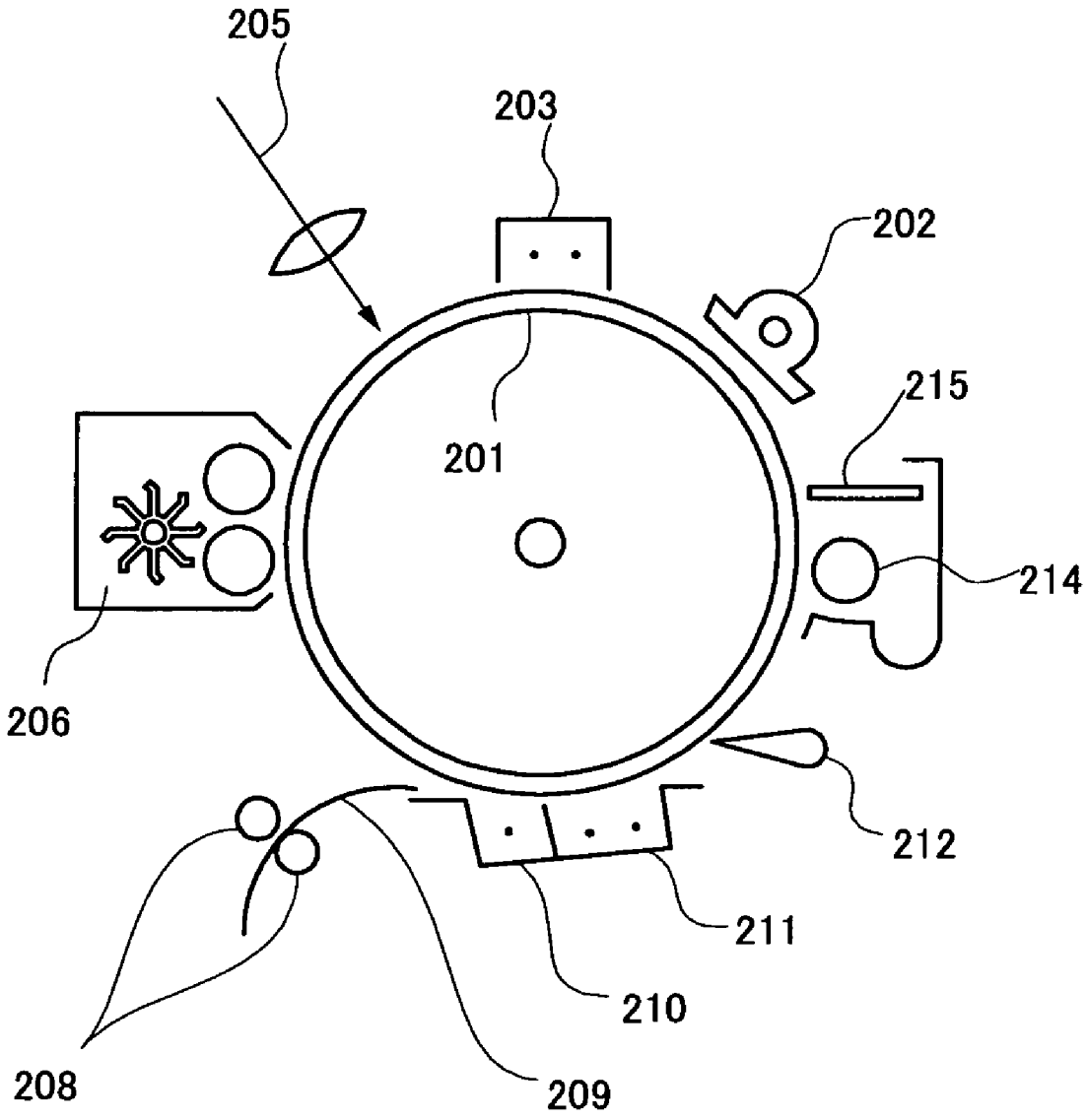
FIG. 3 schematically shows an exemplary image forming apparatus.

An aspect of the image forming apparatus of the invention is demonstrated referring to FIG. 3.

FIG. 3 is a schematic view describing the image forming apparatus of the invention and transformed examples described later belong in the same equation as the invention.

The photoconductor 201, as a latent electrostatic image bearing member, has a support and at least a photosensitive layer and a crosslinked surface layer on the support. For example, it may contain charge generating layer, charge transporting layer and crosslinked surface layer in described order on the support. The photoconductor 201 is in a drum form; however, sheet form and endless belt form are also acceptable.

The chargers of wiring system or roller form may be used as the charger 203. Examples of charger include corotron unit, scorotron unit, solid discharging unit, pin electrode unit, roller charging unit, conductive brush unit, and the like. The photoconductor is charged by using these chargers and dot reproducibility is better when electrical intensity charged on the photoconductors is higher.

The image exposure unit 205 can be provided with high brightness with light-emitting diode (LED), laser diode (LD), Electroluminescence (EL), etc. and the light source which can write in with a high resolution, that is, 600 dpi or more. To expose only the light from desired spectral region, various filters such as a sharply cut filter, bandpass filter, near-infrared cut filter, dichroic filter, interference filter, and conversion filter for color temperature, and the like may be employed.

Known transferring unit can be employed for transferring unit, however, parallel usage of transferring charger 210 and releasing charger 211 is efficient as described in FIG. 3. It is possible to use transfer belt or transfer roller and using less-ozone-producing, contact-types of transfer belt or transfer roller, etc. are preferable. The voltage/current application methods in the transfer can be either constant voltage method or constant current method. It is preferably constant current method because it is possible to retain the constant transfer amount of electric charge and therefore stability is efficient.

Developing member 206 contains one development sleeve and the toner developed on the photoconductor 201 is transferred onto the transfer paper 209.

The toner image formed on the photoconductor becomes an image on the transfer paper by transferring, and there are two ways of doing it. In one way, the toner image that is developed on the surface of photoconductor as shown in FIG. 3 is transferred onto the transfer paper directly. In the other way, toner image is transferred onto the intermediate transfer medium from the photoconductor and then transferred onto the transfer paper. Either way can be employed for the invention.

These transfer members can be any that can satisfy the system of the invention structurally. Transfer charger, electrostatic transfer method using bias roller, adhesive transfer method, mechanical transfer method such as pressure transfer method, etc. and magnetic transfer method can be applied. A charging unit can be employed for the electrostatic transfer method.

When an image is exposed by positively (negatively) charged photoconductor, positively (negatively) charged latent electrostatic image is formed on the surface of photoconductor. Positive image can be obtained by developing with negatively (positively) charged toner (detecting molecule), and negative image can be obtained by developing with positively (negatively) charged toner.

For the light sources of discharging lamp 2, etc., general light-emitting materials such as fluorescent lamps, tungsten lamps, halogen lamps, mercury lamps, sodium lamps, light-emitting diode (LED), laser diode (LD), and electro luminescence (EL) may be employed. To irradiate light only from desired wavelength region, various filters such as sharp-cut filter, bandpass filter, near-infrared cut filter, dichroic filter, interference filter, color conversion filter, etc. may be employed.

The photoconductor is irradiated with those light sources by setting steps that uses light irradiation such as transfer, discharging step, cleaning or prior exposure, etc. simultaneously with the steps shown in FIG. 3.

The discharge mechanism may be omitted from the charge method when it is overlapped with AC components or when residual potential of the photoconductor is relatively small, etc. Alternatively, the electrostatic discharge system, for example, discharge brushes impressed with reverse bias or earth grounded may be used other than optical discharges. In the FIG. 3, 208 is a resist roller and 212 is a separation claw.

The toner on photoconductor 201 developed by the developing unit 206 is transferred onto the transfer paper 209, however, when residual toner is appeared on the photoconductor 201, it is eliminated from photoconductor by fur brush 214 and blade 215. The cleaning may be done only by brushes and known cleaning brushes such as fur brushes and magfur brushes, etc. are used.

Figure 4:
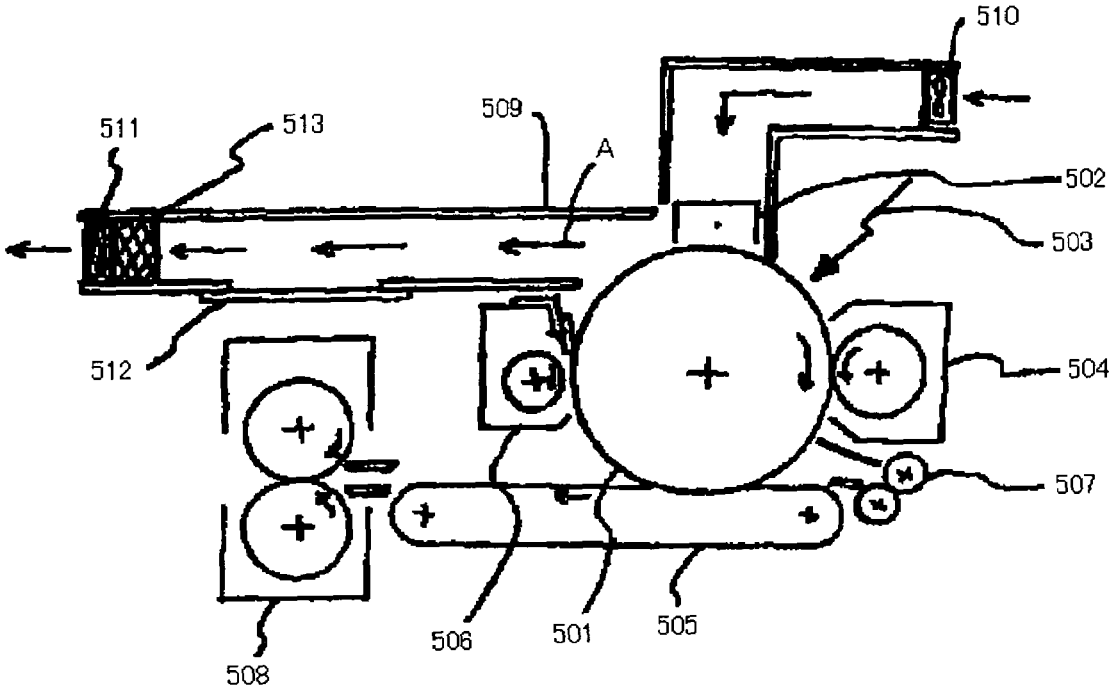
FIG. 4 schematically shows another exemplary image forming apparatus.
Figure 5:
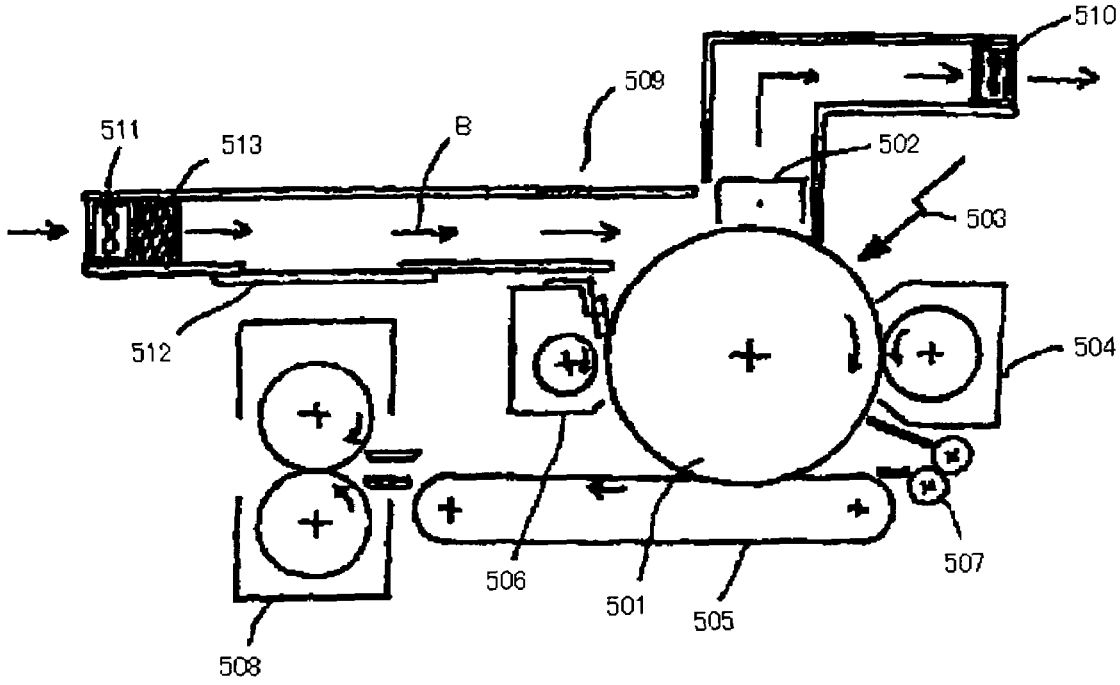
FIG. 5 schematically shows another exemplary image forming apparatus.

The other aspect of image forming apparatus of the invention is explained referring to FIG. 4 and FIG. 5.

In the image forming apparatus shown in FIG. 4 and FIG. 5, charger 502, exposing unit 503, developing unit 504, transfer belt 505 as a transferring unit and cleaning unit 506 are set up in the surrounding area of photoconductor 501 as a latent electrostatic image unit. The resist roller 507 is placed on the upstream side of transfer belt 505 and the fixing unit 508 is placed on the downstream side.

The image forming apparatus contains exhaust path 509 made of duct on the upper part of charger 502 and fixing unit 508, charger fan 510 on the opening mouth of exhaust path 509 and fixing unit fan 511 on the opening mouth of exhaust path 509. The thermoelectric conductance member 512 made of aluminum board that can heat up the inside of exhaust path 509 is also placed near the exhaust path 509 of fixing unit 508. The ozone filter 513 is placed near the inside of fixing unit fan 511. Further, other members having high thermoelectric conductivity can be substituted for aluminum board for the heat conductance member 513 and if pipes are arranged as to prevent adverse effect from heat, all the exhaust path 509 can be constructed with heat conductance member.

In the image forming apparatus, having these structures as shown in FIG. 4, the generated ozone is removed from charger 502 by generating air stream from the charger 502 side down the fixing unit 508 side at the time of image formation.

Specifically, by activating charger fan 510 or by rotating charger fan 510 and fixing unit fan 511 in the process direction, air drawn from the outside of image forming apparatus by charger fan 510 is forced to flow in the direction A as shown in FIG. 4

On the other hand, photoconductor 501 is dehumidified by generating air stream from the fixing unit 508 side to the static builder 502 side within predetermined time of non image-formation. Examples of predetermined time are warming up time after activating image forming apparatus or a set time for dehumidification, etc.

Specifically, by activating fixing unit fan 511 or by rotating fixing unit fan 511 and charger fan 510 in the opposite direction of the process, air drawn from the outside of image forming apparatus by the charger fan 511 is forced to flow in the direction B via ozone filter 513 as shown in FIG. 5.

At the time of air stream generation, heat conductance member 512 is heated up at a high temperature by the fixing unit 508 and the temperature of air rises when it passes through this part. Because air touches the photoconductor 501 before reaching charger 502 while air stream is generated from the fixing unit side down to the charger side, dehumidification of photoconductor 501 is possible. It is preferable to rotate the photoconductor 501 so as to increase the dehumidification efficiency.

Figure 6:
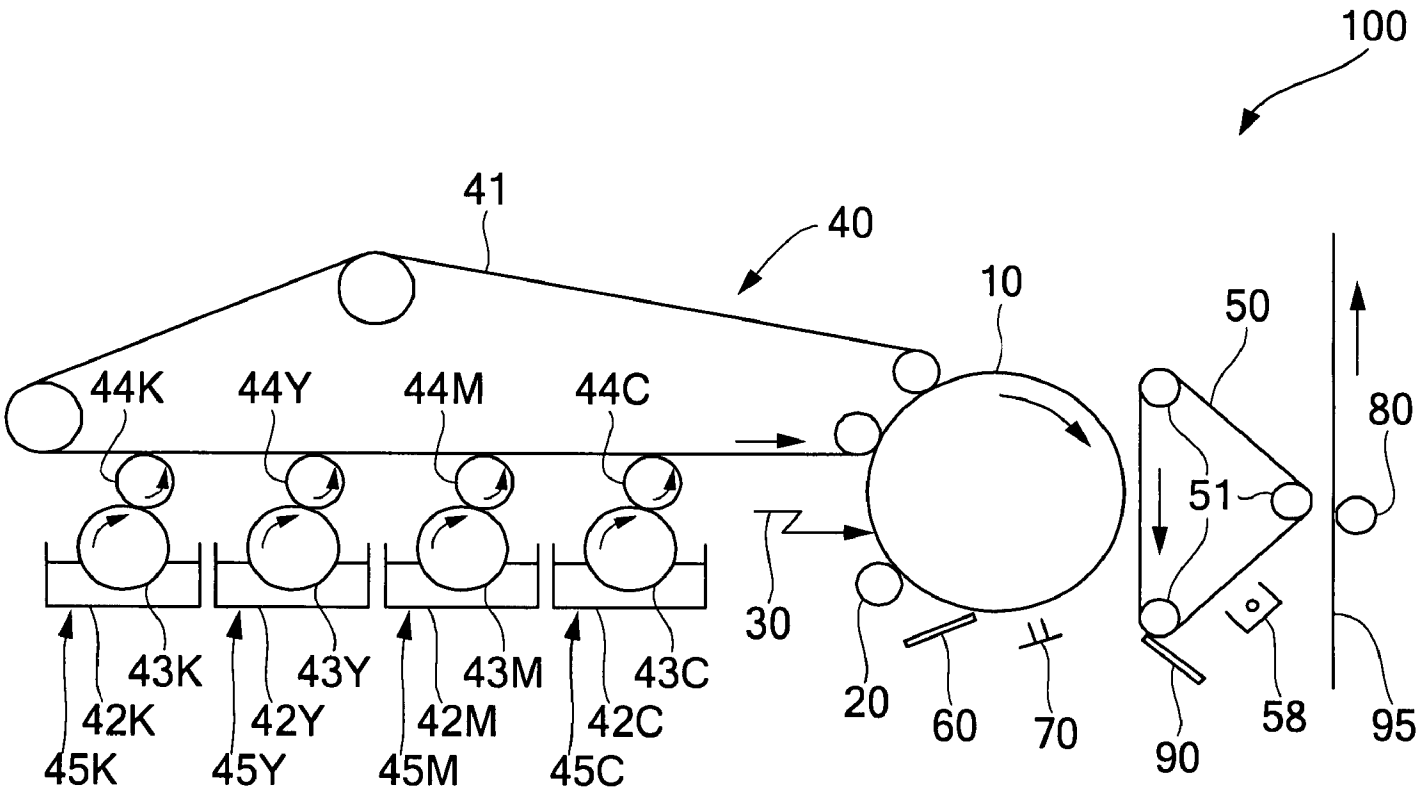
FIG. 6 schematically shows an exemplary image forming process performed by image forming apparatus of the invention.

An aspect of the operation of the image forming process performed by the image forming apparatus of the invention is described referring to FIG. 6. The image forming apparatus 100 shown in FIG. 6 is equipped with the photoconductor drum 10 (hereafter may be referred to as "photoconductor 10") as a latent electrostatic image bearing member, the charge roller 20 as a charging unit, the exposure apparatus 30 as an exposure unit, the developing apparatus 40 as a developing unit, the intermediate transfer member 50, the cleaning apparatus 60 having a cleaning blade as a cleaning unit and the discharge lamp 70 as a discharging unit.

The intermediate transfer member 50 is an endless belt that is being extended by the three roller 51 placed inside the belt and designed to be moveable in arrow direction. A part of three roller 51 function as a transfer bias roller that can imprint a specified transfer bias, the primary transfer bias, to the intermediate transfer member 50. The cleaning apparatus 90 with a cleaning blade is placed near the intermediate transfer member 50, and the transfer roller 80, as a transferring unit which can imprint the transfer bias for transferring the developed image, toner image (second transfer), onto the transfer paper 95 as the final transfer material, is placed face to face with the cleaning apparatus 90. In the surrounding area of the intermediate transfer member 50, the corona charger 58, for charging toner image on the intermediate transfer member 50, is placed between contact area of the photoconductor 10 and the intermediate transfer member 50 and contact area of the intermediate transfer member 50 and the transfer paper 95 in the rotating direction of the intermediate transfer member 50.

The developing unit 40 is constructed with the developing belt 41 as a developer bearing member, black developing unit 45K, yellow developing unit 45Y, magenta developing unit 45M and cyan developing unit 45C that are juxtapositioned in the surrounding area of the developing belt 41. The black developing unit 45K is equipped with developer container 42K, developer feeding roller 43K and developing roller 44K whereas the yellow developing unit 45Y is equipped with developer container 42Y, developer feeding roller 43Y and developing roller 44Y. The magenta developing unit 45M is equipped with developer container 42M, developer feeding roller 43M and developing roller 44M whereas the cyan developing unit 45C is equipped with developer container 42C developer feeding roller 43C and developing roller 44C. The developing belt 41 is an endless belt and is extended between a number of belt rollers as rotatable and the part of developing belt 41 is in contact with the photoconductor 10.

For example, the charge roller 20 charges the photoconductor drum 10 evenly in the image forming apparatus 100 as shown in FIG. 6. The exposure unit 30 exposes imagewise on the photoconductor drum 10 and forms a latent electrostatic image. The latent electrostatic image formed on the photoconductor drum 10 is then developed with the toner fed from the developing unit 40 to form a visible image, a toner image. The visible image (toner image) is then transferred onto the intermediate transfer member 50 by the voltage applied from the roller 51 as the primary transfer and it is further transferred onto the transfer paper 95 as the secondary transfer. As a result, a transfer image is formed on the transfer paper 95. The residual toner on the photoconductor 10 is removed by the cleaning apparatus 60 and the charge built up over the photoconductor 10 is temporarily removed by the discharge lamp 70.

Figure 7:
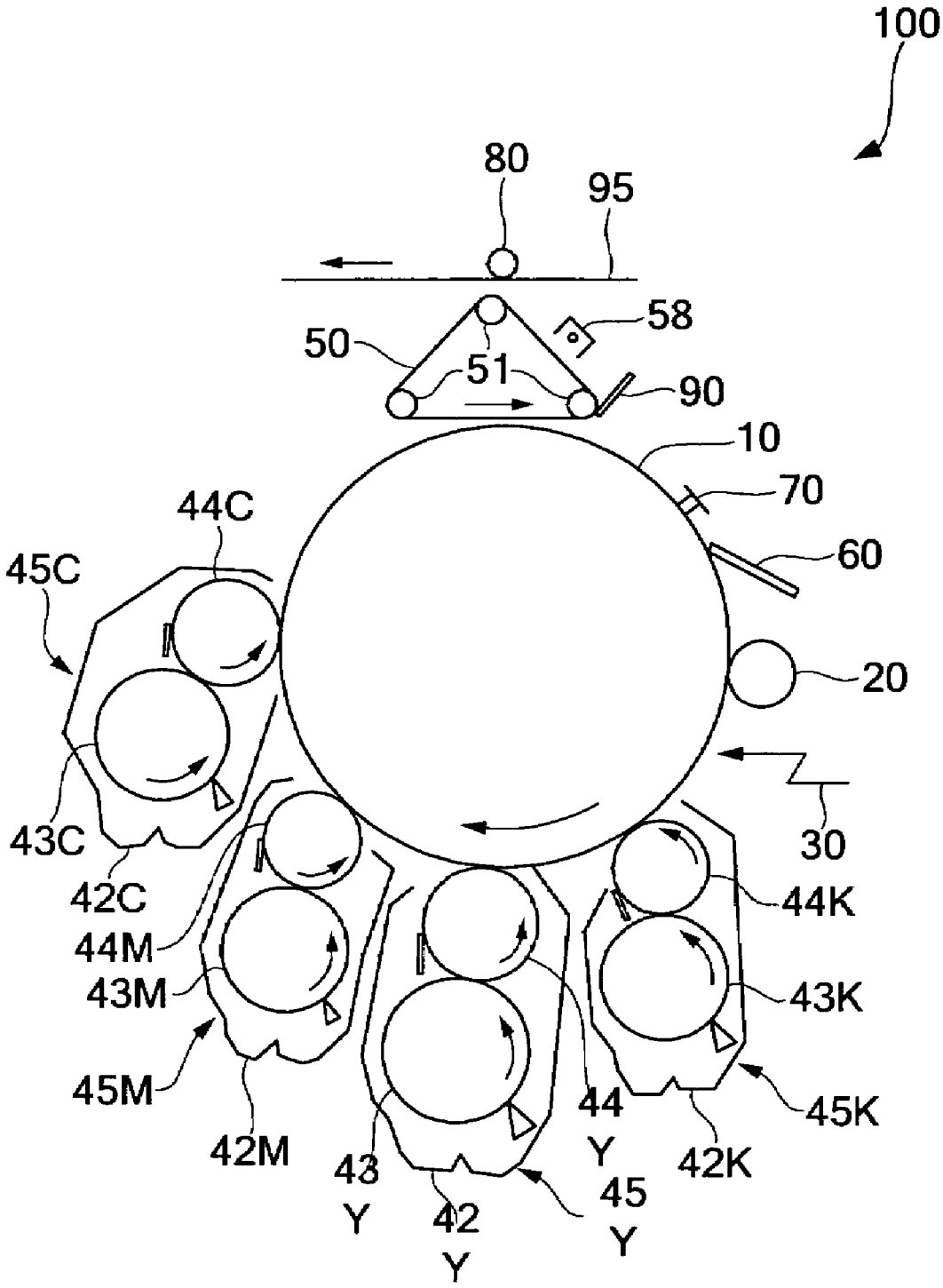
FIG. 7 schematically shows another exemplary image forming process performed by image forming apparatus of the invention.

The other aspect of the operation of image forming processes of the invention by image forming apparatuses of the invention is described referring to FIG. 7. The image forming apparatus 100 as shown in FIG. 7 has the same lineups and effects as the image forming apparatus 100 shown in FIG. 6 except for the developing belt 41 is not equipped and the black developing unit 45K, the yellow developing unit 45Y, the magenta developing unit 45M and the cyan developing unit 45C are placed in the surrounding area directly facing the photoconductor 10. The symbols used in FIG. 7 correspond to the symbols used in FIG. 6.

Figure 8:
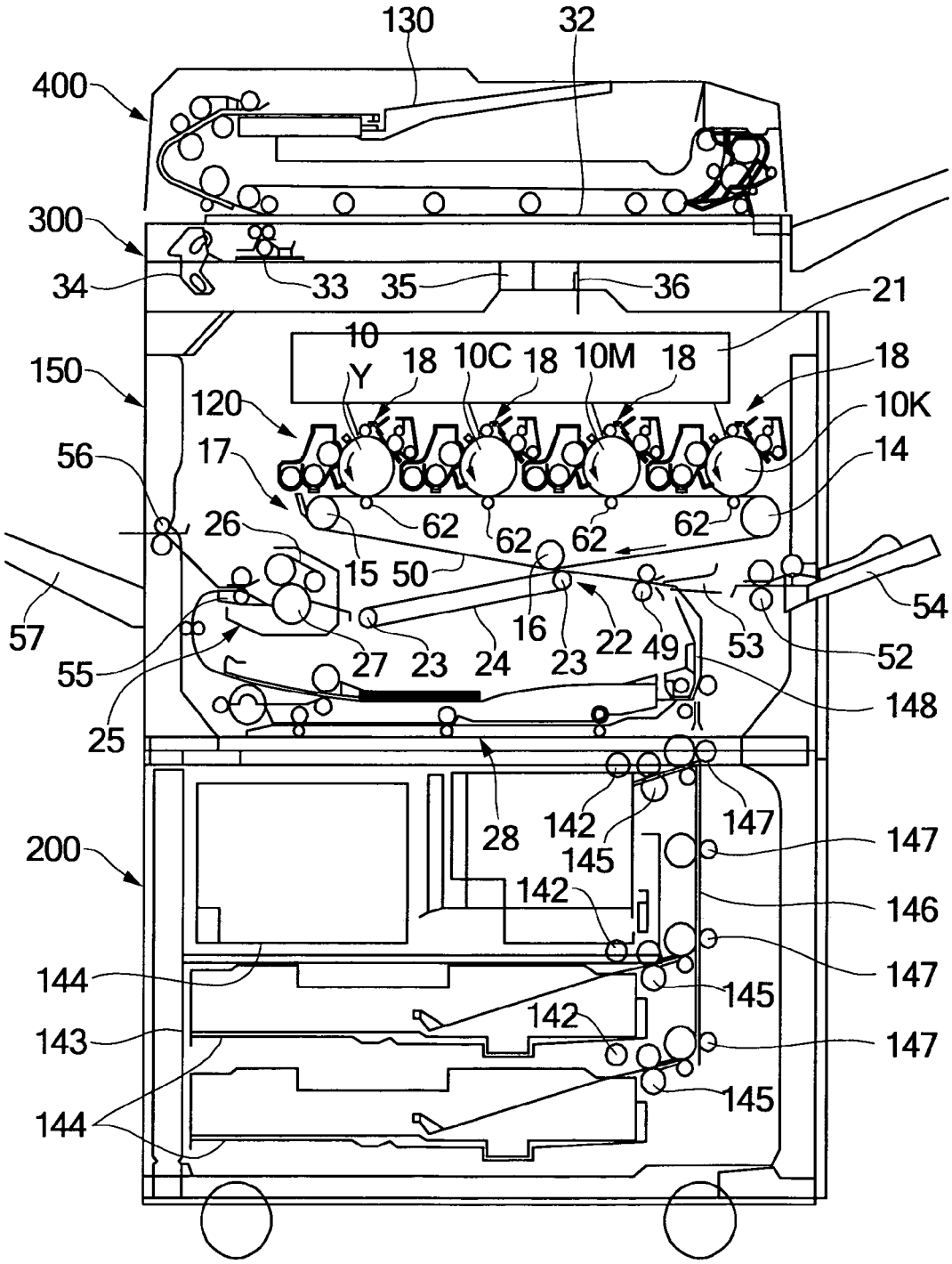
FIG. 8 schematically shows an exemplary image forming process performed by image forming apparatus of the invention, tandem color image forming apparatus.

The other aspect of operation of the image forming processes of the invention by the image forming apparatuses of the invention is described referring to FIG. 8. The tandem image forming apparatus as shown in FIG. 8 is a tandem color image forming apparatus. The tandem image forming apparatus 120 is equipped with the copier main body 150, the feeding paper table 200, the scanner 300 and the automatic document feeder (ADF) 400.

The intermediate transfer member 50 in a form of an endless belt is placed in the center part of the copier main body 150. The intermediate transfer member 50 is extended between the support roller 14, 15 and 16 as rotatable in the clockwise direction as shown in FIG. 8. The intermediate transfer member cleaning unit 17 is placed near the support roller 15 in order to remove the residual toner on the intermediate transfer member 50. The tandem developing unit 120, in which four image forming unit 18, yellow, cyan, magenta and black, are positioned in line along the transport direction in the intermediate transfer member 50, which is being extended between the support roller 14 and 15. The exposure unit 21 is placed near the tandem developing unit 120. The secondary transferring unit 22 is placed on the opposite side where tandem developing unit 120 is placed in the intermediate transfer member 50. The secondary transfer belt 24, an endless belt, is extended between a pair of the roller 23 and the transfer paper transported on the secondary transfer belt 24 and the intermediate transfer member 50 are accessible to each other in the secondary transferring unit 22. The fixing unit 25 is placed near the secondary transferring unit 22. The fixing apparatus 25 is equipped with the fixing belt 26, an endless belt, and the pressure roller 27 placed under the belt pressure.

The sheet inversion unit 28 is placed near the secondary transferring unit 22 and the fixing unit 25 in the tandem image forming apparatus, in order to invert the transfer paper to form images on both sides of the transfer paper.

The full-color image formation, color copy, using the tandem developing unit 120 is explained. At the start, a document is set on the document table 130 of the automatic document feeder (ADF) 400 or the automatic document feeder 400 is opened and a document is set on the contact glass 32 of the scanner 300 and the automatic document feeder 400 is closed.

By pushing the start switch (not shown in figures), the scanner 300 is activated after the document was transported and moved onto the contact glass 32 when the document was set on the automatic document feeder 400, or the scanner 300 is activated right after, when the document was set onto the contact glass 32, and the first carrier 33 and the second carrier 34 will start running. The light from the light source is irradiated from the first carrier 33 simultaneously with the light reflected from the document surface is reflected by the mirror of second carrier 34. Then the scanning sensor 36 receives the light via the imaging lens 35 and the color copy (color image) is scanned to provide image information of black, yellow, magenta and cyan.

Figure 9:
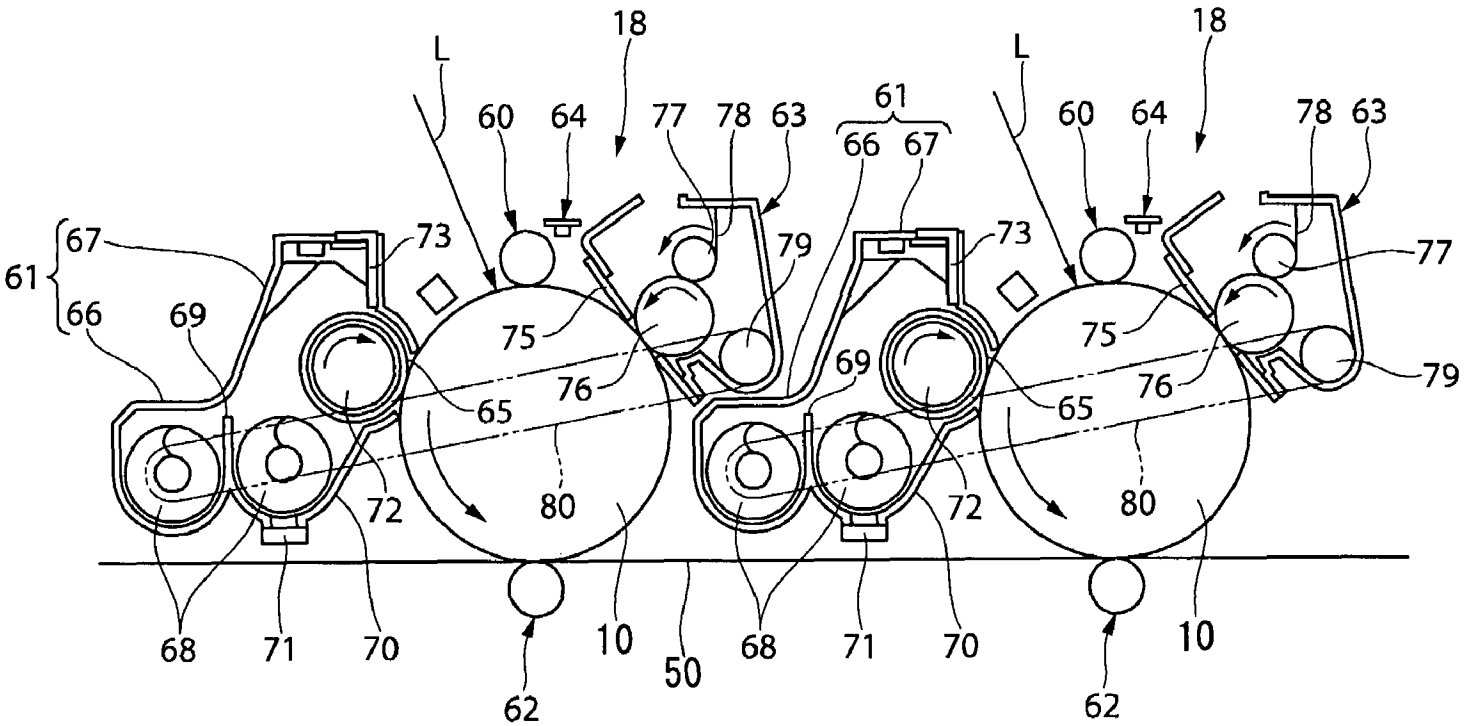
FIG. 9 schematically shows a partially enlarged image forming apparatus of FIG. 8.

Each image information for black, yellow, magenta and cyan is transmitted to each image forming unit 18: black image forming unit, yellow image forming unit, magenta image forming unit and cyan image forming unit, of the tandem image forming apparatus and each toner image of black, yellow, magenta and cyan is formed in each image forming unit. The image forming unit 18: black image forming unit, yellow image forming unit, magenta image forming unit and cyan image forming unit of the tandem image forming apparatus as shown in FIG. 9 is equipped with the photoconductor 10: photoconductor 10K for black, photoconductor 10Y for yellow, photoconductor 10M for magenta and photoconductor 10 C for cyan, the charger 60 that charges photoconductor evenly, an exposing unit by which the photoconductor is exposed imagewise corresponding to each color images based on each color image information as indicated by L in FIG. 9 to form an latent electrostatic image corresponding to each color image on the photoconductor, the developing unit 61 by which the latent electrostatic image is developed using each color toner: black toner, yellow toner, magenta toner and cyan toner to form toner images, the charge-transferring unit 62 by which the toner image is transferred onto the intermediate transfer member 50, the photoconductor cleaning unit 63 and the discharger 64. The image forming unit 18 is able to form each single-colored image: black, yellow, magenta and cyan images, based on each color image information. These formed images: black image formed on the photoconductor 10K for black, yellow image formed on the photoconductor 10Y for yellow, magenta image formed on the photoconductor 10M for magenta and cyan image formed on the photoconductor 10C for cyan, are transferred sequentially onto the intermediate transfer member 50 which is being rotationally transported by the support rollers 14, 15 and 16 (the primary transfer). And the black, yellow, magenta and cyan images are overlapped to form a synthesized color image, a color transfer image.

In the feeding table 200, one of the feeding roller 142 is selectively rotated and sheets (recording paper) are rendered out from one of the feeding cassettes equipped with multiple-stage in the paper bank 143 and sent out to feeding path 146 after being separated one by one by the separation roller 145. The sheets are then transported to the feeding path 148 in the copier main body 150 by the transport roller 147 and are stopped running down to the resist roller 49. Alternatively, sheets (recording paper) on the manual paper tray 54 are rendered out by the rotating feeding roller 142, inserted into the manual feeding path 53 after being separated one by one by the separation roller 52 and stopped by running down to the resist roller 49. Generally, the resist roller 49 is used being grounded; however, it is also usable while bias is imposed for the sheet powder removal.

The resist roller 49 is rotated on the systhesized color image (color transfer image) on the intermediate transfer member 50 in a good timing, and a sheet (recording paper) is sent out between the intermediate transfer member 50 and the secondary transferring unit 22. The color image is then formed on the sheet (recording paper) by transferring (secondary transfer) the synthesized color image (color transfer image) by the secondary transferring unit 22. The residual toner on the intermediate transfer member 50 after the image transfer is cleaned by the intermediate transfer member cleaning unit 17.

The sheet (recording paper) on which the color image is transferred and formed is taken out by the secondary transferring unit 22 and sent out to the fixing unit 25 in order to fix the synthesized color image (color transfer image) onto the sheet (recording paper) under the thermal pressure. Triggered by the switch claw 55, the sheet (recording paper) is discharged by the discharge roller 56 and stacked on the discharge tray 57. Alternatively, triggered by the switch 55, the sheet is inverted by the sheet inversion unit 28 and led to the transfer position again. After recording an image on the reverse side, the sheet is then discharged by the discharge roller 56 and stacked on the discharge tray 57.

The image forming apparatus and the image forming processes of the invention, by employing latent electrostatic image forming members containing reactants from radical polymerizable compounds having three or more functionalities with no charge transport structure and radical polymerizable compounds having one functionality with charge transport structure, at least two antioxidant and crosslinked surface layers with less wear, can form high-resolution, high quality images for prolonged periods.

(Process Cartridge)

The process cartridge of the invention comprises at least latent electrostatic image bearing member that bears latent electrostatic images and developing unit by which a visible image is formed by developing latent electrostatic images supported by the latent electrostatic image bearing member using developer and other units as necessary.

The latent electrostatic image forming member comprises a support, at least a crosslinked surface layer and photosensitive layer disposed on the support. The crosslinked surface layer contains reactants from radical polymerizable compounds having three or more functionalities with no charge transport structure and radical polymerizable compounds having one functionality with charge transport structure, and at least two antioxidant, same as described above.

The developing unit include developer container which contains toner and/or developer and the developer bearing member which bear and transport the toner developer contained in a developer container and may also include layer thickness control members, etc. which controls bearing toner layer thickness.

The process cartridge of the invention is able and preferable to be placed on various image forming apparatuses as detachable.

Figure 10:
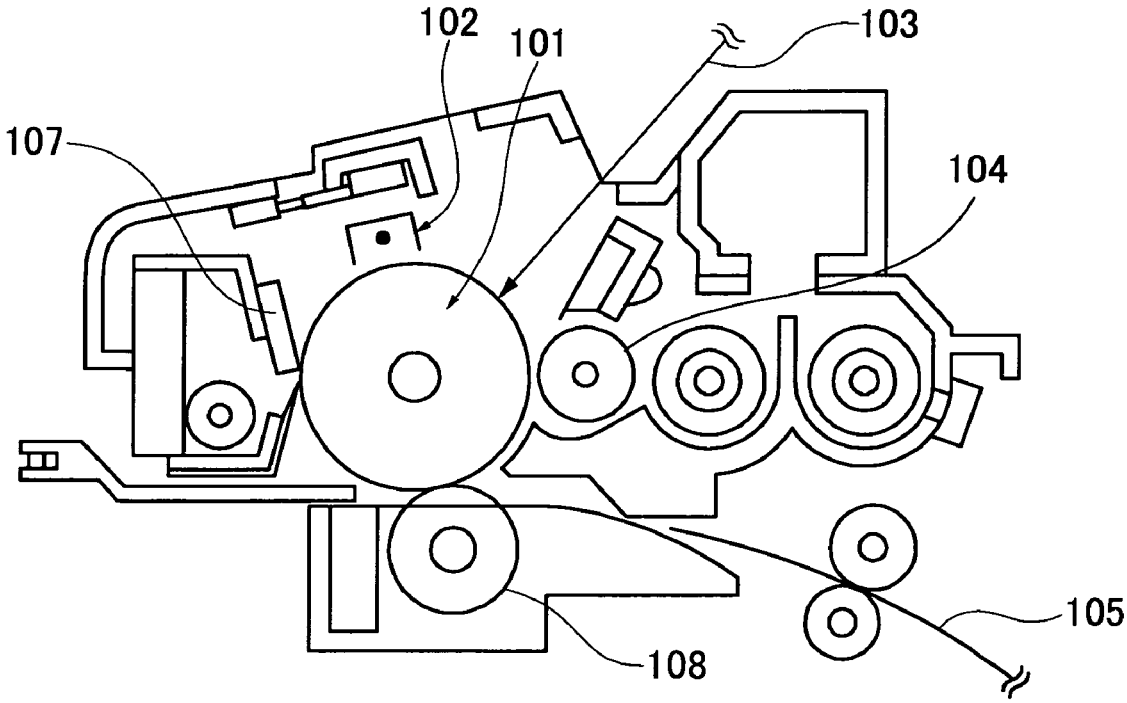
FIG. 10 schematically shows an exemplary process cartridge of the invention.

The process cartridge of the invention include, for example, built-in photoconductor 101, charging unit 102, developing unit 104, cleaning unit 107 and other units as necessary as shown in FIG. 10. In FIG. 10, 103 indicates exposing unit, 105 indicates recording medium and 108 indicates transporting roller.

The photoconductor 101 comprises a support and at least crosslinked surface layer and photosensitive layer on the support.

Known charging members, for example, are used as charging unit 102.

Light sources that are recordable at high resolution, for example, are used for exposing unit 103.

The image forming apparatus of the invention can be constructed as a process cartridge unit containing latent electrostatic image bearing member, developing machine and cleaning machine, etc. placed onto the main body as detachable. Alternatively, a process cartridge unit containing photoconductors and at least one selected from charger, image exposing machine, developing machine, transfer or separation machine and cleaning machine can be constructed and placed onto the main body of image forming apparatus as a detachable single-unit and this may be done by employing guidance unit such as main body rails, etc.

Herein below, with referring to Examples and Comparative Examples, the invention is explained in detail and the following Examples and Comparative Examples should not be construed as limiting the scope of this invention. All parts are expressed by mass unless indicated otherwise.

EXAMPLES

Example 1

The coating liquid for undercoat layer of the following composition below was coated onto the aluminum-made support with diameter of 30 mm by the dipping method while controlling dried layer thickness to be 3.5 μm to form an undercoat layer.

<Composition of Coating Liquid for Undercoat Layer>

- alkyd resin (Beckosol 1307-60-EL by Dainippon Ink and Chemicals, Inc.) . . . 6 parts
- melamine resin (Super Beckamine G-821-60 by Dainippon Ink and Chemicals, Inc.) . . . 4 parts
- Titanium oxide (CR-EL by Ishihara Sangyo Kaisha, Ltd.) . . . 40 parts
- methyl ethyl ketone . . . 50 parts The coating liquid for charge generating layer of the following composition was coated onto the undercoat layer by dipping-coating and dried by heating to form a charge generating layer with a thickness of 0.2 μm.

<Composition of Coating Liquid for Charge Generating Layer>

Bisazo pigments expressed by the following Structural Formula . . . 2.5 parts

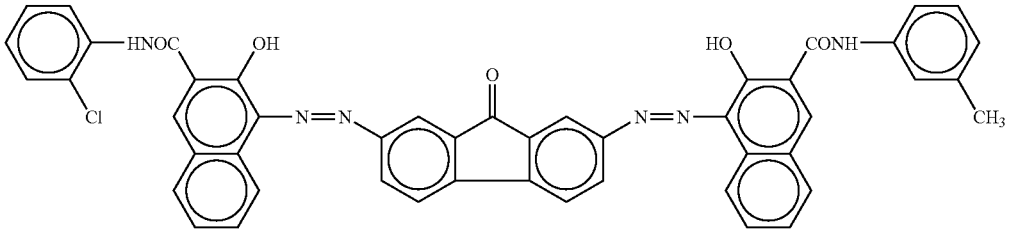

polyvinylbutyral (XYHL by UCC Inc.) . . . 0.5 parts cyclohexanone . . . 200 parts methyl ethyl ketone . . . 80 parts The coating liquid for charge transporting layer of the following composition was coated onto the charge generating layer by dipping-coating and dried by heating to form a charge transporting layer with a thickness of 22 μm.

<Composition of Coating Liquid for Charge Transporting Layer> bisphenol z-type polycarbonate . . . 10 parts low-molecule charge transport substance expressed by the following Structural Formula . . . 10 parts

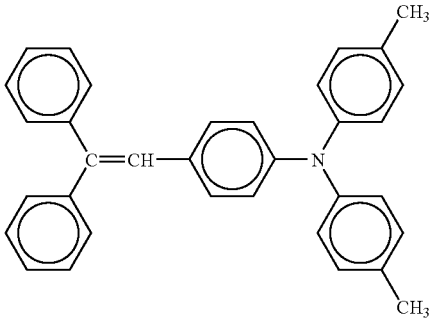

tetrahydrofuran . . . 80 parts tetrahydrofuran solution of 1% by mass of silicone oil (KF50 by Shin-etsu Chemical Co., Ltd.) . . . 0.2 parts After spray-coating the coating liquid for crosslinked surface layer of the following composition onto the charge transporting layer, light was irradiated by a metal halide lamp with 450 mW/cm$^2$ of irradiated light strength for 120 seconds. And it was dried at 130° C. for 30 minutes in order to form a crosslinked surface layer with a thickness of 4.0 μm. Then finally a latent electrostatic image bearing member was produced.

<Composition of Coating Liquid for Crosslinked Surface Layer> radical polymerizable monomer having three or more functionalities with no charge transport structure 1 (KAYARAD TMPTA by Nippon Kayaku Co., Ltd.) . . . 8 parts radical polymerizable monomerradical polymerizable monomer having three or more functionalities with no charge transport structure 2 (KAYARAD DPCA120 by Nippon Kayaku Co., Ltd.) . . . 2 parts radical polymerizable compound having one functionality with charge transport structure (Exemplified compounds No. 54) . . . 10 parts 1-hydroxy-cyclohexyl-phenyl-ketone as light-curing initiator (IRGACURE 184 by Ciba Specialty Chemicals) . . . 1 part tetrahydrofuran (containing 0.02 parts of phenolic antioxidant 2,6-di-t-butyl-p-cresol) . . . 80 parts bis (2,4, di-t-butylphenyl) pentaerythritol phosphate (ADK STAB PEP-24G by Asahi Denka Co., Ltd.) . . . 0.5 parts

Example 2

The latent electrostatic image bearing member was produced similarly to example 1 except for altering following composition of the coating liquid for crosslinked surface layer.

<Compostion of Coating Liquid for Crosslinked Surface Layer> radical polymerizable monomer having three or more functionalities with no charge transport structure 1 (KAYARAD TMPTA by Nippon Kayaku Co., Ltd.) . . . 8 parts radical polymerizable monomerradical polymerizable monomer having three or more functionalities with no charge transport structure 2 (KAYARAD DPCA120 by Nippon Kayaku Co., Ltd.) . . . 2 parts radical polymerizable compound having one functionality with charge transport structure (Exemplified compounds No. 56) . . . 10 parts 1-hydroxy-cyclohexyl-phenyl-ketone as light-curing initiator (IRGACURE 184 by Ciba Specialty Chemicals) . . . 1 part tetrahydrofuran (containing 0.02 parts of phenolic antioxidant 2,6-di-t-butyl-p-cresol) . . . 80 parts tetrakis[3-(3,5-di-t-butyl-4-hydroxyphonyl) propionyl oxymethyl]methane (Sumilizer BP-76 by Sumitomo Chemical Co., Ltd.) . . . 0.5 parts bis (2,4, di-t-butylphenyl) pentaerythritol phosphate (ADK STAB PEP-24G by Asahi Denka Co., Ltd.) . . . 0.5 parts Comparative Example 1

The latent electrostatic image bearing member was produced similarly to example 1 except for altering the following composition of coating liquid for crosslinked surface layer.

<Composition of Coating Liquid for Crosslinked Surface Layer> radical polymerizable monomer having three or more functionalities with no charge transport structure 1 (KAYARAD TMPTAby Nippon Kayaku Co., Ltd.) . . . 8 parts radical polymerizable monomerradical polymerizable monomer having three or more functionalities with no charge transport structure 2 (KAYARAD DPCA120 by Nippon Kayaku Co., Ltd.) . . . 2 parts radical polymerizable compound having one functionality with charge transport structure (Exemplified compounds No. 54) . . . 10 parts 1-hydroxy-cyclohexyl-phenyl-ketone as light-curing initiator (IRGACURE 184, by Ciba Specialty Chemicals) . . . 1 part tetrahydrofuran (containing 0.02 parts of phenolic antioxidant 2,6-di-t-butyl-p-cresol) . . . 80 parts Example 3

The latent electrostatic image bearing member was produced similarly to example 1 except for altering the following composition of coating liquid for crosslinked surface layer.

<Composition of Coating Liquid for Crosslinked Surface Layer> radical polymerizable monomer having three or more functionalities with no charge transport structure 1 (KAYARAD TMPTA by Nippon Kayaku Co., Ltd.) . . . 8 parts radical polymerizable monomerradical polymerizable monomer having three or more functionalities with no charge transport structure 2 (KAYARAD DPCA120 by Nippon Kayaku Co., Ltd.) . . . 2 parts radical polymerizable compound having one functionality with charge transport structure (Exemplified compounds No. 56) . . . 10 parts 1-hydroxy-cyclohexyl-phenyl-ketone as light-curing initiator (IRGACURE 184 by Ciba Specialty Chemicals) . . . 1 part tetrahydrofuran (containing 0.02 parts of phenolic antioxidant 2,6-di-t-butyl-p-cresol) . . . 80 parts tris (2,4-di-t-butylphenyl) phosphite (JP-650 by Johoku Chemical Co., Ltd.) . . . 0.3 parts Example 4

The latent electrostatic image bearing member was produced similarly to example 1 except for altering the following composition of coating liquid for crosslinked surface layer.

<Composition of Coating Liquid for Crosslinked Surface Layer> radical polymerizable monomer having three or more functionalities with no charge transport structure 1 (KAYARAD TMPTA by Nippon Kayaku Co., Ltd.) . . . 8 parts radical polymerizable monomerradical polymerizable monomer having three or more functionalities with no charge transport structure 2 (KAYARAD DPCA120 by Nippon Kayaku Co., Ltd.) . . . 2 parts radical polymerizable compound having one functionality with charge transport structure (Exemplified compounds No. 56) . . . 10 parts 1-hydroxy-cyclohexyl-phenyl-ketone as light-curing initiator (IRGACURE 184, by Ciba Specialty Chemicals) . . . 1 part tetrahydrofuran (containing 0.02 parts of phenolic antioxidant 2,6-di-t-butyl-p-cresol) . . . 80 parts bis (2,4-di-t-butylphenyl) pentaerythritol phosphate (ADK STAB PEP-24 by Asahi Denka Co., Ltd.) . . . 0.5 parts Comparative Example 2

The latent electrostatic image bearing member was produced similarly to example 1 except for altering the following composition of coating liquid for crosslinked surface layer.

<Composition of Coating Liquid for Crosslinked Surface Layer> radical polymerizable monomer having three or more functionalities with no charge transport structure 1 (KAYARAD TMPTA by Nippon Kayaku Co., Ltd.) . . . 8 parts radical polymerizable monomerradical polymerizable monomer having three or more functionalities with no charge transport structure 2 (KAYARAD DPCA120 by Nippon Kayaku Co., Ltd.) . . . 2 parts radical polymerizable compound having one functionality with charge transport structure (Exemplified compounds No. 54) . . . 10 parts 1-hydroxy-cyclohexyl-phenyl-ketone as light-curing stimulator (IRGACURE 184 by Ciba Specialty Chemicals) . . . 1 part tetrahydrofuran with no antioxidant . . . 80 parts Comparative Example 3

The latent electrostatic image bearing member was produced similarly to example 1 except for altering the following composition of coating liquid for crosslinked surface layer.

<Composition of Coating Liquid for Crosslinked Surface Layer> radical polymerizable monomer having three or more functionalities with no charge transport structure 1 (KAYARAD TMPTA by Nippon Kayaku Co., Ltd.) . . . 8 parts radical polymerizable monomerradical polymerizable monomer having three or more functionalities with no charge transport structure 2 (KAYARAD DPCA120 by Nippon Kayaku Co., Ltd.) . . . 2 parts radical polymerizable compound having one functionality with charge transport structure (Exemplified compounds No. 54) . . . 10 parts 1-hydroxy-cyclohexyl-phenyl-ketone as light-curing initiator (IRGACURE 184 by Ciba Specialty Chemicals) . . . 1 part tetrahydrofuran with no antioxidant . . . 80 parts 2,2-methylene bis (4,6-di-t-butylphenyl) octylphosphite (ADK STAB HP-10 by Asahi Denka Co., Ltd.) . . . 0.7 parts Example 5

The latent electrostatic image bearing member was produced similarly to example 1 except for altering the following composition of coating liquid for crosslinked surface layer.

<Composition of Coating Liquid for Crosslinked Surface Layer> radical polymerizable monomer having three or more functionalities with no charge transport structure 1 (KAYARAD TMPTA by Nippon Kayaku Co., Ltd.) . . . 5 parts radical polymerizable monomerradical polymerizable monomer having three or more functionalities with no charge transport structure 2 (KAYARAD DPCA120 by Nippon Kayaku Co., Ltd.) . . . 5 parts radical polymerizable compound having one functionality with charge transport structure (Exemplified compounds No. 54) . . . 10 parts 1-hydroxy-cyclohexyl-phenyl-ketone as light-curing initiator (IRGACURE 184 by Ciba Specialty Chemicals) . . . 1 part tetrahydrofuran (containing 0.02 parts of phenolic antioxidant 2,6-di-t-butyl-p-cresol) . . . 80 parts tetrakis[3-(3,5-di-t-butyl-4-hydroxyphonyl) propionyl oxymethyl]methane (Sumilizer BP-76 by Sumitomo Chemical Co., Ltd.) . . . 0.5 parts Example 6

The latent electrostatic image bearing member was produced similarly to example 1 except for altering the following composition of coating liquid for crosslinked surface layer.

<Composition of Coating Liquid for Crosslinked Surface Layer> radical polymerizable monomer having three or more functionalities with no charge transport structure 1 (KAYARAD TMPTA by Nippon Kayaku Co., Ltd.) . . . 5 parts radical polymerizable monomerradical polymerizable monomer having three or more functionalities with no charge transport structure 2 (KAYARAD DPCA120 by Nippon Kayaku Co., Ltd.) . . . 5 parts radical polymerizable compound having one functionality with charge transport structure (Exemplified compounds No. 54) . . . 10 parts 1-hydroxy-cyclohexyl-phenyl-ketone as light-curing initiator (IRGACURE 184 by Ciba Specialty Chemicals) . . . 1 part tetrahydrofuran (containing 0.02 parts of phenolic antioxidant 2,6-di-t-butyl-p-cresol) . . . 80 parts pentaerythritol tetrakis (3-laurylthiol propionate) (Sumilizer TDP by Sumitomo Chemical Co., Ltd.) . . . 0.5 parts Example 7

The latent electrostatic image bearing member was produced similarly to example 1 except for altering the following composition of coating liquid for crosslinked surface layer.

<Composition of Coating Liquid for Crosslinked Surface Layer> radical polymerizable monomer having three or more functionalities with no charge transport structure 1 (KAYARAD TMPTA by Nippon Kayaku Co., Ltd.) . . . 5 parts radical polymerizable monomerradical polymerizable monomer having three or more functionalities with no charge transport structure 2 (KAYARAD DPCA120 by Nippon Kayaku Co., Ltd.) . . . 5 parts radical polymerizable compound having one functionality with charge transport structure (Exemplified compounds No. 54) . . . 10 parts 1-hydroxy-cyclohexyl-phenyl-ketone as light-curing initiator (IRGACURE 184 by Ciba Specialty Chemicals) . . . 1 part tetrahydrofuran containing 0.02 parts of phenolic antioxidant 2,6-di-t-butyl-p-cresol . . . 80 parts di-stearyl pentaerythritol di-phosphite (ADK STAB PEP-8 by Asahi Denka Co., Ltd.) . . . 0.5 parts Example 8

A single-layered latent electrostatic image bearing member was produced by the following procedure.

<Composition of Pigment Dispersion Liquid> non-metal phthalocyanine pigment (Fastogen Blue8120B by Dainippon Ink And Chemicals, Inc.) . . . 3 parts cyclohexanone . . . 97 parts The above composition was introduced into a glass pot of 9 cm diameter and was dispersed at 100 rpm for 5 hours using PSZ ball of 0.5 mm diameter to produce pigment dispersion liquid. And the coating liquid for single-layered photoconductor of the following composition below was produced using obtained pigment dispersion liquid.

<Composition of Coating Liquid for Single-Layered Photoconductor> pigment dispersion liquid . . . 60 parts electron-hole transporting substance expressed by the following Structural Formula . . . 30 parts

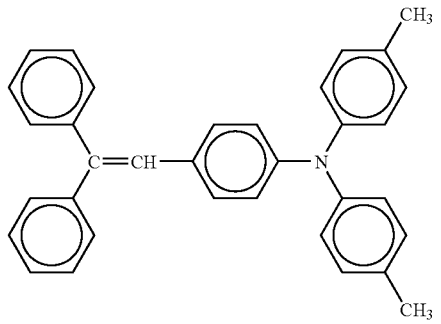

electron transporting substance expressed by the following Structural Formula . . . 20 parts

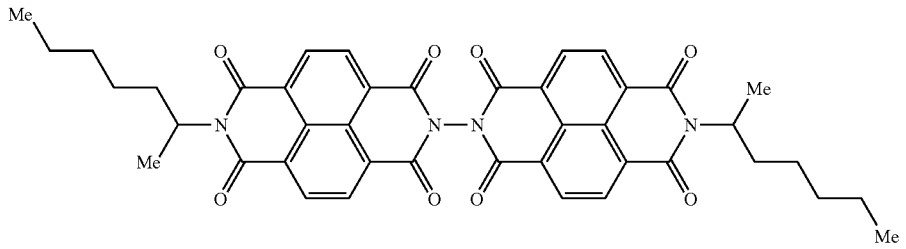

Z type polycarbonate resin (Panlite TS-2050 by Teijin Chemicals Ltd.) . . . 50 parts silicone oil (KF50 by Shin-Etsu Chemical Co., Ltd.) . . . 0.01 parts tetrahydrofuran . . . 350 parts The coating liquid for single-layered photoconductor was coated on an aluminum drum of 30 mm diameter by immersion coating method and dried to form a photosensitive layer of 25 μm thickness.

Next, after spray-coating the coating liquid for crosslinked surface layer of the following composition onto the charge transporting layer, light was irradiated by a metal halide lamp with 450 mW/cm$^2$ of irradiated light strength for 120 seconds. And it was dried at 130° C. for 30 minutes in order to form a crosslinked surface layer with a thickness of 4.0 μm. Then finally a single-layered photoconductor of Example 8 was produced.

<Composition of Coating Liquid for Crosslinked Surface Layer> radical polymerizable monomer having three or more functionalities with no charge transport structure 1 (KAYARAD TMPTA by Nippon Kayaku Co., Ltd.) . . . 8 parts radical polymerizable monomerradical polymerizable monomer having three or more functionalities with no charge transport structure 2 (KAYARAD DPCA120 by Nippon Kayaku Co., Ltd.) . . . 2 parts radical polymerizable compound having one functionality with charge transport structure (Exemplified compounds No. 54) . . . 10 parts 1-hydroxy-cyclohexyl-phenyl-ketone as light-curing initiator (IRGACURE 184 by Ciba Specialty Chemicals) . . . 1 part tetrahydrofuran (containing 0.02 parts of phenolic antioxidant 2,6-di-t-butyl-p-cresol) . . . 80 parts bis (2,4, di-t-butylphenyl) pentaerythritol phosphate (ADK STAB PEP-24G by Asahi Denka Co., Ltd.) . . . 0.5 parts

Comparative Example 4

The latent electrostatic image bearing member was produced similarly to example 1 except for not having crosslinked surface layer.

<Performance Evaluation>

Each produced latent electrostatic image bearing member, electrophotographic photoconductor, was placed on the image forming apparatus, reconstructed imagioNeo 270 with 655 nm of lazer diode as an image exposure light source, and the degree of wear, electric property and image quality were evaluated through actual machine operating test with 100,000 sheets (A4 size, MyPaper by NBS Ricoh Co., Ltd.) with a starting charge potential of −700V. Results are shown in Table 3, 4 and 5.

<Wear Measurement>

The thicknesses of before and after the actual machine operating test was measured by eddy-current film thickness meter (MMS by Fischer Instruments K.K.) and the amount of wear in μm was calculated from the difference between film thickness of before and after.

<Electric Property Evaluation>

The image forming apparatus, reconstructed imagioNeo 270 by Ricoh Company, Ltd. was reconstructed so that the surface potential meter can be attached inside, and each unexposed and exposed electric potential was measured in the beginning, after 50,000 and 100,000 sheets.

<Image Quality Evaluation>

Presence or absence of image disorder was determined by applying test chart S-3 at each image output in the beginning and after 50,000 and 100,000 sheets by using the image forming apparatus, reconstructed imagioNeo270 by Ricoh Company, Ltd.

TABLE 3

| | Wear (μm) | |
|---|---|---|
| | 50,000 sheets | 100,000 sheets |
| Example 1 | 0.61 | 1.12 |
| Example 2 | 0.71 | 1.27 |
| Example 3 | 0.53 | 1.01 |
| Example 4 | 0.49 | 0.93 |
| Example 5 | 0.64 | 1.20 |
| Example 6 | 0.77 | 1.53 |
| Example 7 | 0.81 | 1.19 |
| Example 8 | 0.62 | 1.14 |
| Comparative Example 1 | 0.6 | 1.19 |
| Comparative Example 2 | 0.65 | 1.24 |
| Comparative Example 3 | 0.68 | 1.30 |
| Comparative Example 4 | 5.34 | — |

The Comparative Example 4 was aborted after 50,000 sheets because of the large degree of wear.

TABLE 4

| | Electric Property (−V) | | | | | |
|---|---|---|---|---|---|---|
| | Beginning | | 50,000 sheets | | 100,000 sheets | |
| | Dark | Exposed | Dark | Exposed | Dark | Exposed |
| Example 1 | 700 | 80 | 700 | 85 | 695 | 95 |
| Example 2 | 700 | 85 | 700 | 95 | 705 | 100 |
| Example 3 | 700 | 75 | 695 | 80 | 690 | 90 |
| Example 4 | 700 | 80 | 690 | 85 | 690 | 90 |
| Example 5 | 700 | 90 | 680 | 110 | 675 | 120 |
| Example 6 | 700 | 90 | 695 | 105 | 690 | 115 |
| Example 7 | 700 | 95 | 690 | 100 | 680 | 105 |
| Example 8 | 700 | 95 | 690 | 110 | 690 | 120 |
| Comparative Example 1 | 700 | 80 | 660 | 90 | 645 | 95 |
| Comparative Example 2 | 700 | 85 | 655 | 85 | 640 | 90 |
| Comparative Example 3 | 700 | 90 | 665 | 95 | 650 | 100 |
| Comparative Example 4 | 700 | 55 | 750 | 60 | — | — |

Image Property (Chart S-3 Evaluation)

TABLE 5

| | Image Properties | | |
|---|---|---|---|
| | Beginning | 50,000 sheets | 100,000 sheets |
| Example 1 | good | good | good |
| Example 2 | good | good | good |
| Example 3 | good | good | good |
| Example 4 | good | good | good |
| Example 5 | good | good | slight fog |
| Example 6 | good | good | good |
| Example 7 | good | good | slight fog |
| Example 8 | good | good | good |
| Comparative Example 1 | good | fog in entire surface | fog in entire surface |
| Comparative Example 2 | good | fog in entire surface | fog in entire surface |
| Comparative Example 3 | good | slight fog | fog in entire surface |
| Comparative Example 4 | good | black streak | — |

From the results shown in Tables 3 to 5, the Examples 1 to 7 that used the latent electrostatic image bearing members having reactants from radical polymerizable compounds having three functionalities with no charge transport structure and radical polymerizable compounds having one functionality with charge transportable structure and at least two different antioxidants in the crosslinked surface layer can provide high-quality images for prolonged periods, owing to excellent flaw and wear resistance and appropriate electric properties compared to the Comparative Examples 1 to 4.

What is claimed is:

1. A latent electrostatic image bearing member, comprising:

a support; and at least a photosensitive layer and a crosslinked surface layer disposed on the support;

wherein:

the crosslinked surface layer comprises a reaction product of a radical polymerizable compound having three or more functionalities with no charge transport structure, a radical polymerizable compound having one functionality with charge transport structure, a phosphoric antioxidant and a phenolic antioxidant; and a content of the phosphoric antioxidant is 2 parts by mass to 50 parts by mass relative to 1 part by mass of the phenolic antioxidant.

2. The latent electrostatic image bearing member according to claim 1, wherein the antioxidants are present in the crosslinked surface layer in an amount of from 0.2% by mass to 10% by mass.

3. The latent electrostatic image bearing member according to claim 1, wherein the melting point of the phosphoric antioxidant is 100° C. or more.

4. The latent electrostatic image bearing member according to claim 1, wherein the functional group of the radical polymerizable compound having three or more functionalities with no charge transport structure comprises at least one of an acryloyloxy group and a methacryloyloxy group.

5. The latent electrostatic image bearing member according to claim 1, wherein the molecular-mass ratio relative to the number of functional groups, molecular mass/number of functional groups, in the radical polymerizable compound having three or more functionalities with no charge transport structure is 250 or less.

6. The latent electrostatic image bearing member according to claim 1, wherein the functional group of radical polymerizable compound having one functionality with charge transport structure is any one of an acryloyloxy group and a methacryloyloxy group.

7. The latent electrostatic image bearing member according to claim 1, wherein the charge transport structure of the radical polymerizable compound having one functionality with charge transport structure is a triarylamine structure.

8. The latent electrostatic image bearing member according to claim 1, wherein the radical polymerizable compound having one functionality with charge transport structure is selected from the compounds expressed by the following Structural Formulas (1) and (2):

Structural Formula (1)

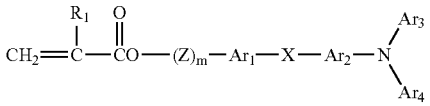

Structural Formula (2)

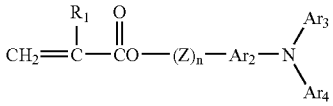

where:

R1 represents hydrogen atom, halogen atom, eyano group, nitro group, alkyl group which may be substituted, aralkyl group which may be substituted, aryl group which may be substituted, alkoxy group, —COOR7 (R7 represents hydrogen atom, alkyl group which may be substituted, aralkyl group which may be substituted, aryl group which may be substituted), halogenated carbonyl group or —CONR8R9 (R8 and R9 may be identical or heterogeneous and represent hydrogen atom, halogen atom, alkyl group which may be substituted, aralkyl group which may be substituted, aryl group which may be substituted);

Ar1 and Ar2 may be identical or heterogeneous and represent arylene group which may be substitute;

Ar3 and Ar4 may be identical or heterogeneous and represent aryl group which may be substituted;

X represents single bond, alkylene group which may be substituted, cycloalkylene group which may be substituted, alkylene ether group which may be substituted, oxygen atom, sulfur atom or vinylene group;

Z represents alkylene group which may be substituted, alkylene ether bivalent group which may be substituted or alkylene oxycarbonyl bivalent group; and each "m" and "n" represents an integer of 0 to 3.

9. The latent electrostatic image bearing member according to claim 1, wherein the radical polymerizable compound having one functionality with charge transport structure is selected from the compounds expressed by the following Structural Formula (3):

Structural Formula (3)

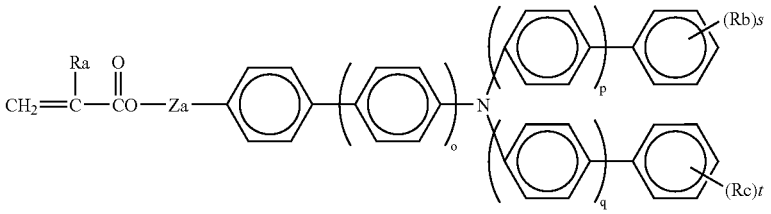

where:

each "o," "p", and "q" represents an integer of 0 or 1; Ra represents hydrogen atom or methyl group;

Rb and Rc may be identical or heterogeneous and represent alkyl group with carbon numbers 1 to 6; and each "s" and "t" represents an integer of 0 to 3; Za represents single bond, methylene group, ethylene group, or groups expressed by following Structural Formulas:

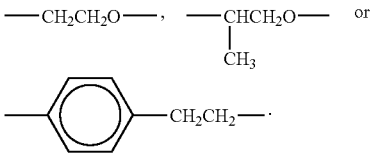

10. The latent electrostatic image bearing member according to claim 1, wherein a content of the radical polymerizable compound having three or more functionalities with no charge transport structure is 20% by mass to 80% by mass based on the total mass of the crosslinked surface layer.

11. The latent electrostatic image bearing member according to claim 1, wherein a content of the radical polymerizable compound having one functionality with charge transport structure is 20% by mass to 80% by mass based on the total mass of the crosslinked surface layer.

12. The latent electrostatic image bearing member according to claim 1, wherein the photosensitive layer comprises a charge transport polymer.

13. The latent electrostatic image bearing member according to claim 12, wherein the charge transport polymer is a polycarbonate resin having principal chain or side chain of triarylamine structure.

14. The latent electrostatic image bearing member according to claim 1, wherein the photosensitive layer is a single-layered photosensitive layer.

15. The latent electrostatic image bearing member according to claim 1, wherein the photosensitive layer is a laminated photosensitive layer comprising at least a charge generating layer and a charge transporting layer in this order on the support.

16. An image forming method comprising:

forming a latent electrostatic image on a latent electrostatic image bearing member, and developing the latent electrostatic image using toner to form a visible image, and transferring the visible image onto a recording medium, and fixing the transferred image on the recording medium, wherein the latent electrostatic image bearing member comprises:

a support, and at least a photosensitive layer and a crosslinked surface layer disposed on the support, wherein:

the crosslinked surface layer comprises a reaction product of a radical polymerizable compound having three or more functionalities with no charge transport structure, a radical polymerizable compound having one functionality with charge transport structure, a phosphoric antioxidant and a phenolic antioxidant; and a content of the phosphoric antioxidant is 2 parts by mass to 50 parts by mass relative to 1 part by mass of the phenolic antioxidant.

17. An image forming apparatus comprising:

a latent electrostatic image bearing member, a latent electrostatic image forming unit configured to form a latent electrostatic image on the latent electrostatic image bearing member, a developing unit configured to develop the latent electrostatic image using toner to form a visible image, a transferring unit configured to transfer the visible image onto a recording medium, and a fixing unit configured to fix the transferred image on the recording medium, wherein the latent electrostatic image bearing member comprises:

a support, and at least a photosensitive layer and a crosslinked surface layer disposed on the support, wherein:

the crosslinked surface layer comprises a reaction product of a radical polymerizable compound having three or more functionalities with no charge transport structure, a radical polymerizable compound having one functionality with charge transport structure, a phosphoric antioxidant and a phenolic antioxidant; and a content of the phosphoric antioxidant is 2 parts by mass to 50 parts by mass relative to 1 part by mass of the phenolic antioxidant.

18. The image forming apparatus according to claim 17, wherein the latent electrostatic image forming unit comprises at least a charger whereby the surface of the latent electrostatic image bearing member is charged and an exposure machine whereby the surface of the latent electrostatic image bearing member is exposed.

19. The image forming apparatus according to claim 18, wherein an exhaust path is placed over the charger and the fixing unit; a charger fan is mounted on the opening part of the exhaust path near the charger; a fixing unit fan is mounted on the opening part of the exhaust path near the fixing unit; a heat conductive member that can heat up inside the exhaust path is placed in the exhaust path facing the fixing unit.

20. The image forming apparatus according to claim 19, wherein a generated ozone from the charger is removed by activating the charger fan to produce an air stream from the charger side down to the fixing unit side at the time of image forming and the latent electrostatic image bearing member is dehumidified by activating fixing unit fan to produce an air stream from the fixing unit side down to the charger side at the time of none image-forming.

21. The image forming apparatus according to claim 19, wherein the latent electrostatic image bearing member is rotated while an air stream is produced from the fixing unit side down to the charger side.

22. A process cartridge comprising:

a latent electrostatic image bearing member, and a developing unit configured to develop a latent electrostatic image using toner to form a visible image, wherein the latent electrostatic image bearing member comprises:

a support, and at least a photosensitive layer and a crosslinked surface layer disposed on the support, wherein:

the crosslinked surface layer comprises a reaction product of a radical polymerizable compound having three or more functionalities with no charge transport structure, a radical polymerizable compound having one functionality with charge transport structure, a phosphoric antioxidant and a phenolic antioxidant; and a content of the phosphoric antioxidant is 2 parts by mass to 50 parts by mass relative to 1 part by mass of the phenolic antioxidant.

* * * * *